US011951363B2

(12) United States Patent
Beach et al.

(10) Patent No.: US 11,951,363 B2
(45) Date of Patent: Apr. 9, 2024

(54) GOLF CLUB HEAD

(71) Applicant: Taylor Made Golf Company, Inc., Carlsbad, CA (US)

(72) Inventors: Todd P. Beach, Encinitas, CA (US); Nathan T. Sargent, Oceanside, CA (US); Peter T. Larsen, San Marcos, CA (US); Kraig Alan Willett, Fallbrook, CA (US); Bing-Ling Chao, San Diego, CA (US); John Francis Lorentzen, El Cajon, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 18/232,078

(22) Filed: Aug. 9, 2023

(65) Prior Publication Data

US 2023/0381603 A1 Nov. 30, 2023

Related U.S. Application Data

(63) Continuation of application No. 18/103,363, filed on Jan. 30, 2023, which is a continuation of application (Continued)

(51) Int. Cl.

| | |
|---|---|
| ***A63B 53/04*** | (2015.01) |
| ***A63B 53/08*** | (2015.01) |
| *A63B 60/00* | (2015.01) |

(52) U.S. Cl.

CPC ..... *A63B 53/0466* (2013.01); *A63B 53/04* (2013.01); *A63B 53/08* (2013.01); (Continued)

(58) Field of Classification Search

CPC ..... A63B 53/042; A63B 53/0425; A63B 53/0429; A63B 53/0466; A63B 53/04; (Continued)

(56) References Cited

U.S. PATENT DOCUMENTS

| | | | |
|---|---|---|---|
| 1,671,956 | A | 5/1928 | Sime |
| 2,087,685 | A | 7/1937 | Hackney |

(Continued)

FOREIGN PATENT DOCUMENTS

| | | |
|---|---|---|
| GB | 2321201 | 7/1998 |
| JP | 05212139 | 8/1993 |

(Continued)

OTHER PUBLICATIONS

Photos of Taylormade Burner 2007 Driver, Callaway FT-5 Driver, Callaway FTi Driver, Cobra L4V Cross-section Driver, Cobra Speed LD Driver, Nike SQ Driver, PING Rapture Driver, Taylormade R7 425 Driver, Taylormade R7 460 Driver, Taylormade R7 Superquad Driver, Titleist 905S Driver, and Titleist907 D2 Driver, 6 pp., all prior to Oct. 27, 2009.

*Primary Examiner* — John E Simms, Jr.
(74) *Attorney, Agent, or Firm* — Klarquist Sparkman, LLP

(57) ABSTRACT

A golf club head is described having a body defining an interior cavity and comprising a heel portion, a toe portion, and a sole portion positioned at a bottom portion of the golf club head, and a crown positioned at a top portion. The body has a forward portion and a rearward portion. The club head can have a non-metallic striking surface positioned at the forward portion of the body.

36 Claims, 37 Drawing Sheets

Related U.S. Application Data

No. 16/817,311, filed on Mar. 12, 2020, now Pat. No. 11,596,841, which is a continuation of application No. 16/057,406, filed on Aug. 7, 2018, now Pat. No. 10,632,350, which is a continuation of application No. 14/862,438, filed on Sep. 23, 2015, now Pat. No. 10,065,083, which is a continuation of application No. 12/589,804, filed on Oct. 27, 2009, now Pat. No. 9,162,115.

(52) U.S. Cl.
CPC ..... *A63B 53/0408* (2020.08); *A63B 53/0412* (2020.08); *A63B 53/0416* (2020.08); *A63B 53/045* (2020.08); *A63B 53/0454* (2020.08); *A63B 53/0458* (2020.08); *A63B 53/0462* (2020.08); *A63B 2053/0491* (2013.01); *A63B 60/002* (2020.08); *A63B 2209/00* (2013.01); *A63B 2209/02* (2013.01)

(58) Field of Classification Search
CPC . A63B 53/08; A63B 53/0408; A63B 53/0412; A63B 53/0416; A63B 2053/0491
USPC ..... 473/329, 330, 332
See application file for complete search history.

(56) References Cited

U.S. PATENT DOCUMENTS 3,233,905 A 2/1966 Flom
4,432,549 A 2/1984 Zebelean
4,826,172 A 5/1989 Antonious
4,884,812 A 12/1989 Nagasaki et al.
4,928,965 A 5/1990 Yamaguchi et al.
5,028,049 A 7/1991 McKeighen
5,076,585 A 12/1991 Bouquet
5,362,047 A 11/1994 Shaw et al.
5,425,538 A 6/1995 Vincent et al.
5,451,056 A 9/1995 Manning
5,465,970 A 11/1995 Adams et al.
5,595,552 A 1/1997 Wright et al.
5,626,530 A 5/1997 Schmidt et al.
5,643,108 A 7/1997 Cheng
5,707,302 A 1/1998 Leon et al.
5,766,094 A 6/1998 Mahaffey et al.
5,776,011 A 7/1998 Su et al.
5,830,084 A 11/1998 Kosmatka
5,851,160 A 12/1998 Rugge et al.
5,873,795 A 2/1999 Wozny et al.
5,906,549 A 5/1999 Kubica
5,921,869 A 7/1999 Blough et al.
5,971,868 A 10/1999 Kosmatka
5,993,331 A 11/1999 Shieh
6,010,411 A 1/2000 Reyes
6,074,309 A 6/2000 Mahaffey
6,224,494 B1 5/2001 Patsky
6,248,025 B1 6/2001 Murphy et al.
6,290,609 B1 9/2001 Takeda
6,319,150 B1 11/2001 Werner et al.
6,348,015 B1 2/2002 Kosmatka
6,379,262 B1 4/2002 Boone
6,413,169 B1 7/2002 Kosmatka
6,428,425 B1 8/2002 Naruo et al.
6,428,427 B1 8/2002 Kosmatka
6,488,594 B1 12/2002 Card et al.
6,558,272 B2 5/2003 Helmstetter et al.
6,605,007 B1 8/2003 Bissonnette et al.
6,612,938 B2 9/2003 Murphy et al.
6,652,391 B1 11/2003 Kubica et al.
6,719,644 B2 4/2004 Beach
6,773,360 B2 8/2004 Willett et al.
6,780,124 B2 8/2004 Lu
6,800,038 B2 10/2004 Willett et al.
6,800,039 B1 10/2004 Tseng
6,821,214 B2 11/2004 Rice
6,824,475 B2 11/2004 Burnett et al.
6,878,073 B2 4/2005 Takeda
6,899,638 B2 5/2005 Iwata et al.
6,904,663 B2 6/2005 Willett et al.
6,926,618 B2 8/2005 Sanchez et al.
6,991,558 B2 1/2006 Beach et al.
6,997,820 B2 2/2006 Willett et al.
7,018,303 B2 3/2006 Yamamoto
7,025,692 B2 4/2006 Erickson et al.
7,029,403 B2 4/2006 Rice et al.
7,066,832 B2 6/2006 Willett et al.
7,097,573 B2 8/2006 Erickson et al.
7,101,289 B2 9/2006 Gibbs et al.
7,131,912 B1 11/2006 Knuth
7,137,907 B2 11/2006 Gibbs et al.
7,140,974 B2 11/2006 Chao et al.
7,147,572 B2 12/2006 Kohno
7,166,040 B2 1/2007 Hoffman et al.
7,166,041 B2 1/2007 Evans
7,166,207 B2 1/2007 Chao et al.
7,186,190 B1 * 3/2007 Beach ..... A63B 53/06 473/335
7,192,364 B2 3/2007 Long
7,258,626 B2 8/2007 Gibbs et al.
7,261,643 B2 8/2007 Rice et al.
7,267,620 B2 9/2007 Chao et al.
7,331,877 B2 2/2008 Yamaguchi et al.
7,361,099 B2 4/2008 Rice et al.
7,384,348 B2 6/2008 Lin et al.
7,407,447 B2 8/2008 Beach et al.
7,419,441 B2 9/2008 Hoffman et al.
7,442,132 B2 10/2008 Nishio
7,527,565 B1 5/2009 Ehlers et al.
7,549,934 B2 6/2009 Rice
7,575,524 B2 8/2009 Willett et al.
7,575,525 B2 8/2009 Matsunaga et al.
7,585,233 B2 9/2009 Horacek et al.
7,591,736 B2 9/2009 Ban
7,682,262 B2 3/2010 Soracco et al.
7,704,162 B2 4/2010 Rice et al.
7,762,907 B2 7/2010 Rice
7,785,213 B2 8/2010 Matsunaga et al.
7,798,916 B2 9/2010 Matsunaga et al.
7,883,431 B2 2/2011 Matsunaga et al.
8,308,582 B2 11/2012 Tanimoto
8,444,505 B2 5/2013 Beach et al.
9,162,115 B1 * 10/2015 Beach ..... A63B 60/00
9,199,138 B2 12/2015 Willett et al.
9,452,327 B2 9/2016 Willet et al.
10,195,497 B1 2/2019 Greaney et al.
11,596,841 B2 * 3/2023 Beach ..... A63B 53/04
2001/0051548 A1 12/2001 Iwata et al.
2002/0065146 A1 5/2002 Kusumoto
2002/0068646 A1 * 6/2002 Yoneyama ..... A63B 53/04 473/345
2003/0036442 A1 2/2003 Chao et al.
2004/0235584 A1 * 11/2004 Chao ..... A63B 53/0466 473/342
2005/0009634 A1 * 1/2005 Rice ..... A63B 53/0466 473/345
2005/0059508 A1 3/2005 Burnett et al.
2005/0181884 A1 8/2005 Beach et al.
2005/0221913 A1 10/2005 Kusumoto
2005/0239575 A1 10/2005 Chao et al.
2006/0068932 A1 * 3/2006 Rice ..... A63B 53/0466 473/345
2006/0079347 A1 * 4/2006 Gibbs ..... A63B 53/04 473/345
2006/0079348 A1 4/2006 Murphy
2006/0252576 A1 11/2006 Lo
2006/0287129 A1 * 12/2006 Billings ..... A63B 53/0466 473/338
2007/0054750 A1 * 3/2007 Rice ..... A63B 60/00 473/329
2007/0105653 A1 * 5/2007 Beach ..... A63B 60/00 473/336

(56) References Cited

U.S. PATENT DOCUMENTS

| | | | | |
|---|---|---|---|---|
| 2007/0293344 | A1* | 12/2007 | Davis | A63B 53/0466 473/336 |
| 2008/0039228 | A1* | 2/2008 | Breier | A63B 60/00 473/345 |
| 2008/0058116 | A1 | 3/2008 | Rae et al. | |
| 2008/0132356 | A1 | 6/2008 | Chao et al. | |
| 2008/0139334 | A1 | 6/2008 | Willett et al. | |
| 2008/0146374 | A1* | 6/2008 | Beach | A63B 60/00 473/350 |
| 2008/0149267 | A1 | 6/2008 | Chao | |
| 2008/0254911 | A1 | 10/2008 | Beach et al. | |
| 2008/0300068 | A1 | 12/2008 | Chao | |
| 2009/0005191 | A1 | 1/2009 | Lin | |
| 2009/0088271 | A1 | 4/2009 | Beach et al. | |
| 2009/0163289 | A1* | 6/2009 | Chao | A63B 53/0466 473/331 |
| 2009/0163291 | A1 | 6/2009 | Chao | |
| 2009/0163292 | A1 | 6/2009 | Chao | |
| 2009/0163296 | A1* | 6/2009 | Chao | A63B 53/0466 264/258 |
| 2009/0227389 | A1 | 9/2009 | Meyer et al. | |
| 2009/0264218 | A1 | 10/2009 | Willett et al. | |
| 2010/0075773 | A1 | 3/2010 | Casati, Jr. | |
| 2010/0087270 | A1* | 4/2010 | Ban | A63B 53/047 473/331 |
| 2017/0007891 | A1 | 1/2017 | Jertson et al. | |
| 2019/0201754 | A1* | 7/2019 | Hoffman | A63B 53/06 |
| 2020/0114229 | A1 | 4/2020 | Milleman et al. | |
| 2021/0299526 | A1 | 9/2021 | Carr et al. | |
| 2022/0072398 | A1 | 3/2022 | Milleman et al. | |

FOREIGN PATENT DOCUMENTS

| | | |
|---|---|---|
| JP | 06182005 | 7/1994 |
| JP | 06218083 | 8/1994 |
| JP | 07163687 | 6/1995 |
| JP | 08155060 | 6/1996 |
| JP | 08243194 | 9/1996 |
| JP | 8280853 | 10/1996 |
| JP | 08308967 | 11/1996 |
| JP | 2651565 | 5/1997 |
| JP | 09239074 | 9/1997 |
| JP | 09253243 | 9/1997 |
| JP | 09299519 | 11/1997 |
| JP | 11042300 | 2/1999 |
| JP | 11216204 | 8/1999 |
| JP | 11235406 | 8/1999 |
| JP | 2000126340 | 5/2000 |
| JP | 2001252379 | 9/2001 |
| JP | 2002-017912 | 1/2002 |
| JP | 2002000777 | 1/2002 |
| JP | 2002136626 | 5/2002 |
| JP | 2002143350 | 5/2002 |
| JP | 2002165904 | 6/2002 |
| JP | 2003102879 | 4/2003 |
| JP | 2003210622 | 7/2003 |
| JP | 2003310807 | 11/2003 |
| JP | 2004097550 | 4/2004 |
| JP | 2004129943 | 4/2004 |
| JP | 2004129944 | 4/2004 |
| JP | 2004135990 | 5/2004 |
| JP | 2004208728 | 7/2004 |
| JP | 2004267630 | 9/2004 |
| JP | 2004298478 | 10/2004 |
| JP | 2006166975 | 6/2006 |
| JP | 2006167279 | 6/2006 |
| JP | 2006263162 | 10/2006 |
| JP | 2006320493 A | 11/2006 |
| JP | 2007082752 | 4/2007 |
| JP | 2007313330 | 12/2007 |
| WO | WO 2007/101350 A1 | 9/2007 |

* cited by examiner

-18° ORIENTATION

0° ORIENTATION

+18° ORIENTATION

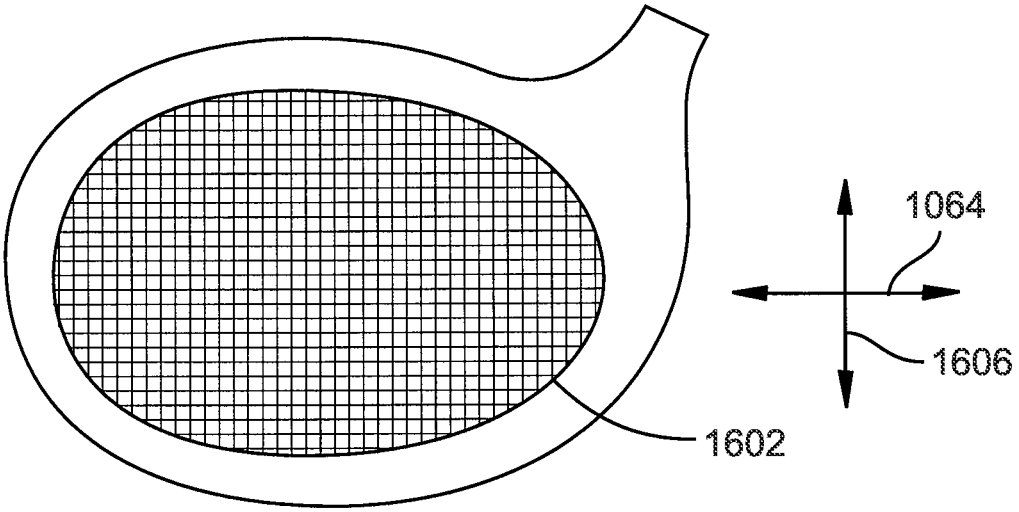
FIG. 47
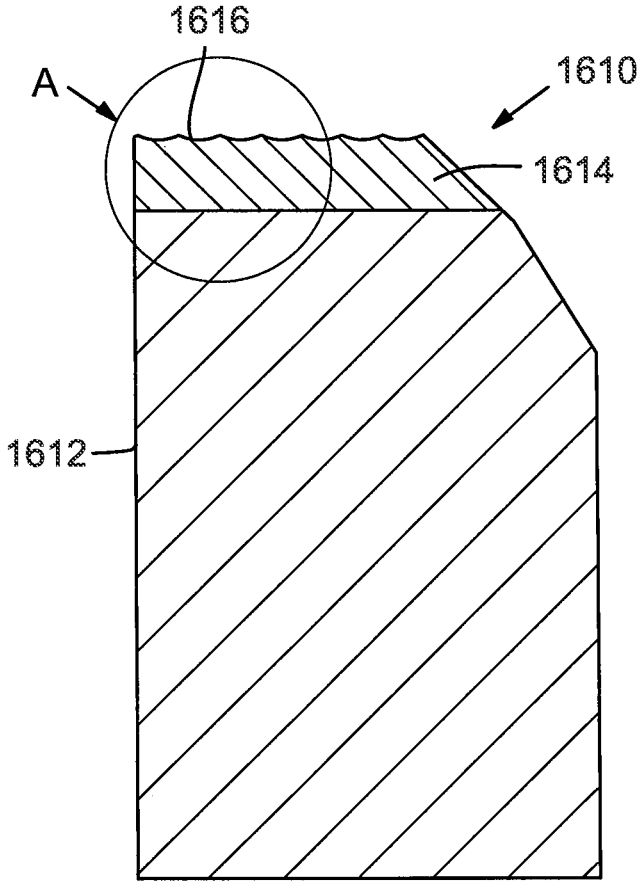
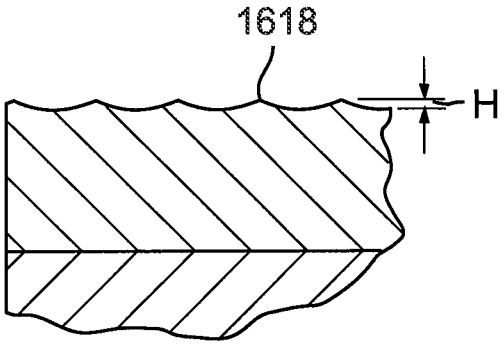
FIG. 49
FIG. 48

GOLF CLUB HEAD

CROSS-REFERENCE TO RELATED APPLICATIONS

This application is a continuation of U.S. patent application Ser. No. 18/103,363, filed Jan. 30, 2023, which is a continuation of U.S. patent application Ser. No. 16/817,311, filed Mar. 12, 2020 (U.S. Pat. No. 11,596,841, issued Mar. 7, 2023), which is a continuation of U.S. patent application Ser. No. 16/057,406, filed Aug. 7, 2018 (U.S. Pat. No. 10,632,350, issued Apr. 28, 2020), which is a continuation of U.S. patent application Ser. No. 14/862,438, filed Sep. 23, 2015 (U.S. Pat. No. 10,065,083, issued Sep. 4, 2018), which is a continuation of U.S. patent application Ser. No. 12/589,804, filed Oct. 27, 2009 (U.S. Pat. No. 9,162,115, issued Oct. 20, 2015); each of these prior applications is incorporated herein by reference in its entirety.

These and all other referenced patents and applications are incorporated herein by reference in their entirety. Furthermore, where a definition or use of a term in a reference, which is incorporated by reference herein is inconsistent or contrary to the definition of that term provided herein, the definition of that term provided herein applies and the definition of that term in the reference does not apply.

BACKGROUND

Golf is a game in which a player, using many types of clubs, hits a ball into each hole on a golf course in the lowest possible number of strokes. Golf club head manufacturers and designers seek to improve certain performance characteristics such as forgiveness, playability, feel, and sound. In addition, the aesthetic of the golf club head must be maintained while the performance characteristics are enhanced.

In general, "forgiveness" is defined as the ability of a golf club head to compensate for mis-hits where the golf club head strikes a golf ball outside of the ideal contact location. Furthermore, "playability" can be defined as the ease in which a golfer can use the golf club head for producing accurate golf shots. Moreover, "feel" is generally defined as the sensation a golfer feels through the golf club upon impact, such as a vibration transferring from the golf club to the golfer's hands. The "sound" of the golf club is also important to monitor because certain impact sound frequencies are undesirable to the golfer.

Golf head forgiveness can be directly measured by the moments of inertia of the golf club head. A moment of inertia is the measure of a golf head's resistance to twisting upon impact with a golf ball. Generally, a high moment of inertia value for a golf club head will translate to a lower amount of twisting in the golf club head during "off-center" hits. Because the amount of twisting in the golf club head is reduced, the likelihood of producing a straight golf shot has increased thereby increasing forgiveness. In addition, a higher moment of inertia can increase the ball speed upon impact thereby producing a longer golf shot.

The United States Golf Association (USGA) regulations constrain golf club head shapes, sizes, and moments of inertia. Due to theses constraints, golf club manufacturers and designers struggle to produce a club having maximum size and moment of inertia characteristics while maintaining all other golf club head characteristics.

With the ever-increasing popularity and competitiveness of golf, substantial effort and resources are currently being expended to improve golf clubs so that increasingly more golfers can have more enjoyment and more success at playing golf. Much of this improvement activity has been in the realms of sophisticated materials and club-head engineering. For example, modern "wood-type" golf clubs (notably, "drivers," "fairway woods," and "utility clubs"), with their sophisticated shafts and non-wooden club-heads, bear little resemblance to the "wood" drivers, low-loft long-irons, and higher numbered fairway woods used years ago. These modern wood-type clubs are generally called "metal-woods."

An exemplary metal-wood golf club such as a fairway wood or driver typically includes a hollow shaft having a lower end to which the club-head is attached. Most modern versions of these club-heads are made, at least in part, of a light-weight but strong metal such as titanium alloy. The club-head comprises a body to which a strike plate (also called a face plate) is attached or integrally formed. The strike plate defines a front surface or strike face that actually contacts the golf ball.

The current ability to fashion metal-wood club-heads of strong, light-weight metals and other materials has allowed the club-heads to be made hollow. Use of materials of high strength and high fracture toughness has also allowed club-head walls to be made thinner, which has allowed increases in club-head size, compared to earlier club-heads. Larger club-heads tend to provide a larger "sweet spot" on the strike plate and to have higher club-head inertia, thereby making the club-heads more "forgiving" than smaller club-heads. Characteristics such as size of the sweet spot are determined by many variables including the shape profile, size, and thickness of the strike plate as well as the location of the center of gravity (CG) of the club-head.

The distribution of mass around the club-head typically is characterized by parameters such as rotational moment of inertia (MOI) and CG location. Club-heads typically have multiple rotational MOIs, each associated with a respective Cartesian reference axis (x, y, z) of the club-head. A rotational MOI is a measure of the club-head's resistance to angular acceleration (twisting or rotation) about the respective reference axis. The rotational MOIs are related to, inter alia, the distribution of mass in the club-head with respect to the respective reference axes. Each of the rotational MOIs desirably is maximized as much as practicable to provide the club-head with more forgiveness.

Another factor in modern club-head design is the face plate. Impact of the face plate with the golf ball results in some rearward instantaneous deflection of the face plate. This deflection and the subsequent recoil of the face plate are expressed as the club-head's coefficient of restitution (COR). A thinner face plate deflects more at impact with a golf ball and potentially can impart more energy and thus a higher rebound velocity to the struck ball than a thicker or more rigid face plate. Because of the importance of this effect, the COR of clubs is limited under United States Golf Association (USGA) rules.

Regarding the total mass of the club-head as the club-head's mass budget, at least some of the mass budget must be dedicated to providing adequate strength and structural support for the club-head. This is termed "structural" mass. Any mass remaining in the budget is called "discretionary" or "performance" mass, which can be distributed within the club-head to address performance issues, for example.

Some current approaches to reducing structural mass of a club-head are directed to making at least a portion of the club-head of an alternative material. Whereas the bodies and face plates of most current metal-woods are made of titanium alloy, several "hybrid" club-heads are available that are made, at least in part, of components formed from both graphite/epoxy-composite (or another suitable composite material) and a metal alloy. For example, in one group of these hybrid club-heads a portion of the body is made of carbon-fiber (graphite)/epoxy composite and a titanium alloy is used as the primary face-plate material. Other club-heads are made entirely of one or more composite materials. Graphite composites have a density of approximately 1.5 g/cm$^3$, compared to titanium alloy which has a density of 4.5 g/cm$^3$, which offers tantalizing prospects of providing more discretionary mass in the club-head.

Composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers is substantial, e.g., fifty or more. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition.

Conventional processes by which fiber-resin composites are fabricated into club-head components utilize high (and sometimes constant) pressure and temperature to cure the resin portion in a minimal period of time. The processes desirably yield components that are, or nearly are, "net-shape," by which is meant that the components as formed have their desired final configurations and dimensions. Making a component at or near net-shape tends to reduce cycle time for making the components and to reduce finishing costs.

Unfortunately, at least three main defects are associated with components made in this conventional fashion: (a) the components exhibit a high incidence of composite porosity (voids formed by trapped air bubbles or as a result of the released gases during a chemical reaction); (b) a relatively high loss of resin occurs during fabrication of the components; and (c) the fiber layers tend to have "wavy" fibers instead of straight fibers. Whereas some of these defects may not cause significant adverse effects on the service performance of the components when the components are subjected to simple (and static) tension, compression, and/or bending, component performance typically will be drastically reduced whenever these components are subjected to complex loads, such as dynamic and repetitive loads (i.e., repetitive impact and consequent fatigue).

Manufacturers of metal wood golf club-heads have more recently attempted to manipulate the performance of their club heads by designing what is generically termed a variable face thickness profile for the striking face. It is known to fabricate a variable-thickness composite striking plate by first forming a lay-up of prepreg plies, as described above, and then adding additional "partial" layers or plies that are smaller than the overall size of the plate in the areas where additional thickness is desired (referred to as the "partial ply" method). For example, to form a projection on the rear surface of a composite plate, a series of annular plies, gradually decreasing in size, are added to the lay-up of prepreg plies.

Unfortunately, variable-thickness composite plates manufactured using the partial ply method are susceptible to a high incidence of composite porosity because air bubbles tend to remain at the edges of the partial plies (within the impact zone of the plate). Moreover, the reinforcing fibers in the prepreg plies are ineffective at their ends. The ends of the fibers of the partial plies within the impact zone are stress concentrations, which can lead to premature delamination and/or cracking. Furthermore, the partial plies can inhibit the steady outward flow of resin during the curing process, leading to resin-rich regions in the plate. Resin-rich regions tend to reduce the efficacy of the fiber reinforcement, particularly since the force resulting from golf-ball impact is generally transverse to the orientation of the fibers of the fiber reinforcement.

Typically, conventional CNC machining is used during the manufacture of composite face plates, such as for trimming a cured part. Because the tool applies a lateral cutting force to the part (against the peripheral edge of the part), it has been found that such trimming can pull fibers or portions thereof out of their plies and/or induce horizontal cracks on the peripheral edge of the part. As can be appreciated, these defects can cause premature delamination and/or other failure of the part.

While durability limits the application of non-metals in striking plates, even durable plastics and composites exhibit some additional deficiencies. Typical metallic striking plates include a fine ground striking surface (and for iron-type golf clubs may include a series of horizontal grooves) that tends to promote a preferred ball spin in play under wet conditions. This fine ground surface appears to provide a relief volume for water present at a striking surface/ball impact area so that impact under wet conditions produces a ball trajectory and shot characteristics similar to those obtained under dry conditions. While non-metals suitable for striking plates are durable, these materials generally do not provide a durable roughened, grooved, or textured striking surface such as provided by conventional clubs and that is needed to maintain club performance under various playing conditions. Accordingly, improved striking plates, striking surfaces, and golf clubs that include such striking plates and surfaces and associated methods are needed.

SUMMARY

In one embodiment, the present disclosure describes a golf club head comprising a heel portion, a toe portion, a crown, a sole, and a face.

The foregoing and other objects, features, and advantages of the invention will become more apparent from the following detailed description, which proceeds with reference to the accompanying figures According to one aspect of the present invention, a golf club head is described having a body defining an interior cavity and comprising a heel portion, a toe portion, and a sole portion positioned at a bottom portion of the golf club head, and a crown positioned at a top portion. The body has a forward portion and a rearward portion. A face is positioned at the forward portion of the body. The face has a center face location and includes a center face characteristic time. An off-center location on the face is located at about −40 mm in a heel direction away from the center face location. The off-center location has an off-center characteristic time of at least 80% of the center face characteristic time.

In one example, the center face characteristic time is between about 230 μs and about 257 μs. In another example, the off-center characteristic time is greater than 190 μs or 210 μs.

In one example, the body has a volume of between about 400 cc and about 500 cc. In another example, the moment of inertia about the center of gravity z-axis is greater than 450 kg·mm$^2$. In one example, the face includes a face area greater than 4,500 mm$^2$ or mm$^2$.

In yet another example, the face includes a composite face insert. In one example, the golf club head has a head origin defined as a position on the face plane at the center face location. The head origin includes an x-axis tangential to the face and generally parallel to the ground when the head is in an address position where a positive x-axis extends towards the heel portion. A y-axis extends perpendicular to the x-axis and generally parallel to the ground when the head is in the address position where a positive y-axis extends from the face and through the rearward portion of the body. A z-axis extends perpendicular to the ground and to the x-axis and to the y-axis when the head is ideally positioned. A positive z-axis extends from the origin and generally upward. The golf club head has a center of gravity with a y-axis coordinate being greater than about 15 mm.

In one example, the golf club head center of gravity includes an x-axis coordinate between approximately −5 mm and approximately 10 mm. A y-axis coordinate is between approximately 15 mm and approximately 50 mm, and a z-axis coordinate is between approximately −10 mm and approximately 5 mm.

According to another aspect of the present invention, a golf club head includes an off-center location on the face located at about 40 mm in a toe direction away from the center face location, the off-center location having an off-center characteristic time being at least 80% of the center face characteristic time.

In one example, the off-center characteristic time is greater than 200 μs or greater than 220 μs.

According to another aspect of the present invention, a first off-center location on the face is located at about 40 mm in a toe direction away from the center face location. A second off-center location on the face is located at about −40 mm in a heel direction away from the center face location. The first off-center location and the second off-center location each have an off-center characteristic time being at least 80% of the center face characteristic time. In one example, the center face characteristic time is between about 230 μs and about 257 μs and the first off-center location characteristic time and the second off-center characteristic time each are greater than 190 μs. In one example, the first off-center location characteristic time and the second off-center characteristic time each are greater than 210 μs.

In yet another example, the face includes a face area greater than 4,500 mm$^2$ and at least one rib is attached to a portion of a rear surface of the face.

Some disclosed examples pertain to composite articles, and in particular a composite face plate for a golf club-head, and methods for making the same. In certain embodiments, a composite face plate for a club-head is formed with a cross-sectional profile having a varying thickness. The face plate comprises a lay-up of multiple, composite prepreg plies. The face plate can include additional components, such as an outer polymeric or metal layer (also referred to as a cap) covering the outer surface of the lay-up and forming the striking surface of the face plate. In other embodiments, the outer surface of the lay-up can be the striking surface that contacts a golf ball upon impact with the face plate.

In order to vary the thickness of the lay-up, some of the prepreg plies comprise elongated strips of prepreg material arranged in a cross-cross, overlapping pattern so as to add thickness to the composite lay-up in one or more regions where the strips overlap each other. The strips of prepreg plies can be arranged relative to each other in a predetermined manner to achieve a desired cross-sectional profile for the face plate. For example, in one embodiment, the strips can be arranged in one or more clusters having a central region where the strips overlap each other. The lay-up has a projection or bump formed by the central overlapping region of the strips and desirably centered on the sweet spot of the face plate. A relatively thinner peripheral portion of the lay-up surrounds the projection. In another embodiment, the lay-up can include strips of prepreg plies that are arranged to form an annular projection surrounding a relatively thinner central region of the face plate, thereby forming a cross-sectional profile that is reminiscent of a "volcano."

The strips of prepreg material desirably extend continuously across the finished composite part; that is, the ends of the strips are at the peripheral edge of the finished composite part. In this manner, the longitudinally extending reinforcing fibers of the strips also extend continuously across the finished composite part such that the ends of the fibers are at the periphery of the part. In addition, the lay-up can initially be formed as an "oversized" part in which the reinforcing fibers of the prepreg material extend into a peripheral sacrificial portion of the lay-up. Consequently, the curing process for the lay-up can be controlled to shift defects into the sacrificial portion of the lay-up, which subsequently can be removed to provide a finished part with little or no defects. Moreover, the durability of the finished part is increased because the free ends of the fibers are at the periphery of the finished part, away from the impact zone.

The sacrificial portion desirably is trimmed from the lay-up using water-jet cutting. In water-jet cutting, the cutting force is applied in a direction perpendicular to the prepreg plies (in a direction normal to the front and rear surfaces of the lay-up), which minimizes damage to the reinforcing fibers.

In one representative embodiment, a golf club-head comprises a body having a crown, a heel, a toe, and a sole, and defining a front opening. The head also includes a variable-thickness face insert closing the front opening of the body. The insert comprises a lay-up of multiple, composite prepreg plies, wherein at least a portion of the plies comprise a plurality of elongated prepreg strips arranged in a criss-cross pattern defining an overlapping region where the strips overlap each other. The lay-up has a first thickness at a location spaced from the overlapping region and a second thickness at the overlapping region, the second thickness being greater than the first thickness.

In another representative embodiment, a golf club-head comprises a body having a crown, a heel, a toe, and a sole, and defining a front opening. The head also includes a variable-thickness face insert closing the front opening of the body. The insert comprises a lay-up of multiple, composite prepreg plies, the lay-up having a front surface, a peripheral edge surrounding the front surface, and a width. At least a portion of the plies comprise elongated strips that are narrower than the width of the lay-up and extend continuously across the front surface. The strips are arranged within the lay-up so as to define a cross-sectional profile having a varying thickness.

In another representative embodiment, a composite face plate for a club-head of a golf club comprises a composite lay-up comprising multiple prepreg layers, each prepreg layer comprising at least one resin-impregnated layer of longitudinally extending fibers at a respective orientation. The lay-up has an outer peripheral edge defining an overall size and shape of the lay-up. At least a portion of the layers comprise a plurality of composite panels, each panel comprising a set of one or more prepreg layers, each prepreg layer in the panels having a size and shape that is the same as the overall size and shape of the lay-up. Another portion of the layers comprise a plurality of sets of elongated strips, the sets of strips being interspersed between the panels within the lay-up. The strips extend continuously from respective first locations on the peripheral edge to respective second locations on the peripheral edge and define one or more areas of increased thickness of the lay-up where the strips overlap within the lay-up.

In another representative embodiment, a method for making a composite face plate for a club-head of a golf club comprises forming a lay-up of multiple prepreg composite plies, a portion of the plies comprising elongated strips arranged in a criss-cross pattern defining one or more areas of increased thickness in the lay-up where one or more of the strips overlap each other. The method can further include at least partially curing the lay-up, and shaping the at least partially cured lay-up to form a part having specified dimensions and shape for use as a face plate or part of a face plate for a club-head.

In still another representative embodiment, a method for making a composite face plate for a club-head of a golf club comprises forming a lay-up of multiple prepreg plies, each prepreg ply comprising at least one layer of reinforcing fibers impregnated with a resin. The method can further include at least partially curing the lay-up, and water-jet cutting the at least partially cured lay-up to form a composite part having specified dimensions and shape for use as a face plate or part of a face plate in a club-head.

In some examples, golf club heads comprise a club body and a striking plate secured to the club body. The striking plate includes a face plate and a cover plate secured to the face plate and defining a striking surface, wherein the striking surface includes a plurality of scoreline indentations. In some examples, an adhesive layer secures the cover plate to the face plate. In other alternative embodiments, the scoreline indentations are at least partially filled with a pigment selected to contrast with an appearance of an impact area of the striking surface and the cover plate is metallic and has a thickness between about 0.25 mm and 0.35 mm. In further examples, the scoreline indentations are between about 0.05 and 0.09 mm deep. In other representative examples, a ratio of a scoreline indentation width to a cover plate thickness is between about 2.5 and 3.5, and the face plate is formed of a titanium alloy. In some examples, the scoreline indentations include transition regions having radii of between about 0.2 mm and 0.6 mm, and the cover plate includes a rim configured to extend around a perimeter of the face plate. According to some embodiments, the face plate is a composite face plate and the club body is a wood-type club body.

Cover plates for a golf club face plate comprise a titanium alloy sheet having bulge and roll curvatures, and including a plurality of scoreline indentations. A scoreline indentation depth D is between about 0.05 mm and 0.12 mm, and a titanium alloy sheet thickness T is between about 0.20 mm and 0.40 mm.

In further examples, golf club heads comprise a club body and a striking plate secured to the club body. The striking plate includes a metallic cover having a plurality of impact resistant scoreline indentations situated on a striking surface. In some examples, the metallic cover is between about 0.2 mm and 1.0 mm thick and the scoreline indentations have depths between about 0.1 mm and 0.02 mm. In further examples, the scoreline indentations have a depth D and the metallic cover has a thickness T such that a ratio D/T is between about 0.15 and 0.30 or between about 0.20 and 0.25. In additional examples, the face plate is a variable thickness face plate.

Methods comprise selecting a metallic cover sheet and trimming the metallic cover sheet so as to conform to a golf club face plate. The metallic cover sheet provides a striking surface for a golf club. A plurality of scoreline indentations are defined in the striking surface, wherein the metallic cover sheet has a thickness T between about 0.1 mm and 0.5 mm, and the scoreline indentations have a depth D such that a ratio D/T is between about 0.1 and 0.4. In additional examples, a rim is formed on the cover sheet and is configured to cover a perimeter of the face plate. In typical examples, the metallic sheet is a titanium alloy sheet and is trimmed after formation of the scoreline indentations. In some examples, the scoreline indentations are formed in an impact area of the striking surface or outside of an impact area of the striking surface.

According to some examples, golf club heads (wood-type or iron-type) comprise a club body and a striking plate secured to the club body. The striking plate includes a composite face plate having a front surface and a polymer cover layer secured to the front surface of the face plate, the polymer cover layer having a textured striking surface. In some embodiments, a thickness of the cover layer is between about 0.1 mm and about 2.0 mm or about 0.2 mm and 1.2 mm, or the thickness of the cover layer is about 0.4 mm. In further examples, the striking face of the composite face plate has an effective Shore D hardness of at least about 75, 80, or 85. In additional representative examples, the textured striking surface has one or more of a mean surface roughness between about 1 μm and 10 μm, a mean surface feature frequency of at least about 2/mm, or a surface profile kurtosis greater than about 1.5, 1.75, or 2.0. In additional embodiments, the textured striking surface has a mean surface roughness of less than about 4.5 μm, a mean surface feature frequency of at least about 3/mm, and a surface profile kurtosis greater than about 2 as measured in a top-to-bottom direction, a toe-to-heel direction, or along both directions. In some examples, the striking surface is textured along a top-to-bottom direction or a toe-to-heel direction only. In other examples, the striking surface is textured along an axis that is tilted with respect to a toe-to-heel and a top-to-bottom direction.

Methods comprise providing a face plate for a golf club and a cover layer for a front surface of the face plate. A striking surface of the cover layer is patterned so as to provide a roughened or textured striking surface. According to some examples, the roughened striking surface is patterned to include a periodic array of surface features that provide a mean roughness less than about 5 μm and a mean surface feature frequency along at least one axis substantially parallel to the striking surface of at least 2/mm. In other examples, the striking surface of the cover layer is patterned with a mold. In further examples, the striking surface is patterned by pressing a fabric against the cover layer, and subsequently removing the fabric. In a representative example, the cover layer is formed of a thermoplastic and the fabric is applied as the cover layer is formed.

Golf club heads comprise a face plate having a front surface and a control layer situated on the front surface of the face plate, wherein the control layer has a striking surface having a surface roughness configured to provide a ball spin of about 2500 rpm, 3000 rpm, or 3500 rpm under wet conditions. In some examples, the control layer is a polymer layer. In further examples, the control layer is a polymer layer having a thickness of between about 0.3 mm and 0.5 mm, and the surface roughness of the striking surface is substantially periodic along at least one axis that is substantially parallel to the striking surface. In representative examples, the striking surface of the face plate has a Shore D hardness of at least about 75, 80, or more preferably, at least about 85. The polymer layer can be a thermoset or thermoplastic material. In representative examples, the polymer layer is a SURLYN ionomer or similar material, or a urethane, preferably a non-yellowing urethane.

The foregoing and other objects, features, and advantages of the invention will become more apparent from the following detailed description, which proceeds with reference to the accompanying figures.

BRIEF DESCRIPTION OF THE DRAWINGS

The present invention is illustrated by way of example and not limitation in the figures of the accompanying drawings in which like references indicate similar elements.

FIGS. 47-49 illustrate another representative striking plate that includes a cover layer having a roughened striking surface.

DETAILED DESCRIPTION

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Embodiments of a golf club head providing desired center-of-gravity (hereinafter, "CG") properties and increased moments of inertia (hereinafter, "MOI") and specific characteristic time values are described herein. In some embodiments, the golf club head has an optimal shape for providing maximum golf shot forgiveness given a maximum head volume, a maximum head face area, and a maximum head depth according to desired values of these parameters, and allowing for other considerations such as the physical attachment of the golf club head to a golf club and golf club aesthetics.

Forgiveness on a golf shot is generally maximized by configuring the golf club head such that the CG of the golf club head is optimally located and the MOI of the golf club head is maximized.

In certain embodiments, the golf club head has a shape with dimensions at or near the golf club head dimensional constraints set by current USGA regulations. In such embodiments, the golf club head features fall within a predetermined golf head shape range that results in a desired CG location and increased MOI, and thus more forgiveness on off center hits than conventional golf club heads.

In the embodiments described herein, the "face size" or "striking surface area" is defined according to a specific procedure described herein. A front wall extended surface is first defined which is the external face surface that is extended outward (extrapolated) using the average bulge radius (heel-to-toe) and average roll radius (crown-to-sole). The bulge radius is calculated using five equidistant points of measurement fitted across a 2.5 inch segment along the x-axis (symmetric about the center point). The roll radius is calculated by three equidistant points fitted across a 1.5 inch segment along the y-axis (also symmetric about the center point).

The front wall extended surface is then offset by a distance of 0.5 mm towards the center of the head in a direction along an axis that is parallel to the face surface normal vector at the center of the face. The "face size" is defined as the area of the club head in the front portion that is within the region defined by the front wall extended surface offset. The center of the face is defined according to USGA "Procedure for Measuring the Flexibility of a Golf Clubhead", Revision 2.0, Mar. 25, 2005, which is hereby incorporated by reference in its entirety.

Figure 1:
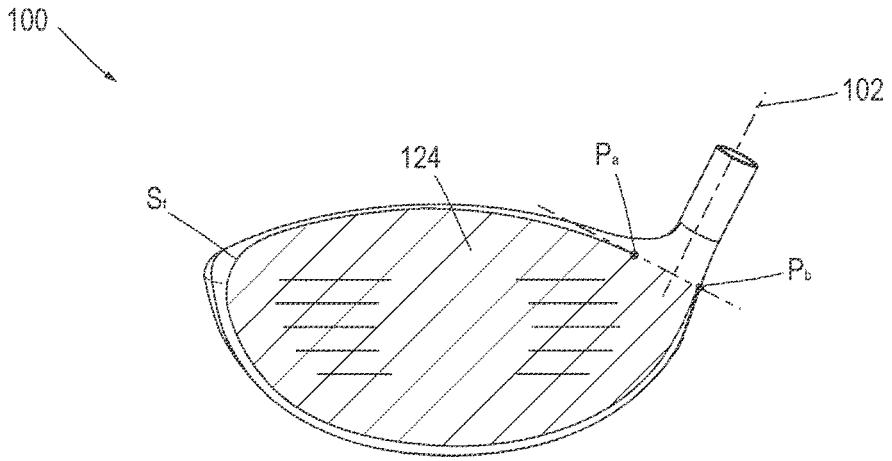
FIG. 1 illustrates a front view of a golf club head.

FIG. 1 illustrates a golf club head 100 and hosel axis 102. The golf club head 100 includes a face front wall profile shape curve (herein, "$S_f$") defined as the intersection of the external surface of the head with the offset extended front wall surface. Furthermore, the hosel region of the face front wall profile shape curve is trimmed by finding the intersection point (herein, "$P_a$") of $S_f$ with a 30 mm diameter cylindrical surface that is co-axial with the shaft (or hosel) axis. A line is drawn from the intersection point, $P_a$, in a direction normal to the hosel/shaft axis which intersects the curve $S_f$ at a second point (herein, "$P_b$"). The two points, $P_a$ and $P_b$, define two trimmed points of $S_f$. The line drawn from $P_a$ to $P_b$ defines the edge of the "face size" within the hosel region as defined in the present application.

Therefore, the "face size" (shown as the shaded region in FIG. 1) is a projected area normal to a front wall plane which is tangent to the face surface at the center of the face using the method defined in the USGA "Procedure for Measuring the Flexibility of a Golf Clubhead", Revision 2.0, Mar. 25, 2005.

Figure 2:
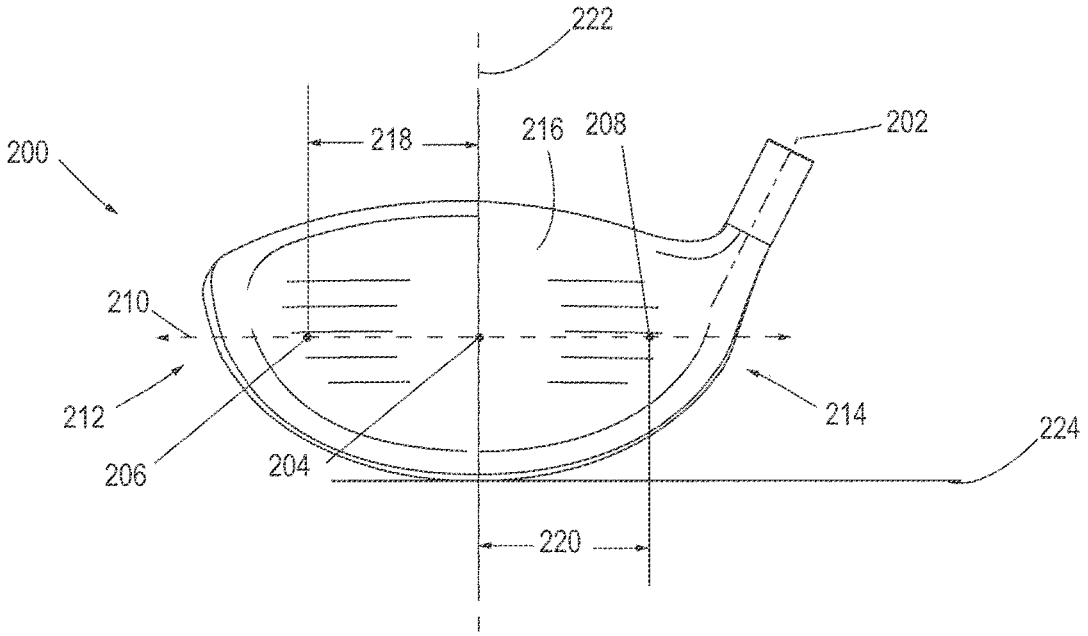
FIG. 2 illustrates a front view of a golf club head and first and second CT reference points.

FIG. 2 illustrates a golf club head 200 having a hosel axis 202 and a center face (hereinafter, "CF") location 204 on a face 216, as previously defined. A horizontal axis 210 extends from the center face location 204 towards a heel 214 direction (negative direction) and towards a toe 212 direction (positive direction). The horizontal axis 210 is generally tangent to the center face location 204 and parallel to a flat ground surface 224 at the address position. The horizontal axis 210 is referenced in determining a characteristic time (hereinafter, "CT") distribution across the face of the golf club head 200. In addition, a vertical axis 222 is also shown being perpendicular to the horizontal axis 210 and the ground surface 224.

In one exemplary embodiment, a first CT reference point 206 is shown on the surface of the face 216 in a toe 212 direction. The first CT reference point 206 is offset from the center face location 204 by a first offset distance 218 along the horizontal axis 210. The first CT reference point 206 is not offset along the vertical axis 222. Similarly, a second CT reference point 208 is shown on the surface of the face 216 in a heel direction. The second CT reference point 208 is offset from the center face location 204 by a second offset distance 220 along the horizontal axis 210. The first and second CT reference points 206,208 can be equidistant from the center face and offset by a distance between 0 mm and mm in order to take CT measurements at multiple points across the surface of the face 216.

Figure 3:
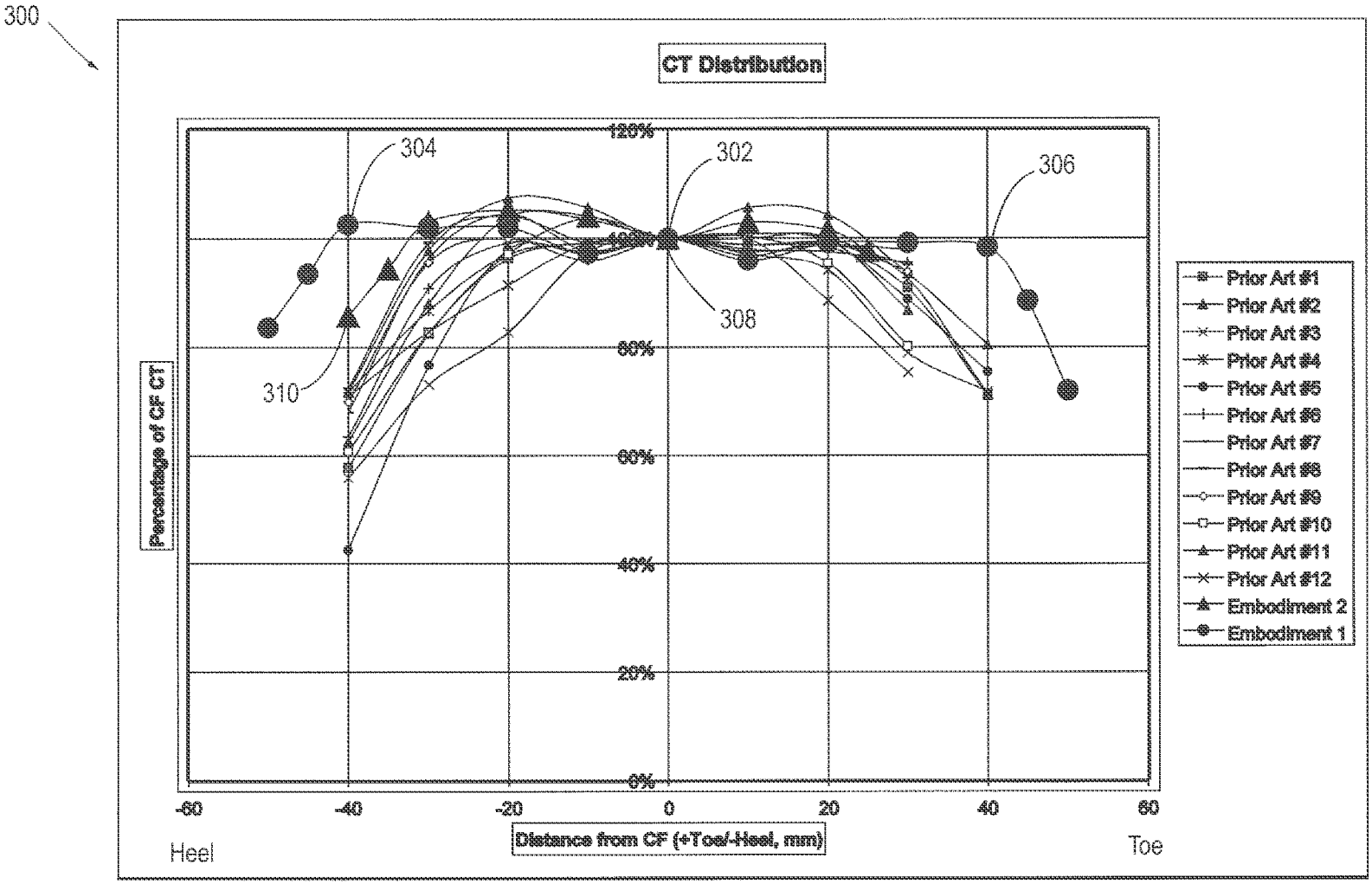
FIG. 3 illustrates a graph including a CT distribution of two embodiments compared to the prior art.

FIG. 3 illustrates a comparison chart 300 of CT characteristics of various prior art clubs with two exemplary embodiments. The x-axis in the comparison chart 300 of FIG. 3 indicates the location of a CT measurement point along the horizontal axis 210. The y-axis in the comparison chart 300 indicates the percentage of center face CT at any given CT reference point. For example, Embodiment 1 includes thirteen different measured CT reference points along the horizontal axis 210 in 5 mm or 10 mm increments from the center face location 302.

Furthermore, it should be noted that Embodiment 1 provides a relatively constant CT across the face from the heel-to-toe relative to the prior art clubs tested. A more consistent CT can promote a more consistent trajectory and distance upon impact. A first CT reference point 306 is located at an offset of 40 mm from the center face location 302 and a second CT reference point 304 is located at an offset of −40 mm from the center face location 302. In certain embodiments, the first and second CT reference points 306,304 at mm and −40 mm from the center face each have a CT Value that deviates from the center face CT Value by 10% or less. In other words, the off-center characteristic time is at least 90% of the center face characteristic time.

In some embodiments, the first and second CT reference points 306,304 at 40 mm and −40 mm from the center face each deviate from the center face CT Value by between 0% and 5% or between 0% and 15%. The off-center characteristic time is at least 80% or 85% of the center face characteristic time and can be at least 95% of the center face characteristic time. In one embodiment, the body and face of Embodiment 1 is a metallic material or titanium alloy.

In certain embodiments, the first and second CT reference points 306,304 at 40 mm and −40 mm from the center face each have a CT Value that deviates from the center face CT Value by less than 15% or 20%.

In some embodiments, the center face characteristic time is between about 230 μs and about 257 μs. The off-center characteristic time at the 40 mm and −40 mm location is between about 180 μs and about 257 μs. In some embodiments, the off-center characteristic time is greater than about 190 μs or greater than about 210 μs.

Table 1 illustrates specific CT values for Embodiment 1. The corresponding Offset Distance from Center Face and Percentage of Center Face CT is also shown for each CT Value. As previously noted, the CT Values are below the CT maximum limits set forth by the USGA Rules of Golf.

TABLE 1

Embodiment 1 CT Values

| Offset Distance from CF (mm) (+toe-side, −heel-side) | CT Value (μs) at the Offset Distance | Percentage of CF CT (%) at the Offset Distance |
|---|---|---|
| 50 | 175 | 72 |
| 45 | 215 | 88 |
| 40 | 239 | 98 |
| 30 | 241 | 99 |
| 20 | 241 | 99 |
| 10 | 233 | 96 |
| 0 | 243 | 100 |
| −10 | 236 | 97 |
| −20 | 248 | 102 |
| −30 | 248 | 102 |
| −40 | 249 | 102 |
| −45 | 227 | 93 |
| −50 | 203 | 84 |

The CT Values in the present application were calculated based on the method outlined in the USGA "Procedure for Measuring the Flexibility of a Golf Clubhead", Revision 2.0, Mar. 25, 2005, incorporated by reference in its entirety. Specifically, the method described in the sections entitled "3. Summary of Method", "5. Testing Apparatus Set-up and Preparation", "6. Club Preparation and Mounting", and "7. Club Testing" are exemplary sections that are relevant. Specifically, the characteristic time is the time for the velocity to rise from 5% of a maximum velocity to 95% of the maximum velocity under the test set forth by the USGA as described above.

Embodiment 1 described above is a titanium alloy construction of a club head shown in FIGS. 4A-4H. The face area of Embodiment 1 is approximately 5,530 $mm^2$ according to the procedures set forth above. The CT values measured for Embodiment 1 at the first and second CT reference points (+/−40 mm) in Table 1 are both greater than about 200 μs or greater than about 220 μs. Due to the large face size of Embodiment 1, a large CT value can be sustained at the first and second CT reference points.

In another example, Embodiment 2 includes a composite face insert located on the face with a metallic body shown in FIGS. 5A-5C, 6A, 6B described in further detail below.

Embodiment 2 includes nine different measured CT reference points along the horizontal axis 210 in 5 mm to 10 mm increments.

Embodiment 2 provides a heel-side CT reference point 310 located at an offset of −40 mm (heel-side) from the center face location 308. In certain embodiments, the heel-side CT reference points 310 at −40 mm from the center face has a CT Value that deviates from the center face CT Value by less than 20%. In some embodiments, the heel-side CT reference points 310 at −40 mm from the center face deviates from the center face CT Value by between 0% and 20% or between 0% and 15%. In one example, the body of Embodiment 2 is a metallic material or titanium alloy while the face includes a composite insert having a variable thickness, described in further detail below. The face size of Embodiment 2 according to the measurement method previously described is about 6,978 $mm^2$ but in other embodiments can be about 4,500 $mm^2$ or greater.

In certain embodiments, heel-side CT reference point 310 at −40 mm from the center face deviates from the center face CT Value by less than 15

Figure 4A:
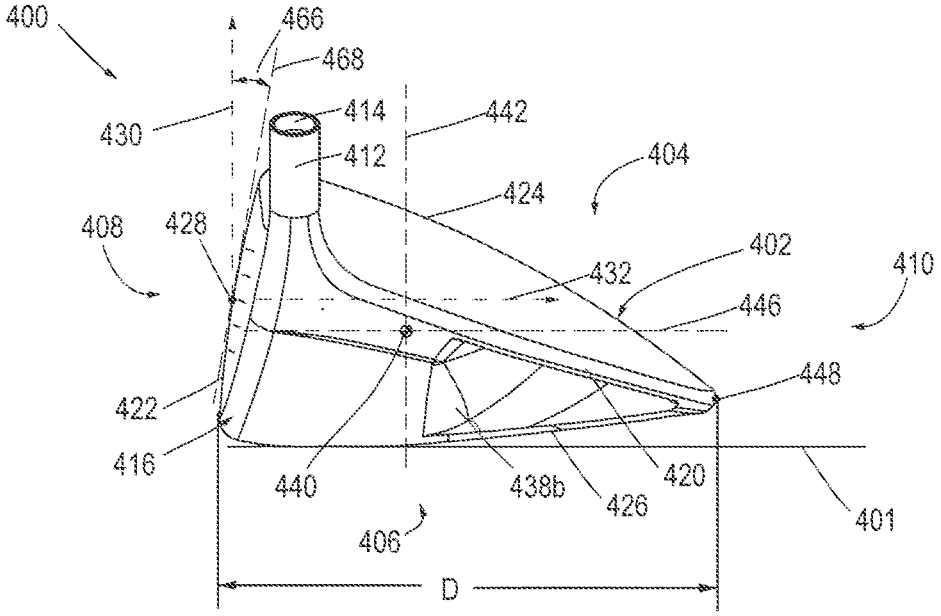
FIG. 4A illustrates a side view of a golf club head, according to one embodiment.

FIG. 4A shows a wood-type (e.g., driver or fairway wood) golf club head 400 including a hollow body 402 having a top portion 404, a bottom portion 406, a front portion 408, and a back portion 410. The club head 400 also includes a hosel 412 which defines a hosel bore 414 and is connected with the hollow body 402. The hollow body 402 further includes a heel portion 416 and a toe portion 418. A striking surface 422 is located on the front portion 408 of the golf club head 400. In some embodiments, the striking surface 422 can include a bulge and roll curvature and can be a face plate that is welded onto the front portion of the body. The striking surface 422 has a face plane 468 that forms a face angle 466.

In some embodiments of the present invention, the striking surface 422 is made of a composite material and includes a support structure and insert having dimensions and features as described in U.S. patent application Ser. No. 10/442,348 (now U.S. Pat. No. 7,267,620), Ser. No. 10/831,496 (now U.S. Pat. No. 7,140,974), Ser. No. 11/642,310, Ser. No. 11/825,138, Ser. No. 11/823,638, Ser. No. 12/004,387, Ser. No. 11/960,609, Ser. No. 11/960,610 and Ser. No. 12/156,947, which are incorporated herein by reference in their entirety. The composite material can be manufactured according to the methods described in U.S. patent application Ser. No. 11/825,138.

In other embodiments, the striking surface 422 is made from a metal alloy (e.g., titanium, steel, aluminum, and/or magnesium), ceramic material, or a combination of composite, metal alloy, and/or ceramic materials. Moreover, the striking face 422 can be a striking plate having a variable thickness as described in U.S. Pat. Nos. 6,997,820, 6,800,038, and 6,824,475, which are incorporated herein by reference in their entirety.

The golf club head 400 also has a body volume, typically measured in cubic centimeters ($cm^3$), equal to the volumetric displacement of the club head 400, according to the United States Golf Association "Procedure for Measuring the Club Head Size of Wood Clubs" Revision 1.0 procedures. The embodiments described herein have a total body volume of between about 400 cc and about 500 cc. For example, the total body volume can be between about 450 cc and about 475 cc. In one example, the total body volume of Embodiment 1 and Embodiment 2 is about 460 cc.

A club head origin coordinate system is provided such that the location of various features of the club head (including, e.g., a club head CG) can be determined. In FIG. 4A, a club head origin point 428 is represented on the club head 400. The club head origin point 428 is positioned at the ideal impact location which is the center of the striking surface 422.

The head origin coordinate system is defined with respect to the head origin point 428 and includes a Z-axis 430, an X-axis 434 (shown in other views), and a Y-axis 432. The Z-axis 430 extends through the head origin point 428 in a generally vertical direction relative the ground 401 when the club head 400 is at an address position. Furthermore, the Z-axis 430 extends in a positive direction from the origin point 428 toward the top portion 404 of the golf club head 400.

The X-axis 434 extends through the head origin point 428 in a toe-to-heel direction substantially parallel or tangential to the striking surface 422 at the ideal impact location. The X-axis 430 extends in a positive direction from the origin point 428 to the heel 416 of the club head 400 and is perpendicular to the Z-axis 430 and Y-axis 432.

The Y-axis 432 extends through the head origin point 428 in a front-to-back direction and is generally perpendicular to the X-axis 434 and Z-axis 430. The Y-axis 432 extends in a positive direction from the origin point 428 towards the rear portion or back portion 410 of the club head 400.

The top portion 404 includes a crown 424 that extends substantially in an X-direction and Y-direction and has a top portion volume defined by the top portion 404. Similarly, the bottom portion 406 has a bottom portion volume. The bottom portion 406 also includes a sole area 426 that substantially faces the ground 401 at the address position of the golf club head 400 and also extends primarily in an X and Y-direction.

The top portion volume and the bottom portion volume are combined to create a total body volume. It is understood that the top 404 and bottom 406 portions are three dimensional objects that also extend in the Z-direction 430.

Moreover, the crown 424 is defined as an upper portion of the club head 400 above a peripheral outline of the club head 400 as viewed from a top-down direction and includes a region rearwards of the top most portion of the front portion 408 that contains the ball striking surface 422. In one embodiment, a skirt region can be located on a side portion 420 of the club head 400 and can include regions within both the top portion 404 and bottom portion 406. In some embodiments, a skirt region is not present or pronounced.

The top 404 and bottom 406 portions can be integrally formed using techniques such as molding, cold forming, casting, and/or forging and the striking face can be attached to the crown, sole, and skirt (if any) through bonding, welding, or any known method of attachment. For example, a face plate can be attached to the body 400 as described in U.S. patent application Ser. No. 10/442,348 (now U.S. Pat. No. 7,267,620) and Ser. No. 10/831,496 (now U.S. Pat. No. 7,140,974), as previously mentioned above. The body 400 can be made from a metal alloy such as titanium, steel, aluminum, and or magnesium. Furthermore, the body 400 can be made from a composite material, ceramic material, or any combination thereof. The body 400 can have a thin-walled construction as described in U.S. patent application Ser. No. 11/067,475 (now issued U.S. Pat. No. 7,186,190) and Ser. No. 11/870,913 which are incorporated herein by reference in their entirety.

Figure 4B:
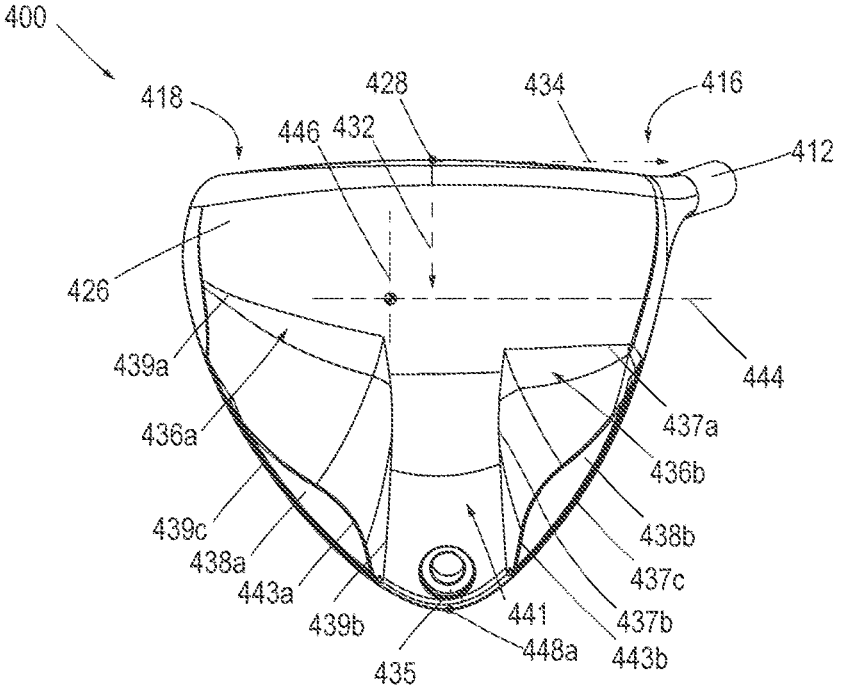
FIG. 4B illustrates a sole view of the golf club head in FIG. 4A.
Figure 4C:
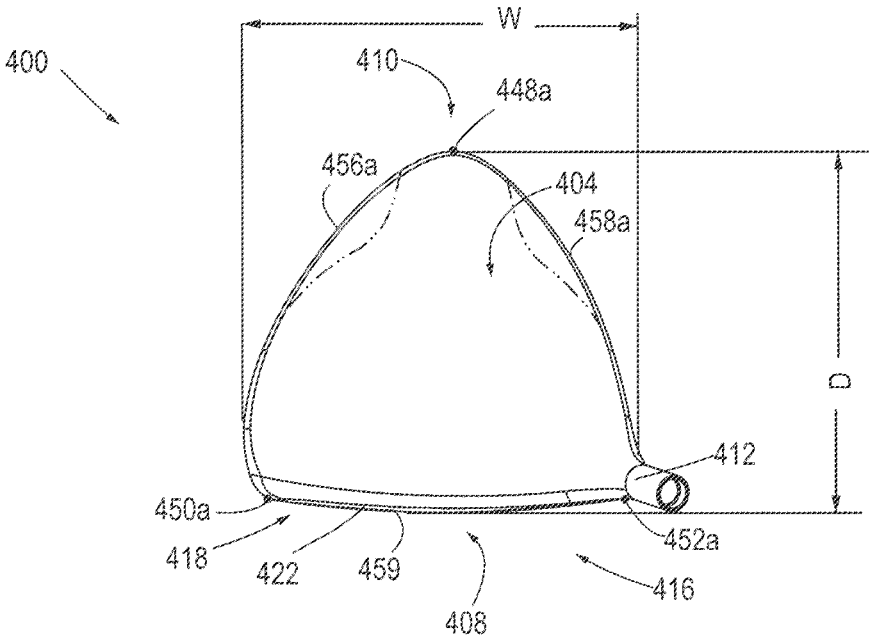
FIG. 4C illustrates a crown view of the golf club head in FIG. 4A.
Figure 4D:
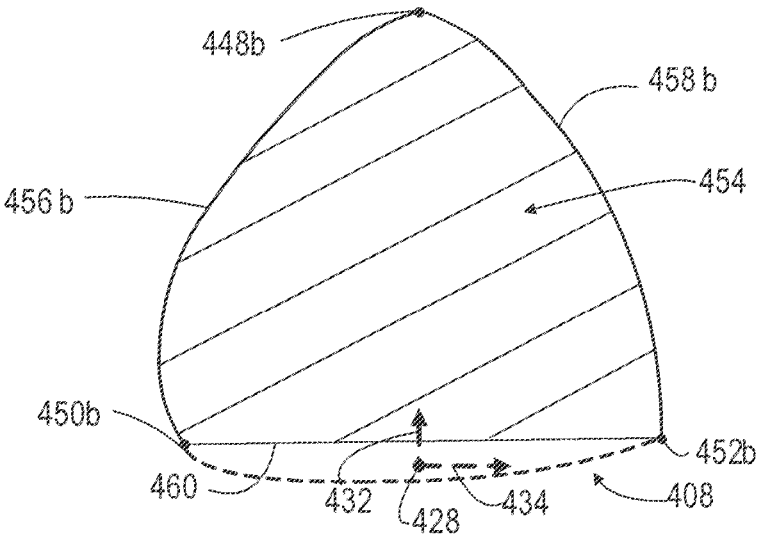
FIG. 4D illustrates a projected crown silhouette of the golf club head in FIG. 4C.
Figure 4E:
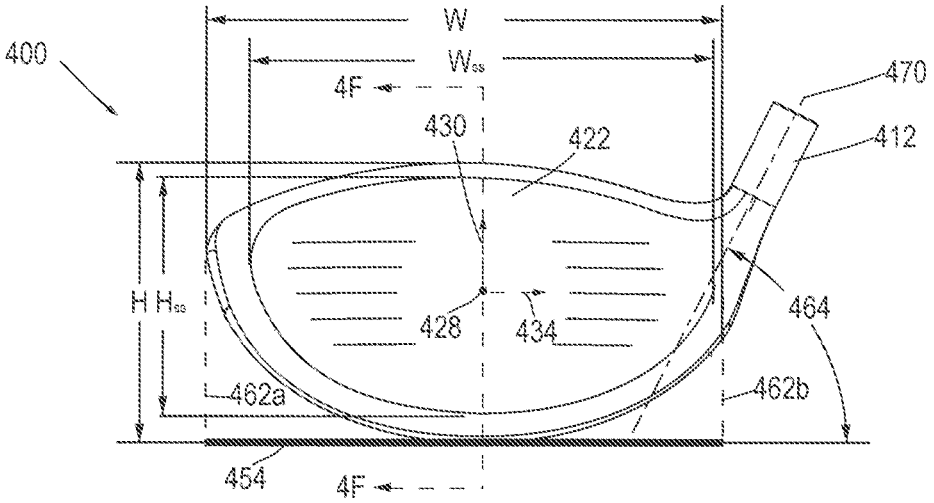
FIG. 4E illustrates a front view of the golf club head in FIG. 4A.

Referring to FIGS. 4A, 4C, and 4E, the golf club heads described herein each have a maximum club head height (H, top-bottom), width (W, heel-toe) and depth (D, front-back). The maximum height, H, is defined as the distance between the lowest and highest points on the outer surface of the golf club head body measured along an axis parallel to the origin Z-axis 430 when the club head is at a proper address position. The maximum depth, D, is defined as the distance between the forward-most and rearward-most points on the surface of the body measured along an axis parallel to the origin Y-axis 432 when the head is at a proper address position. The maximum width, W, is defined as the distance between the farthest distal toe point and closest proximal heel point on the surface of the body measured along an axis parallel to the origin X-axis 434 when the head is at a proper address position.

The height, H, width, W, and depth D of the club head in the embodiments herein are measured according to the United States Golf Association "Procedure for Measuring the Club Head Size of Wood Clubs" revision 1.0 and Rules of Golf, Appendix II(4)(b)(i).

Golf club head moments of inertia are defined about three axes extending through the golf club head CG 440 including: a CG z-axis 442 extending through the CG 440 in a generally vertical direction relative to the ground 401 when the club head 400 is at address position, a CG x-axis 444 extending through the CG 440 in a heel-to-toe direction generally parallel to the striking surface 422 and generally perpendicular to the CG z-axis 442, and a CG y-axis 446 extending through the CG 440 in a front-to-back direction and generally perpendicular to the CG x-axis 444 and the CG z-axis 442. The CG x-axis 444 and the CG y-axis 446 both extend in a generally horizontal direction relative to the ground 401 when the club head 400 is at the address position. Specific CG location values are discussed in further detail below with respect to certain exemplary embodiments.

The moment of inertia about the golf club head CG x-axis 444 is calculated by the following equation:

$$I_{CGx}=\int(y^2+z^2)dm$$

In the above equation, y is the distance from a golf club head CG xz-plane to an infinitesimal mass dm and z is the distance from a golf club head CG xy-plane to the infinitesimal mass dm. The golf club head CG xz-plane is a plane defined by the CG x-axis 444 and the CG z-axis 442. The CG xy-plane is a plane defined by the CG x-axis 444 and the CG y-axis 446.

Moreover, a moment of inertia about the golf club head CG z-axis 442 is calculated by the following equation:

$$I_{CGz}=\int(x^2+y^2)dm$$

In the equation above, x is the distance from a golf club head CG yz-plane to an infinitesimal mass dm and y is the distance from the golf club head CG xz-plane to the infinitesimal mass dm. The golf club head CG yz-plane is a plane defined by the CG y-axis 446 and the CG z-axis 442. Specific moment of inertia values for certain exemplary embodiments are discussed further below.

FIG. 4B shows a bottom view of the bottom portion 406 having a first indentation 438*a* and a second indentation 438*b* located on the bottom portion 406 of the club head 400. The first indentation 438*a* is located near the toe portion 418 and the second indentation 438*b* is located near the heel portion 416 of the club head 400. In one exemplary embodiment, the first 438*a* and second 438*b* indentation are generally triangular in shape and arranged so that the sole 426 forms a T-shape. In one embodiment, the first 438*a* and second 438*b* indentation are mirrored across the Y-axis 432 and are about the same shape and size. In other embodiments, the first indentation 438*a* is slightly larger than the second 438*b* indentation.

The first indentation 438*a* has a first edge 439*a*, a second edge 439*b*, and a third edge 439*c*. The second indentation 438*b* also has a first edge 437*a*, a second edge 437*b*, and a third edge 437*c*. The first edges 439*a*, 437*a* of both indentations extend in an X and Y-direction and are generally curved with respect to the X-axis 434. The second edges 439*b*, 437*b* of both indentations extend primarily in a Y-direction and are generally curved with respect to the Y-axis 432. The third edge 439*c* of the first indentation 438*a* is a curved edge in the X-Y plane that generally follows a silhouette profile near the toe side 418 of the club head 400. The third edge 437*c* of the second indentation 438*b* is also a curved edge in the X-Y plane that generally follows a silhouette profile near the heel side 416 of the club head 400.

In each indentation 438*a*, 438*b*, a convex indentation wall 436*a*, 436*b* extends from the first edge 439*a*, 437*a* toward the top portion 404 or crown 424 creating a fourth edge 443*a*, 443*b* located within the indentations 438*a*, 438*b*. The fourth edge 443*a*, 443*b* represents the intersection between the indentation wall 436*a*, 436*b* and a bottom surface of the crown 424. Thus, a bottom surface area of the crown 424 is exposed within each indentation 438*a*, 438*b* between the fourth edge 443*a*, 443*b* and the third edge 437*c*, 439*c*.

The convex indentation wall 436*a*, 436*b* ensures that the cavity of the club head 400 maintains a certain volume which can affect the sound frequency of the club head 400 upon direct impact with a golf ball. In one embodiment, the frequency of the sole upon direct impact with a golf ball has a first sole mode greater than 3000 Hz. In one exemplary embodiment, the first sole mode frequency is about 3212 Hz while the second and third modes are about 3297 Hz and 3427 Hz, respectively. In certain preferred embodiments, the first sole mode frequency is at between about 3200 to 3500 Hz.

The first 438*a* and second 438*b* indentations are separated by a plateau or center sole portion 441 that extends in a direction parallel to the Y-axis 432. In one exemplary embodiment, the width (along the X-axis 434) of the center sole portion 441 is about 22 mm to about 31 mm between the two indentations 438*a*, 438*b*. Furthermore, the width (along the X-axis 434) of each indentation 438*a*, 438*b* is about 50 mm to about 57 mm and the length (along the Y-axis 432) of each indentation 438*a*, 438*b* is about 69 mm or more than 60 mm. In another embodiment, the width of each indentation 438*a*, 438*b* is about 40 mm and the length of each indentation 438*a*, 438*b* is about 65 mm.

The center sole portion 441 also contains a movable weight port 435 located on the sole 426 near the back portion 410 where a movable weight may be inserted or removed to change characteristics of the CG location, as described in U.S. patent application Ser. No. 10/290,817 (U.S. Pat. No. 6,773,360), Ser. No. 10/785,692 (U.S. Pat. No. 7,166,040), Ser. No. 11/025,469, Ser. No. 11/067,475 (U.S. Pat. No. 7,186,190), Ser. No. 11/066,720 (U.S. Pat. No. 7,407,447), and Ser. No. 11/065,772 (U.S. Pat. No. 7,419,441), which are hereby incorporated by reference in their entirety.

The sole 426 of the bottom portion 406 is defined as a lower portion of the club head 400 extending upwards from a lowest point of the club head when the club head is positioned at a proper address position relative to a golf ball on a ground surface 401. In some exemplary embodiments, the sole 426 extends about 50-60% of the distance from the lowest point of the club head to the crown 424. In further exemplary embodiments, the sole extends upward in the Z-direction about 15 mm for a driver and between about 10 mm and 12 mm for a fairway wood. The sole 426 can include the entire bottom portion 406 or partially cover a bottom region of the bottom portion 406. The sole 426 and bottom portion 406 are located below the top portion 404 in a negative Z-direction.

FIG. 4C shows a top view of the club head 400 including the top portion 404, striking surface 422, and the hosel 412. The X-axis 434 and the Y-axis 432 extend from the origin point 428 as previously mentioned (not shown for clarity). A first point 448*a*, a second point 450*a*, and a third point 452*a* are located about the perimeter of the top portion 404. The first point 448*a* is a rearward-most point on the surface of the body measured along an axis parallel to the origin Y-axis 432 when the head 400 is at a proper address position. The second point 450*a* is an intersection point defining the intersection between the front portion 408, the top portion 404, and the bottom portion 406 that is located near the toe portion 418 of the club head 400. The third point 452 a is an intersection point defining the intersection between the between the front portion 408, the top portion 404, and the bottom portion 406 that is located near the heel portion 416 of the club head 400. In one embodiment, the third point 452*a* defines an intersection that excludes or ignores a majority of the hosel 412.

A top portion silhouette profile includes a first contour 456*a*, a second contour 458*a*, and a third segment 459 being located along a perimeter of the top portion 404 defining the outer bounds of the top portion 404 in substantially an X-direction 434 and Y-direction 432.

The first contour 456*a* extends along an outer toe edge of the club head 400 between the first point 448*a* and second point 450*a*. The second contour 458*a* extends along an outer heel edge of the club head 400 between the first point 448*a* and third point 452*a*. The third segment 459 defining the top portion silhouette profile is a straight line (with respect to the X-axis 434 and Z-axis 430, i.e. viewed from the X-Z plane) along the surface of the front portion 408 or striking surface 422 that connects the second point 450*a* and the third point 452*a*. The first contour 456*a*, second contour 458*a*, and third segment 459 are substantially coplanar.

In certain embodiments, a plane between the top portion 404 and bottom portion 406 that contains the first point 448*a*, second point 450*a*, third point 452*a*, first contour 456*a*, second contour 458*a*, and third segment 459 can be referenced as a dividing plane for measuring a top portion volume and a bottom portion volume. In addition, the same dividing plane is used for measuring a top portion surface area $S_t$ or bottom portion surface area $S_b$. A top and bottom portion volume is measured according to the weighed water displacement method under United States Golf Association "Procedure for Measuring the Club Head Size of Wood Clubs" Revision 1.0 procedures.

FIG. 4D shows a projected crown silhouette 454 being the top portion silhouette profile shape that is externally projected on to the ground when looking vertically down at the crown 424 when the head 400 is in the address position.

The projected crown silhouette 454 occupies an area in the X-Y plane as emphasized by the hatched lines in FIG. 4D. However, the projected crown silhouette 454 excludes the striking surface 422 and front portion 408 as shown in dashed lines. The projected crown silhouette 454 is defined by the first point projection 448*b*, the second point projection 450*b*, the third point projection 452*b*, and a projected portion of the outer perimeter of the top portion 404 on to the ground 401 or an X-Y plane.

As further shown in FIG. 4D, the projected crown silhouette 454 is defined by three projected segments 456*b*, 458*b*, 460 located between the first 448*b*, second 450*b*, and third 452*b* projected points. The first contour 456*a* and the second contour 458*a* are located along the perimeter of the top portion 404 and correspond to the first projected segment 456*b* and the second projected segment 458*b*, respectively. The projected segments 456*b*, 458*b* are the projected profiles of the crown on to the X-Y plane or ground 401. The first projected segment 456*b* extends between the first projected point 448*b* and the second projected point 450*b*. The second projected segment 458*b* extends between the first projected point 448*b* and the third projected point 452*b*. The third segment 460 of the profile is a single line segment connecting the second projected point 450*b* and the third projected point 452*b* in the projected X-Y plane. Similar to the first 456*b* and second 458*b* projected segments, the third segment 460 corresponds to an actual crown top line profile contour and is a relatively straight-line boundary drawn between the second projected point 450*b* and third projected point 452*b* running along the top line of the face 422. In other words, the third segment 460 is a projected line of the boundary between the face 422 and the crown 424.

In one embodiment, the projected crown silhouette 454 occupies a projected silhouette area of about 11,702 $mm^2$ in an X-Y plane which excludes the face 422. In some embodiments, the projected silhouette area is greater than 10,000 $mm^2$. The volume saved in the bottom portion 406 is reallocated to the top portion 404 of the club head 400 to create a larger and more unique projected crown silhouette 454 or top portion perimeter shape.

FIG. 4E shows a front view of the club head 400 and striking surface 422 at an address position. Projection lines 462*a*, 462*b* are shown in dashed lines to further illustrate how the crown silhouette is projected on to the ground 401, as previously described. It is understood that the crown silhouette can be projected on to any X-Y plane, not necessarily the ground 401 only, without departing from the scope of the invention.

A golf club head, such as the club head 400 is at its proper address position when face angle 466 is approximately equal to the golf club head loft and the golf club head lie angle 464 is about equal to 60 degrees. In other words, the address position is generally defined as the position of the club head as it naturally sits on the ground 401 when the shaft is at 60 degrees to the ground.

The face angle 466 is defined between a face plane 468 that is tangent to an ideal impact location 428 on the striking surface 422 and a vertical Z-X plane containing the Z-axis 430 and X-axis 434. Moreover, the golf club head lie angle 464 is the angle between a longitudinal axis (or hosel axis) 470 of the hosel 412 or shaft and the ground 401 or X-Y plane. It is understood that the ground 401 is assumed to be a level plane.

FIG. 4E further shows the ideal impact location 428 on the striking surface 422 of the golf club head. In one embodiment, the origin point 428 or ideal impact location is located at the geometric center of the striking surface 422. The origin point 428 is the intersection of the midpoints of a striking surface height ($H_{ss}$) and striking surface width ($W_{ss}$) of the striking surface 422 as measured according to the USGA "Procedure for Measuring the Flexibility of a Golf Clubhead", Revision 2.0.

In certain embodiments, the ball striking surface 422 has the maximum allowable surface area under current USGA dimensional constraints for golf club heads in order to achieve a desired level of forgiveness and playability. Specifically, the maximum club head height (H) is about 71 mm (2.8") and a maximum width (W) of about 127 mm (5"). In certain embodiments, the height is about 63.5 mm to 71 mm (2.5" to 2.8") and the width is about 119.38 mm to about 127 mm (4.7" to 5.0"). Furthermore, the depth dimension (D) is about 111.76 mm to about 127 mm (4.4" to 5.0"). In one preferred specific exemplary embodiment, the club height, H, is about 70 mm and the club width is about 126 mm while the club length is about 125 mm.

In one embodiment, the striking surface 422 may reach the maximum height H and width W dimensions as a direct result of the removal of volume from the bottom portion 406. In certain embodiments, the striking surface 422 has a surface area between about 4,000 $mm^2$ and 7,000 $mm^2$ and, in certain preferred embodiments, the striking surface 422 is greater than 4,500 $mm^2$ or 5,000 $mm^2$. In other embodiments, the ball striking surface 422 may have a maximum height $H_{ss}$ value of about 67 mm to about 71 mm, a maximum width $W_{ss}$ value of about 418 mm to about 427 mm. In another exemplary embodiment, the striking surface 422 area is about 6,192 $mm^2$, according to the procedure for measuring striking surface area, as previously described.

The golf club head of the implementations shown herein can have a maximum depth D equal to the maximum allowable depth of about 127 mm (5 inches) under current USGA dimensional constraints. Because the moment of inertia of a golf club head about a CG of the head is proportional to the squared distance of a golf club head mass away from the CG, having a maximum depth D value can have a desirable effect on moment of inertia and the CG position of the club head. Thus, the presence of the indentation 438 achieves a large height H, depth D, and width W dimension of the club head 400 while maintaining an advantageous CG location and acceptable MOI values.

Specifically, in some implementations, the CG x-axis coordinate is between about −2 mm and about 7 mm, the CG y-axis coordinate is between about 30 mm and about 40 mm, and the CG z-axis coordinate is between about −7 mm and about 2 mm.

In other embodiments of the present invention, the golf club head 400 can have a CG with a CG x-axis 434 coordinate between about −5 mm and about 10 mm, a CG y-axis 432 coordinate between about 15 mm and about 50 mm, and a CG z-axis 430 coordinate between about −10 mm and about 5 mm. In yet another embodiment, the CG y-axis 432 coordinate is between about 20 mm and about 50 mm.

In one specific exemplary embodiment, the golf club head 400 has a CG with a CG x-axis 434 coordinate of about 2.8 mm, a CG y-axis 432 coordinate of about 31 mm, and a CG z-axis 430 coordinate of about −4.71 mm. In one example, a composite face embodiment can achieve a CG with a CG x-axis 434 coordinate of about 3.0 mm, a CG y-axis 432 coordinate of about 36.5 mm, and a CG z-axis 430 of about −6.0 mm.

In certain implementations, the club head 400 can have a moment of inertia about the CG z-axis, $I_{CGz}$, between about 450 kg·mm$^2$ and about 650 kg·mm$^2$, and a moment of inertia about the CG x-axis $I_{CGx}$ between about 300 kg·mm$^2$ and about 500 kg·mm$^2$. In one exemplary embodiment, the club head 400 has a moment of inertia about the CG z-axis, $I_{CGz}$, of about 504 kg·mm$^2$ and a moment of inertia about the CG x-axis $I_{CGx}$ of about 334 kg·mm$^2$. In another exemplary embodiment, the striking surface 422 is composed of a composite material previously described and has a moment of inertia about the CG z-axis, $I_{CGz}$, of about 543 kg·mm$^2$ and a moment of inertia about the CG x-axis $I_{CGx}$ of about 382 kg·mm$^2$. In one embodiment, the composite striking surface 422 decreases the total club weight by about 10 g.

In addition, the presence of the indentation 438 in the bottom portion 406 increases the bottom portion surface area $S_b$ located below the top portion silhouette profile 456*a*, 458*a*, 459. In certain implementations the club head can have a top portion surface area $S_t$ (which includes the face) of about 16,000 mm$^2$ to 18,000 mm$^2$ and a bottom portion surface area $S_b$ of about 18,000 mm$^2$ to about 22,000 mm$^2$. The surface area ratio $S_r$ of the top portion surface area $S_t$ to the bottom portion surface area $S_b$ is represented by the equation:

$$S_r = \frac{S_t}{S_b}$$

In certain embodiments, the surface ratio $S_r$ can range between about 0.70 to about 0.96, with a preferred range of less than 0.90 and less than 0.80. A lower surface area ratio $S_r$ indicates that the bottom portion has an increased surface area due to the indentations.

In one exemplary embodiment, the top portion 404 surface area $S_t$ is about 17,117 mm$^2$ and the bottom portion 406 surface area $S_b$ including the indentation 438 is about 21,809 mm$^2$ resulting in a total surface area of about 38,926 mm$^2$ and a surface ratio $S_r$ of about 0.78. The top portion 404 surface area $S_t$ can be greater than about 15,000 mm$^2$ and the bottom portion 406 surface area $S_b$ including the indentation 438 is greater than about mm$^2$.

Figure 4F:
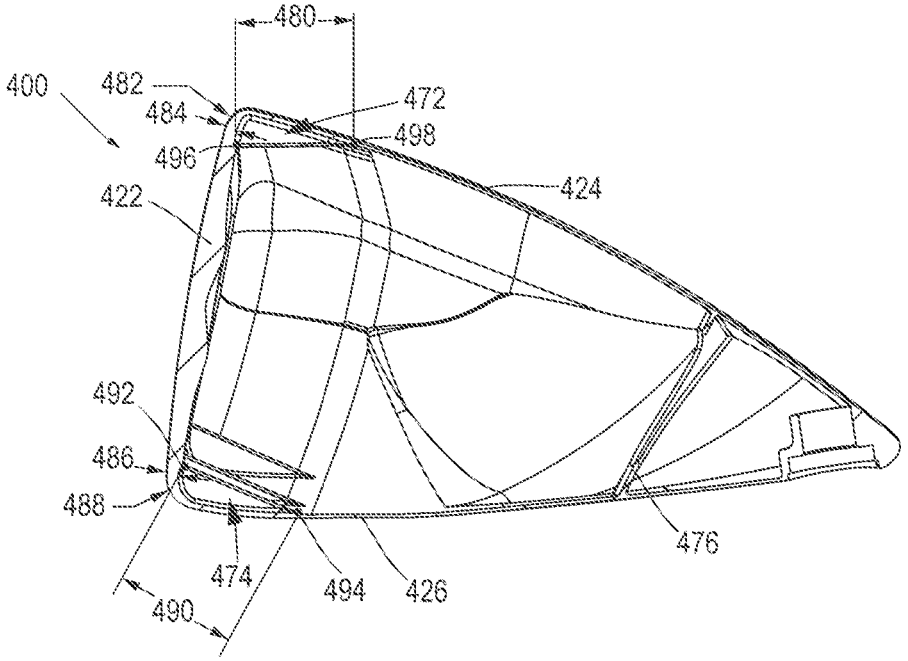
FIG. 4F illustrates a cross-sectional view taken along cross sectional lines 4F-4F shown in FIG. 4E.

FIG. 4F is a cross-sectional view taken along cross-sectional lines 4F-4F in FIG. 4E. The golf club head 400 includes upper ribs 472 and lower ribs 474. In one embodiment, the upper ribs 472 include three or more ribs spaced across the crown 424 to face 422 transition. In certain embodiments, the lower ribs include five or more ribs spaced across the sole 426 to face 422 transition. As shown, the face 422 is a variable face thickness as previously described. In addition, a rear rib 476 is shown extending across the interior crown 424 surface and interior sole 476 surface. Even though a large face size can increase the CT Values at the first and second CT reference points, the upper ribs 472 and lower ribs 474 are relied upon to prevent the CT Values from exceeding a desired CT Value maximum. The upper 472 and lower ribs 474 are strategically placed to increase the stiffness of the face in selected regions to lower the CT Values. Therefore, a face size greater than 4,500 mm$^2$ may require ribs described above to lower the CT Values to within acceptable limits.

FIG. 4F further shows a top 484 and bottom 486 face thickness immediately before the curvature of the transition region connecting the club head body and face 422. In some embodiments, the top 484 and bottom 486 face thickness measured perpendicularly to the face 422 is between 1 mm and 4 mm or less than 2.5 mm. The upper transition region radius 482 is between about 2 mm and 5 mm while the lower transition region radius 488 is between about 3 mm and 7 mm. In certain embodiments, the upper transition region radius 482 is less than the lower transition region radius 488. In one example, the upper rib 472 is attached to a portion of the face 422 at a first point 496 and the upper rib 472 is further attached at a second point 498 to a portion of the interior surface of the crown 424. In certain embodiments, the linear length 480 of the upper ribs 472 between the first point 496 and second point 498 is between about 5 mm and 30 mm or between about 15 mm and mm.

Similarly, the lower ribs 474 include a first point 492 where the ribs connect with a portion of the face 422 and a second point 494 where the ribs connect with a portion of the interior surface of the sole 426. In certain embodiments, the linear length 490 of the lower ribs 474 between the first point 492 and the second point 494 is also between about 5 mm and 30 mm or between about 15 mm and 25 mm.

Figure 4G:
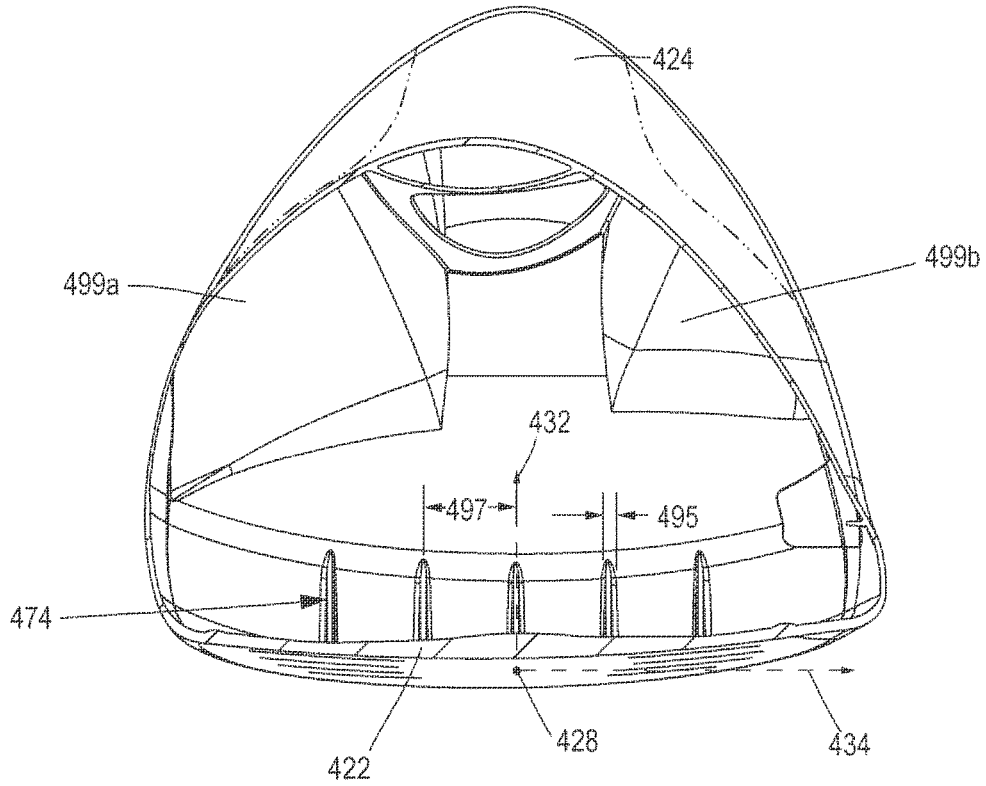
FIG. 4G illustrates a cross-sectional view taken through a crown portion of the golf club head in FIG. 4C.

FIG. 4G shows a cross-sectional view taken through the crown portion 424 and face 422 of the club head 400 showing an interior cavity and interior sole portion. The lower ribs 474 include five lower ribs being equally spaced and centered about the center point 428 as measured along the X-axis 434. The ribs can be spaced apart along the X-axis 434 by a distance of between about 5 mm to about 30 mm. In some embodiments, the ribs are spaced apart along the X-axis by a distance 497 of between about 15 mm and 25 mm. In addition, the interior cavity includes two interior raised portions 499*a*, 499*b* that correspond to the recesses 438*a*, 438*b* previously described. Each rib can have a thickness 495 of less than about 10 mm or less than about 5 mm. In one example, the rib is about 1 mm in thickness.

Figure 4H:
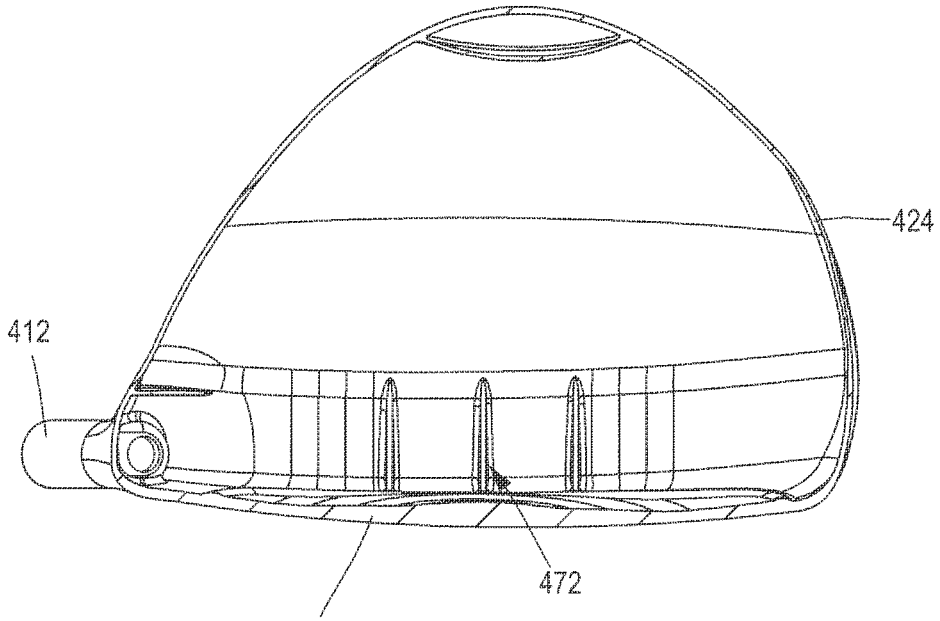
FIG. 4H illustrates a cross-sectional view taken through a crown portion of the golf club head in FIG. 4C showing an interior crown surface.

FIG. 4H shows a cross-sectional view taken through the crown portion 424 and face 422 showing an interior crown surface and three upper ribs 472. The upper ribs 472 have to be spaced apart according to the distances previously described and can include a thickness within the dimensions already described.

Figure 5A:
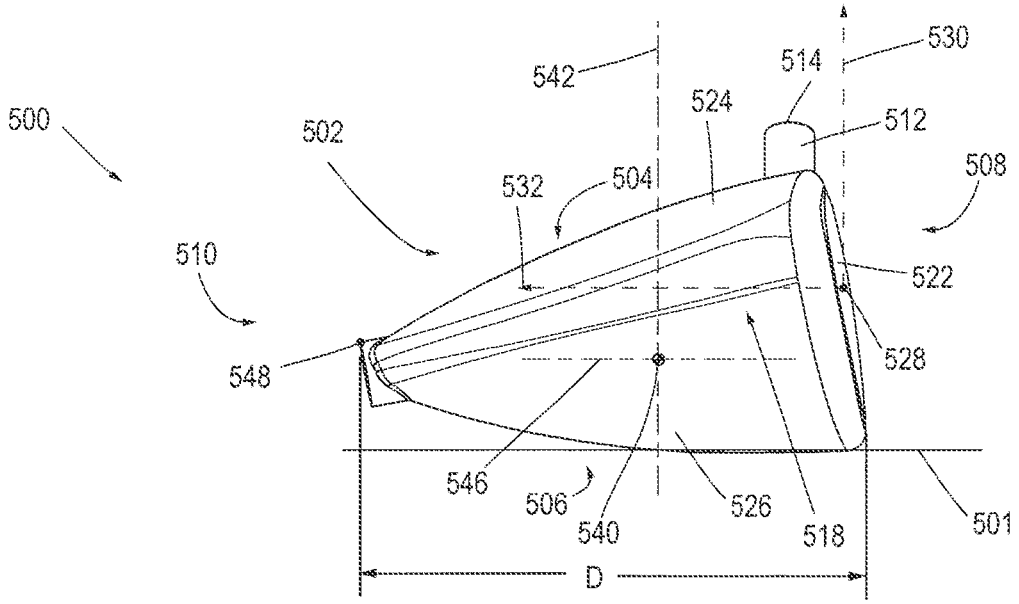
FIG. 5A illustrates a side view of a golf club head, according to another embodiment.

FIG. 5A shows a wood-type (e.g., driver or fairway wood) golf club head 500 including a hollow body 502 having a top portion 504, a bottom portion 506, a front portion 508, and a back portion 510 having a weight port 564. A hosel 512 which defines a hosel bore 514 is connected with the hollow body 502. The body 502 further includes a heel portion 516 and a toe portion 518.

FIG. 5A further shows a striking surface 522, a crown 524, a sole 526, an origin point 528, a Z-axis 530, a Y-axis 532, an X-axis 534, a rearward-most point 548 (at the address position), a CG point 540, a CG z-axis 542, a CG x-axis 544, a and a CG y-axis 546, as previously described. The club head 500 further includes a depth, D, as described above when positioned at the address position relative to the ground 501.

Figure 5B:
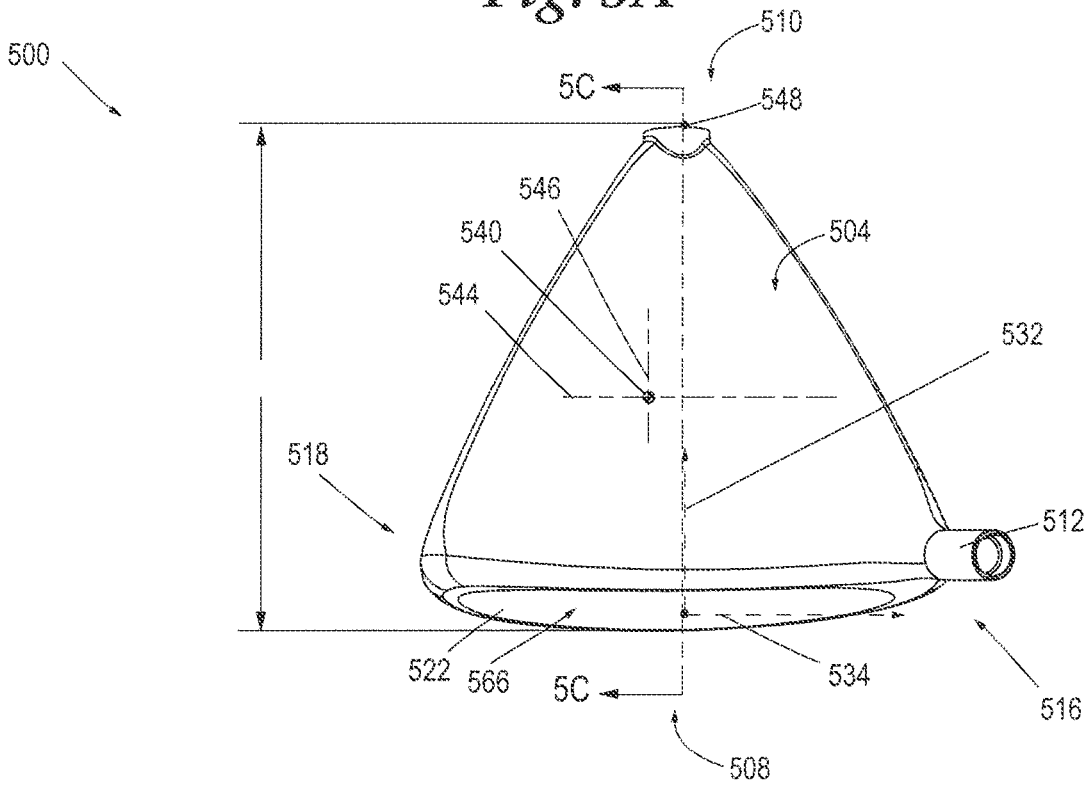
FIG. 5B illustrates a top view of the golf club head in FIG. 5A.

FIG. 5B shows a top view of the club head 500 including the top portion 504, striking surface 522, and the hosel 512. The X-axis 534 and the Y-axis 532 extend from the origin point 528 as previously mentioned.

Figure 5C:
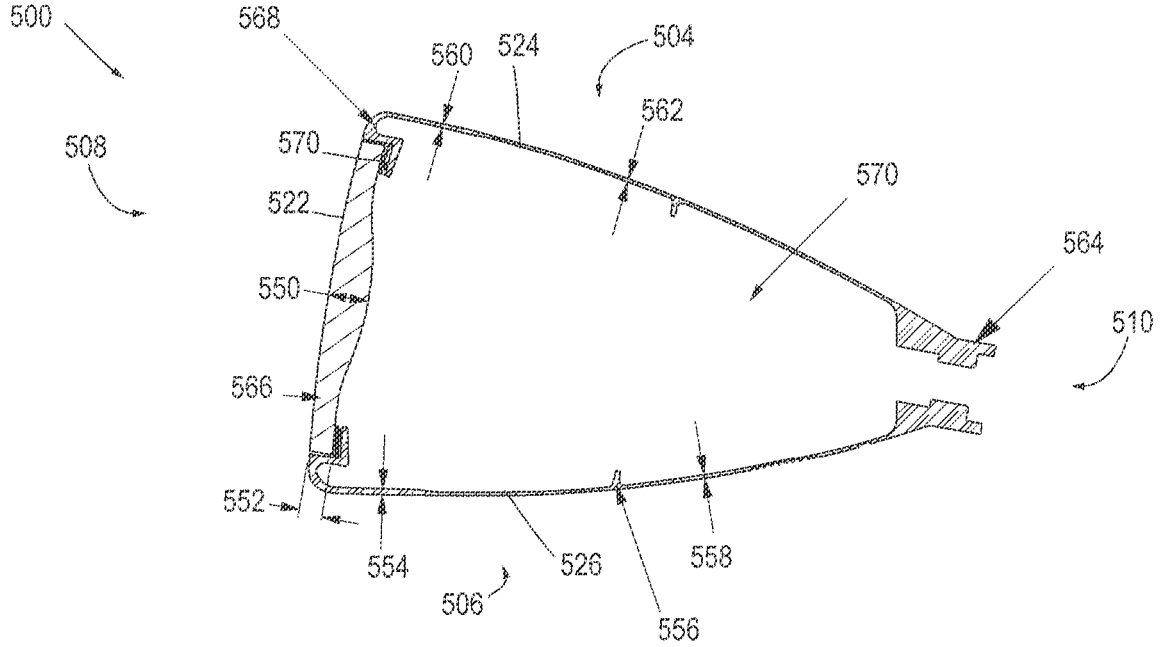
FIG. 5C illustrates a cross-sectional side view taken through cross-section lines 5C-5C in FIG. 5B.

FIG. 5C illustrates a cross-sectional view taken along cross-sectional lines 5C-5C in FIG. 5B. The striking surface 522 is primarily located on an insert 566. In one embodiment, the insert 566 is comprised of a composite material arranged to produce a variable thickness having a center thickness 550 greater than a peripheral end region thickness 552. In certain embodiments, the center thickness 550 is between about 2 mm and 10 mm or between about 4 mm and 9 mm. In some embodiments, the end region thickness 552 is between about 2 mm and about 8 mm or between about 3 mm and 6 mm. In one embodiment, the center face thickness is about 7.2 mm and the end region thickness 552 is about 4.1 mm.

The hinge region 568 is located about the edge of the insert 566 to support the peripheral end region of the insert 566. An adhesive 570 secures the insert 566 to the hinge region 568.

In some embodiments, a front crown thickness 560 and a back crown thickness 562 is located on the crown portion 524. In some embodiments, the front crown thickness 560 and the back crown thickness 562 is between about 0.5 mm to about 1 mm or about 0.6 mm or 0.8 mm. The front crown thickness 560 can be equal to or thicker than the back crown thickness 562.

In addition, a front sole thickness 554 and a back sole thickness 558 are located on the sole portion 526. In some embodiments, the front sole thickness 554 is between about mm and 1.5 mm or about 1.1 mm. The back sole thickness 558 is between about 0.5 mm and about 1 mm. The front sole thickness 554 is greater than the back sole thickness 558. Furthermore, a continuous mid-section rib 556 can be provided on the interior surface of the club head cavity 570.

Figure 6A:
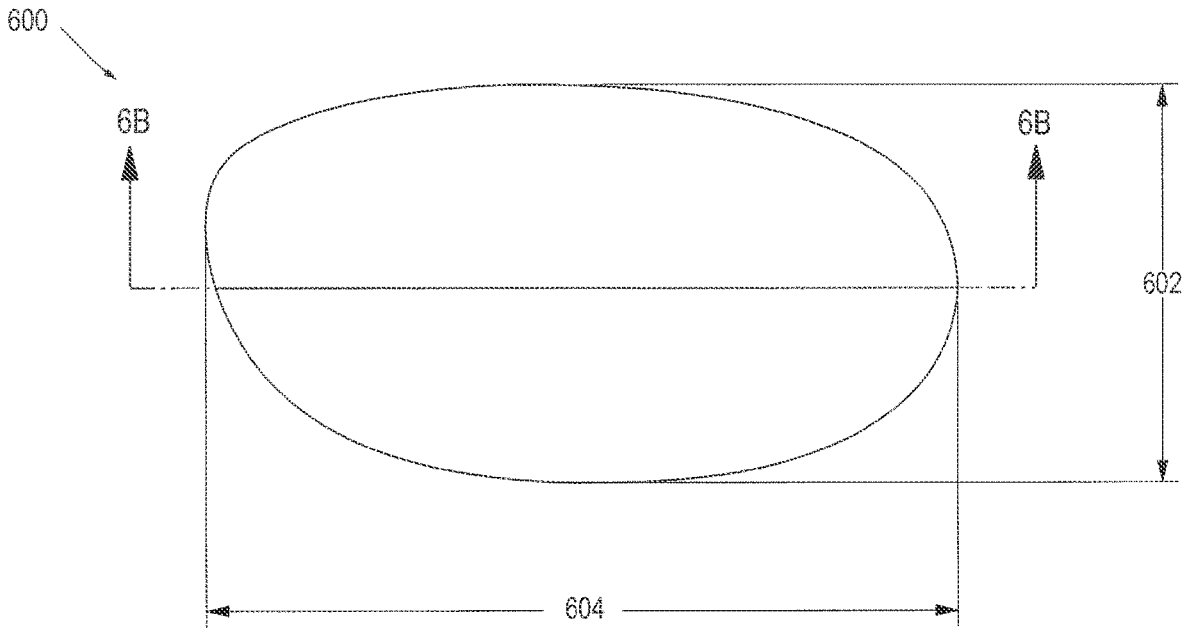
FIG. 6A illustrates a front view of a face insert.

FIG. 6A illustrates an exemplary composite insert 600 having a height dimension 602 and a width dimension 604. The height dimension 602 can be between about 50 mm and about 127 mm. The width dimension 604 can between about 100 mm and about 127 mm. In one embodiment, the height dimension 602 is about 57 mm and the width dimension is about 108 mm.

Figure 6B:
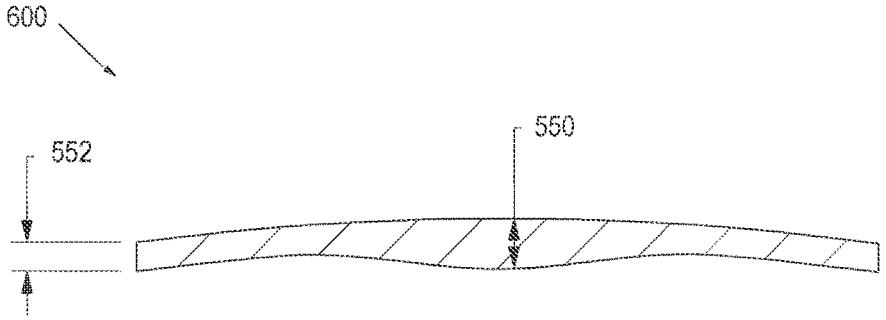
FIG. 6B illustrates a cross-sectional view taken through cross-section lines 6B-6B in FIG. 6A.

FIG. 6B illustrates a cross sectional view taken along cross section lines 6B-6B in FIG. 6A. The insert 600 includes a center thickness 550 and peripheral end region thickness 552 as previously described.

Figure 7A:
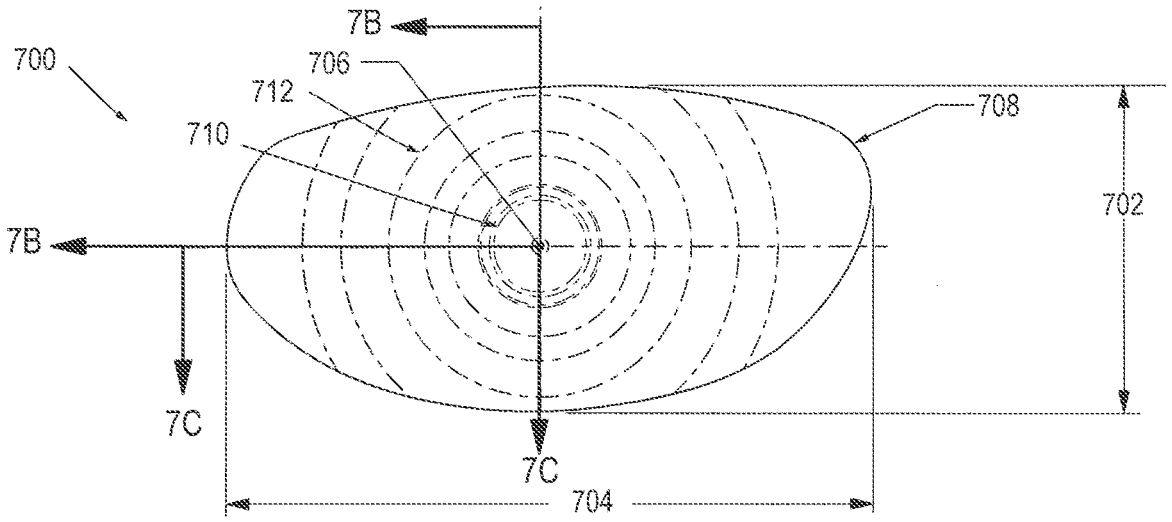
FIG. 7A illustrates a rear surface view of a face plate.

FIG. 7A shows a rear surface view of face plate 700 that is mechanically attached in the front portion of a club head to form a striking surface 422 (shown in FIG. 4F). The face plate 700 includes an outer profile 708, a center point 706, and inverted cone 710, a height dimension 702, and a width dimension 704. The face plate 700 includes varying thickness zones 712 surrounding the center point 706 and an inverted cone 710. The height dimension 702 is between about 50 mm and about 88 mm. In one embodiment, the height dimension 702 is about 54.0 mm. The width dimension 704 is between about 100 mm and about 127 mm. In one embodiment, the width dimension 704 is about 107 mm.

Figure 7B:
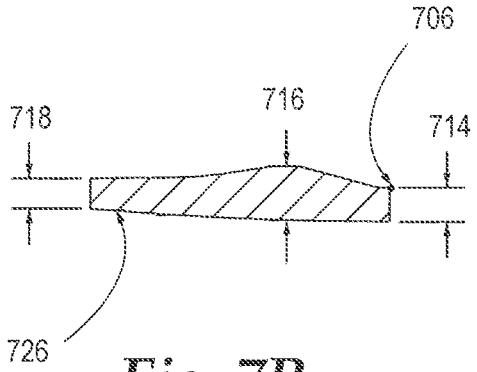
FIG. 7B illustrates a partial cross-sectional view taken through cross-section lines 7B-7B in FIG. 7A.

FIG. 7B is a partial vertical cross-sectional view taken along cross-section lines 7B-7B in FIG. 7A. FIG. 7B further shows a front striking surface 726, a center point thickness 714, an inverted cone maximum thickness 716, and a peripheral end thickness 718. In some embodiments, the center point 706 thickness 714 is between about 2.5 mm to 3.5 mm. In one embodiment, the center point 706 thickness 714 is about 3.0 mm. In certain embodiments, the inverted cone maximum thickness 716 is between about 3.5 mm to 5.0 mm or between about 4.5 mm and about 5.0 mm. In one embodiment, the inverted cone maximum thickness 716 is about 4.8 mm. In some embodiments, the peripheral end thickness 718 is between about 2.0 to about 3.0 mm in one embodiment, the peripheral end thickness 718 is about 2.7 mm.

Figure 7C:
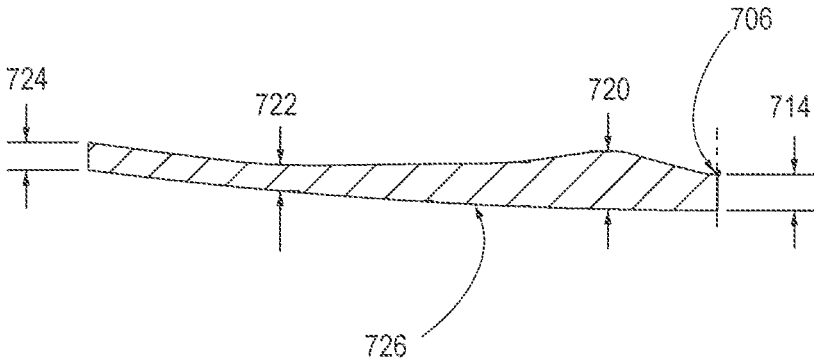
FIG. 7C illustrates a partial cross-sectional view taken through cross section liens 7C-7C in FIG. 7A.

FIG. 7C is a partial horizontal cross-sectional view taken along cross-section lines 7C-7C in FIG. 7A. FIG. 7C shows a center point 706 thickness 714, an inverted cone maximum thickness 720, a minimum thickness 722, and a peripheral end thickness 724. The inverted cone maximum thickness 720 is about the same dimensions as the inverted cone maximum thickness 716 previously described. The minimum thickness 722 is between about 2.0 mm to about 2.5 mm. In one embodiment, the minimum thickness 722 is about 2.1 mm and the peripheral end thickness 724 is about 2.3 mm. The peripheral end thickness 724 is greater than the minimum thickness 722.

In use, the embodiments of the present invention create a high CT Value when measured at 40 mm and −40 mm from the center face CT location on a large face while remaining within USGA limits. In one embodiment, the CT Value is consistent across the face of the club over a longer distance to promote a more consistent shot when the ball impacts an off-center location in either a heel or toe direction.

In addition, the embodiments described herein can also have various crown silhouette profile areas of greater than about 11,000 $mm^2$ and within the range of about 11,700 $mm^2$ to about 14,000 $mm^2$.

Furthermore, another advantage of the present invention, is that the club head still achieves a low CG (i.e. at least 2 mm below center-face and at least 15 mm aft of a hosel axis) in order to achieve a high launch angle, low spin trajectory for maximum distance. In one embodiment, the CG is at least 18 mm aft of a hosel axis. Another advantage of the present invention is that the moment of inertia about the vertical axis CG z-axis ($I_{CGz}$) is greater than about 500 $kg \cdot mm^2$ and the moment of inertia about the heel-toe axis CG x-axis ($I_{CGx}$) is greater than about 300 $kg \cdot mm^2$ plus a test tolerance of 10 $kg \cdot mm^2$.

Another advantage of the present invention is that a relatively high coefficient of restitution (COR) can be maintained. The COR measured in accordance with the U.S.G.A. Rule 4-1a is greater than 0.810 in the embodiments described herein.

Now with reference to FIGS. 8-56, in the following description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

As used herein, the singular forms "a," "an," and "the" refer to one or more than one, unless the context clearly dictates otherwise.

As used herein, the term "includes" means "comprises." For example, a device that includes or comprises A and B contains A and B but may optionally contain C or other components other than A and B. A device that includes or comprises A or B may contain A or B or A and B, and optionally one or more other components such as C.

As used herein, the term "composite" or "composite materials" means a fiber-reinforced polymeric material.

Figure 8:
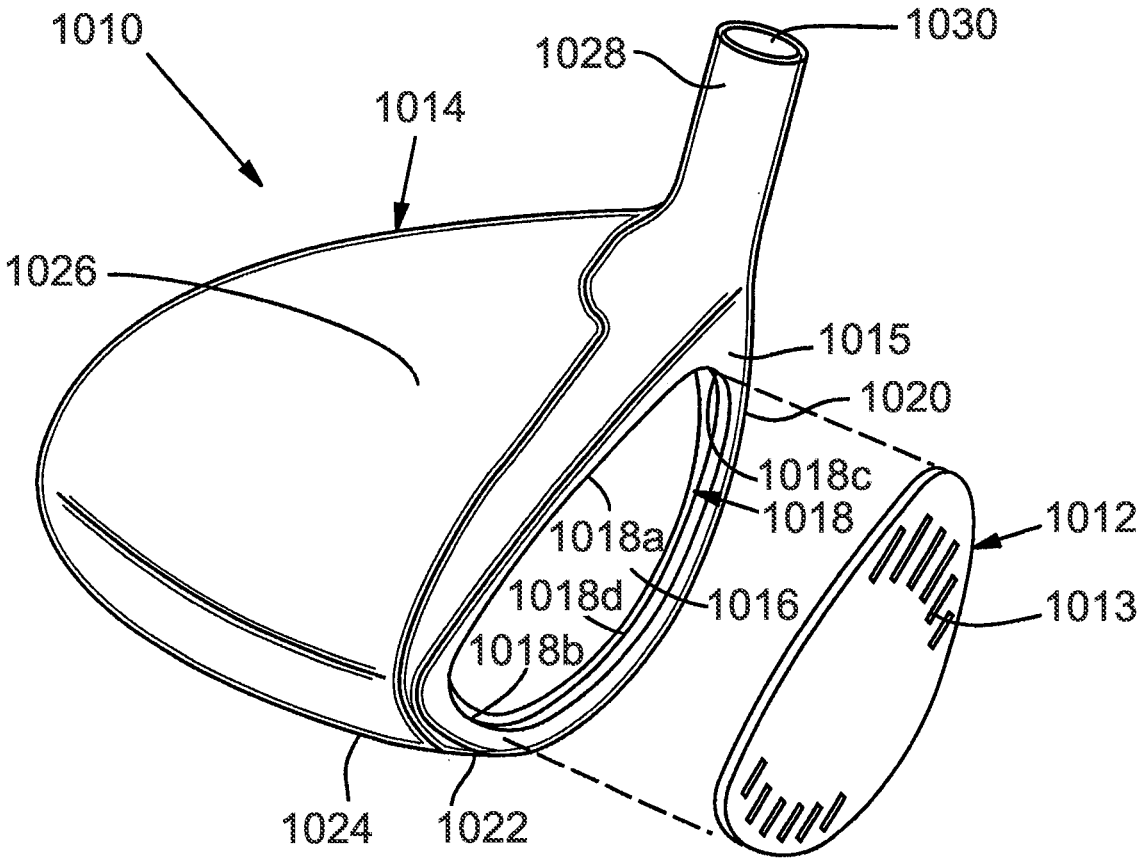
FIG. 8 is a perspective view of a "metal-wood" club-head, showing certain general features pertinent to the instant disclosure.

The main features of an exemplary hollow "metal-wood" club-head 1010 are depicted in FIG. 8. The club-head 1010 comprises a face plate, strike plate, or striking plate 1012 and a body 1014. The face plate 1012 typically is convex, and has an external ("striking") surface (face) 1013. The body 1014 defines a front opening 1016. A face support 1018 is disposed about the front opening 1016 for positioning and holding the face plate 1012 to the body 1014. The body 1014 also has a heel 1020, a toe 1022, a sole 1024, a top or crown 1026, and a hosel 1028. Around the front opening 1016 is a "transition zone" 1015 that extends along the respective forward edges of the heel 1020, the toe 1022, the sole 1024, and the crown 1026. The transition zone 1015 effectively is a transition from the body 1014 to the face plate 1012. The face support 1018 can comprise a lip or rim that extends around the front opening 1016 and is released relative to the transition zone 1015 as shown. The hosel 1028 defines an opening 1030 that receives a distal end of a shaft (not shown). The opening 1016 receives the face plate 1012, which rests upon and is bonded to the face support 1018 and transition zone 1015, thereby enclosing the front opening 1016. The transition zone 1015 can include a sole-lip region 1018*d*, a crown-lip region 1018*a*, a heel-lip region 1018*c*, and a toe-lip region 1018*b*. These portions can be contiguous, as shown, or can be discontinuous, with spaces between them.

In a club-head according to one embodiment, at least a portion of the face plate 1012 is made of a composite including multiple plies or layers of a fibrous material (e.g., graphite, or carbon, fiber) embedded in a cured resin (e.g., epoxy). For example, the face plate 1012 can comprise a composite component (e.g., component 1040 shown in FIGS. 9-11) that has an outer polymeric layer forming the striking surface 1013. Examples of suitable polymers that can be used to form the outer coating, or cap, are described in detail below. Alternatively, the face plate 1012 can have an outer metallic cap forming the external striking surface 1013 of the face plate, as described in U.S. Pat. No. 7,267,620, which is incorporated herein by reference.

An exemplary thickness range of the composite portion of the face plate is 7.0 mm or less. The composite desirably is configured to have a relatively consistent distribution of reinforcement fibers across a cross-section of its thickness to facilitate efficient distribution of impact forces and overall durability. In addition, the thickness of the face plate 1012 can be varied in certain areas to achieve different performance characteristics and/or improve the durability of the club-head. The face plate 1012 can be formed with any of various cross-sectional profiles, depending on the club-head's desired durability and overall performance, by selectively placing multiple strips of composite material in a predetermined manner in a composite lay-up to form a desired profile.

Attaching the face plate 1012 to the support 1018 of the club-head body 1014 may be achieved using an appropriate adhesive (typically an epoxy adhesive or a film adhesive). To prevent peel and delamination failure at the junction of an all-composite face plate with the body of the club-head, the composite face plate can be recessed from or can be substantially flush with the plane of the forward surface of the metal body at the junction. Desirably, the face plate is sufficiently recessed so that the ends of the reinforcing fibers in the composite component are not exposed.

The composite portion of the face plate is made as a lay-up of multiple prepreg plies. For the plies the fiber reinforcement and resin are selected in view of the club-head's desired durability and overall performance. In order to vary the thickness of the lay-up, some of the prepreg plies comprise elongated strips of prepreg material arranged in one or more sets of strips. The strips in each set are arranged in a cross-cross, overlapping pattern so as to add thickness to the composite lay-up in the region where the strips overlap each other, as further described in greater detail below. The strips desirably extend continuously across the finished composite part; that is, the ends of the strips are at the peripheral edge of the finished composite part. In this manner, the longitudinally extending reinforcing fibers of the strips also can extend continuously across the finished composite part such that the ends of the fibers are at the periphery of the part. Consequently, during the curing process, defects can be shifted toward a peripheral sacrificial portion of the composite lay-up, which sacrificial portion subsequently can be removed to provide a finished part with little or no defects. Moreover, the durability of the finished part is increased because the free ends of the fibers are at the periphery of the finished part, away from the impact zone.

In tests involving certain club-head configurations, composite portions formed of prepreg plies having a relatively low fiber areal weight (FAW) have been found to provide superior attributes in several areas, such as impact resistance, durability, and overall club performance. (FAW is the weight of the fiber portion of a given quantity of prepreg, in units of $g/m^2$.) FAW values below 100 $g/m^2$, and more desirably below 70 $g/m^2$, can be particularly effective. A particularly suitable fibrous material for use in making prepreg plies is carbon fiber, as noted. More than one fibrous material can be used. In other embodiments, however, prepreg plies having FAW values above 100 $g/m^2$ may be used.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement.

Figure 11:
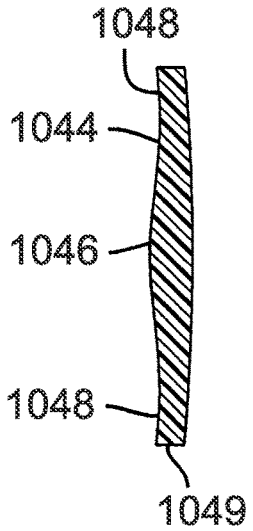
FIG. 11 is a cross-sectional view taken along line 11-11 of FIG. 9.
Figure 9:
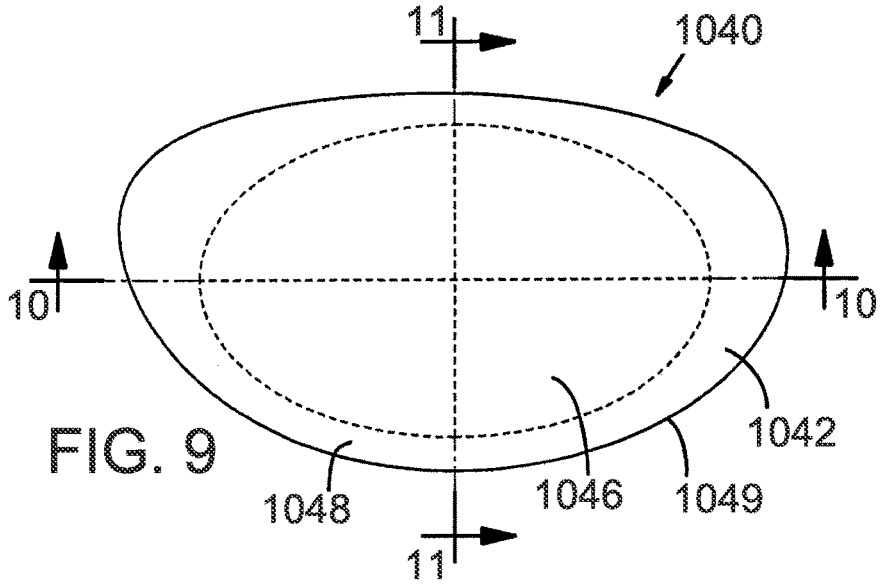
FIG. 9 is a front elevation view of one embodiment of a net-shape composite component used to form the strike plate of a club-head, such as the club-head shown in FIG. 8.
Figure 10:
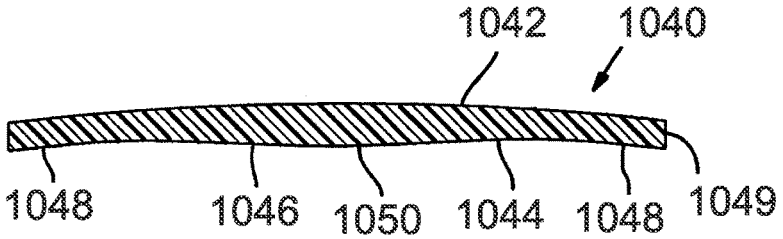
FIG. 10 is a cross-sectional view taken along line 10-10 of FIG. 9.

FIGS. 9-11 show an exemplary embodiment of a finished component 1040 that is fabricated from a plurality of prepreg plies or layers and has a desired shape and size for use as a face plate for a club-head or as part of a face plate for a clubhead. The composite part 1040 has a front surface 1042 and a rear surface 1044. In this example the composite part has an overall convex shape, a central region 1046 of increased thickness, and a peripheral region 1048 having a relatively reduced thickness extending around the central region. The central region 1046 in the illustrated example is in the form of a projection or cone on the rear surface having its thickest portion at a central point 1050 (FIG. 10) and gradually tapering away from the point in all directions toward the peripheral region 1048. The central point 1050 represents the approximate center of the "sweet spot" (optimal strike zone) of the face plate 1012, but not necessarily the geometric center of the face plate. The thicker central region 1046 adds rigidity to the central area of the face plate 1012, which effectively provides a more consistent deflection across the face plate. In certain embodiments, the central region 1046 has a thickness of about 5 mm to about 7 mm and the peripheral region 1048 has a thickness of about 4 mm to about 5 mm.

Figure 12:
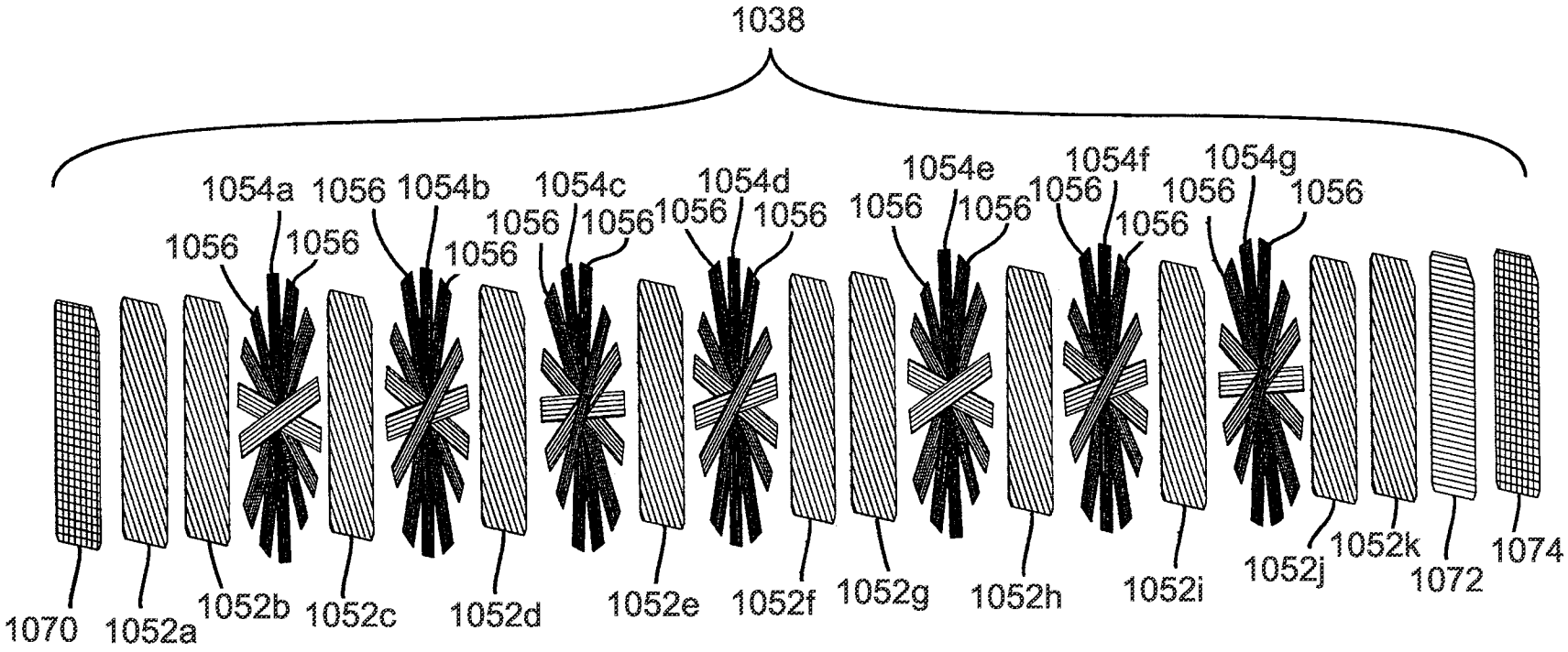
FIG. 12 is an exploded view of one embodiment of a composite lay-up from which the component shown in FIG. 9 can be formed.
Figure 16:
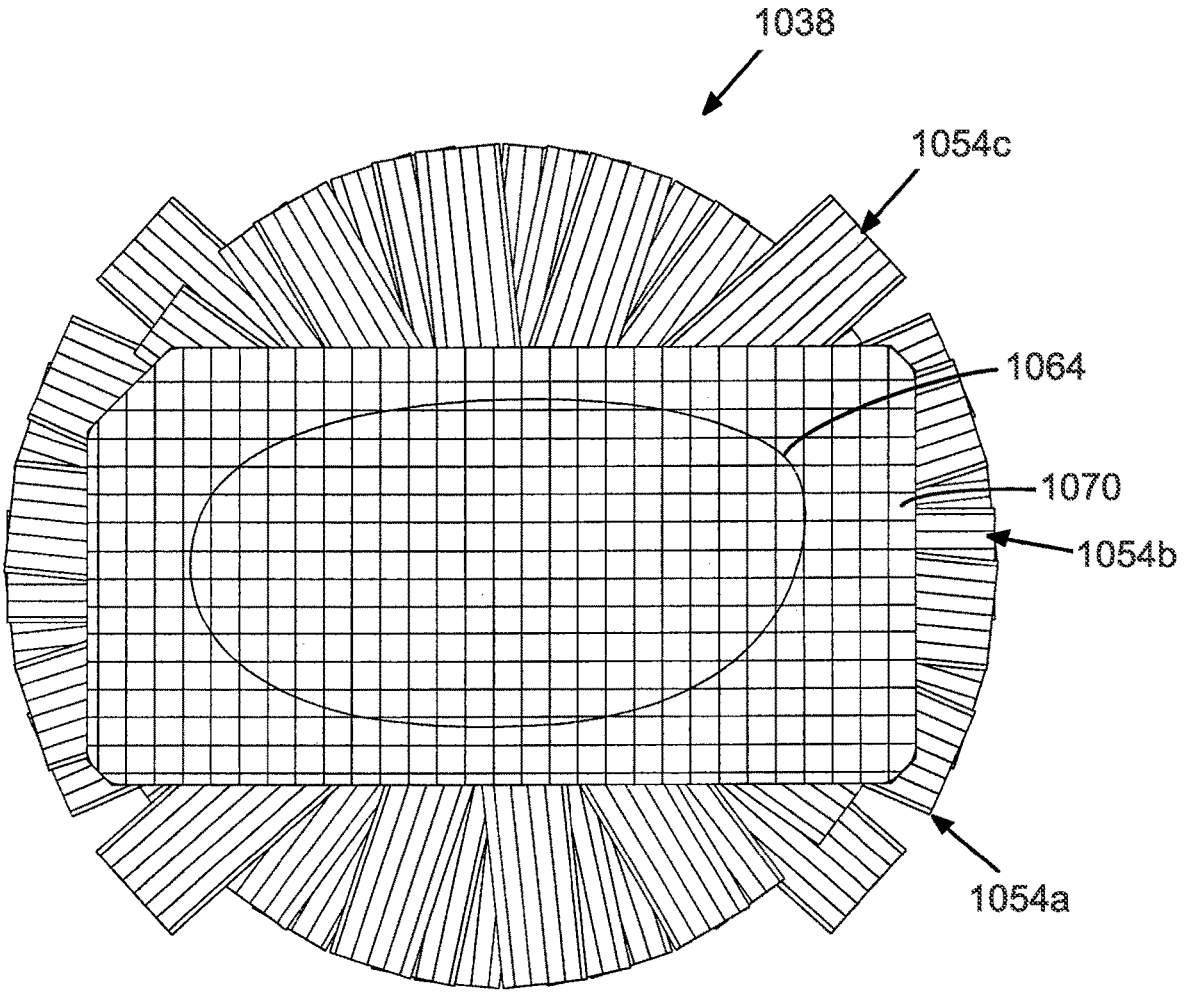
FIG. 16 is a top plan view of the composite lay-up shown in FIG. 12.

In certain embodiments, the composite component 1040 is fabricated by first forming an oversized lay-up of multiple prepreg plies, and then machining a sacrificial portion from the cured lay-up to form the finished part 1040. FIG. 16 is a top plan view of one example of a lay-up 1038 from which the composite component 1040 can be formed. The line 1064 in FIG. 16 represents the outline of the component 1040. Once cured, the portion surrounding the line 1064 can be removed to form the component 1040. FIG. 12 is an exploded view of the lay-up 1038. In the lay-up, each prepreg ply desirably has a prescribed fiber orientation, and the plies are stacked in a prescribed order with respect to fiber orientation.

As shown in FIG. 12, the illustrated lay-up 1038 is comprised of a plurality of sets, or unit-groups, 1052*a*-1052*k* of one or more prepreg plies of substantially uniform thickness and one or more sets, or unit-groups, 1054*a*-1054*g* of individual plies in the form of elongated strips 1056. For purposes of description, each set 1052*a*-1052*k* of one or more plies can be referred to as a composite "panel" and each set 1054*a*-1054*g* can be referred to as a "cluster" of elongated strips. The clusters 1054*a*-1054*g* of elongated strips 1056 are interposed between the panels 1052*a*-1052*k* and serve to increase the thickness of the finished part 1040 at its central region 1046 (FIG. 9). Each panel 1052*a*-1052*k* comprises one or more individual prepreg plies having a desired fiber orientation. The individual plies forming each panel 1052*a*-1052*k* desirably are of sufficient size and shape to form a cured lay-up from which the smaller finished component 1040 can be formed substantially free of defects. The clusters 1054*a*-1054*g* of strips 1056 desirably are individually positioned between and sandwiched by two adjacent panels (i.e., the panels 1052*a*-1052*k* separate the clusters 1054*a*-1054*g* of strips from each other) to facilitate adhesion between the many layers of prepreg material and provide an efficient distribution of fibers across a cross-section of the part.

In particular embodiments, the number of panels 1052*a*-1052*k* can range from 9 to 14 (with eleven panels 1052*a*-1052*k* being used in the illustrated embodiment) and the number of clusters 1054*a*-1054*g* can range from 1 to 12 (with seven clusters 1054*a*-1054*g* being used in the illustrated embodiment). However, in alternative embodiments, the number of panels and clusters can be varied depending on the desired profile and thickness of the part.

The prepreg plies used to form the panels 1052*a*-1052*k* and the clusters 1054*a*-1054*g* desirably comprise carbon fibers impregnated with a suitable resin, such as epoxy. An example carbon fiber is "34-700" carbon fiber (available from Grafil, Sacramento, CA), having a tensile modulus of 234 Gpa (34 Msi) and a tensile strength of 4500 Mpa (650 Ksi). Another Grafil fiber that can be used is "TR50S" carbon fiber, which has a tensile modulus of 240 Gpa (35 Msi) and a tensile strength of 4900 Mpa (710 ksi). Suitable epoxy resins are types "301" and "350" (available from Newport Adhesives and Composites, Irvine, CA). An exemplary resin content (RIC) is 40%.

Figure 13:
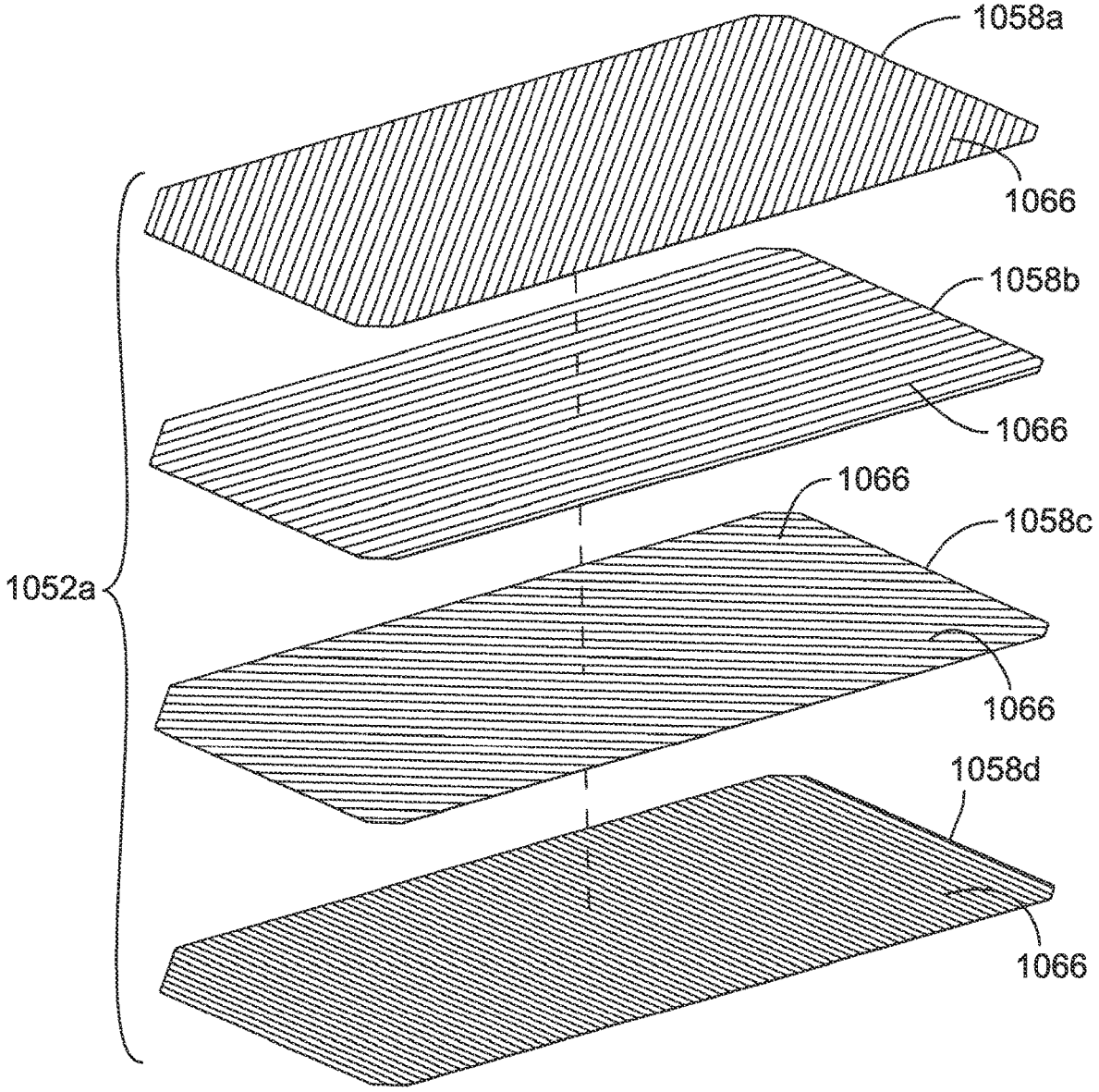
FIG. 13 is an exploded view of a group of prepreg plies of differing fiber orientations that are stacked to form a "quasi-isotropic" composite panel that can be used in the lay-up illustrated in FIG. 12.

FIG. 13 is an exploded view of the first panel 1052*a*. For convenience of reference, the fiber orientation (indicated by lines 1066) of each ply is measured from a horizontal axis of the club-head's face plane to a line that is substantially parallel with the fibers in the ply. As shown in FIG. 13, the panel 1052*a* in the illustrated example comprises a first ply 1058*a* having fibers oriented at +45 degrees, a second ply 1058*b* having fibers oriented at 0 degrees, a third ply 1058*c* having fibers oriented at −45 degrees, and a fourth ply 1058*d* having fibers oriented at 90 degrees. The panel 1052*a* of plies 1058*a*-1058*d* thus form a "quasi-isotropic" panel of prepreg material. The remaining panels 1052*b*-1052*k* can have the same number of prepreg plies and fiber orientation as set 1052*a*.

The lay-up illustrated in FIG. 12 can further include an "outermost" fiberglass ply 1070 adjacent the first panel 1052*a*, a single carbon-fiber ply 1072 adjacent the eleventh and last panel 1052*k*, and an "innermost" fiberglass ply 1074 adjacent the single ply 1072. The single ply can have a fiber orientation of 90 degrees as shown. The fiberglass plies 1070, 1074 can have fibers oriented at 0 degrees and 90 degrees. The fiberglass plies 1070, 1074 are essentially provided as sacrificial layers that protect the carbon-fiber plies when the cured lay-up is subjected to surface finishing such as sand blasting to smooth the outer surfaces of the part.

Figure 14:
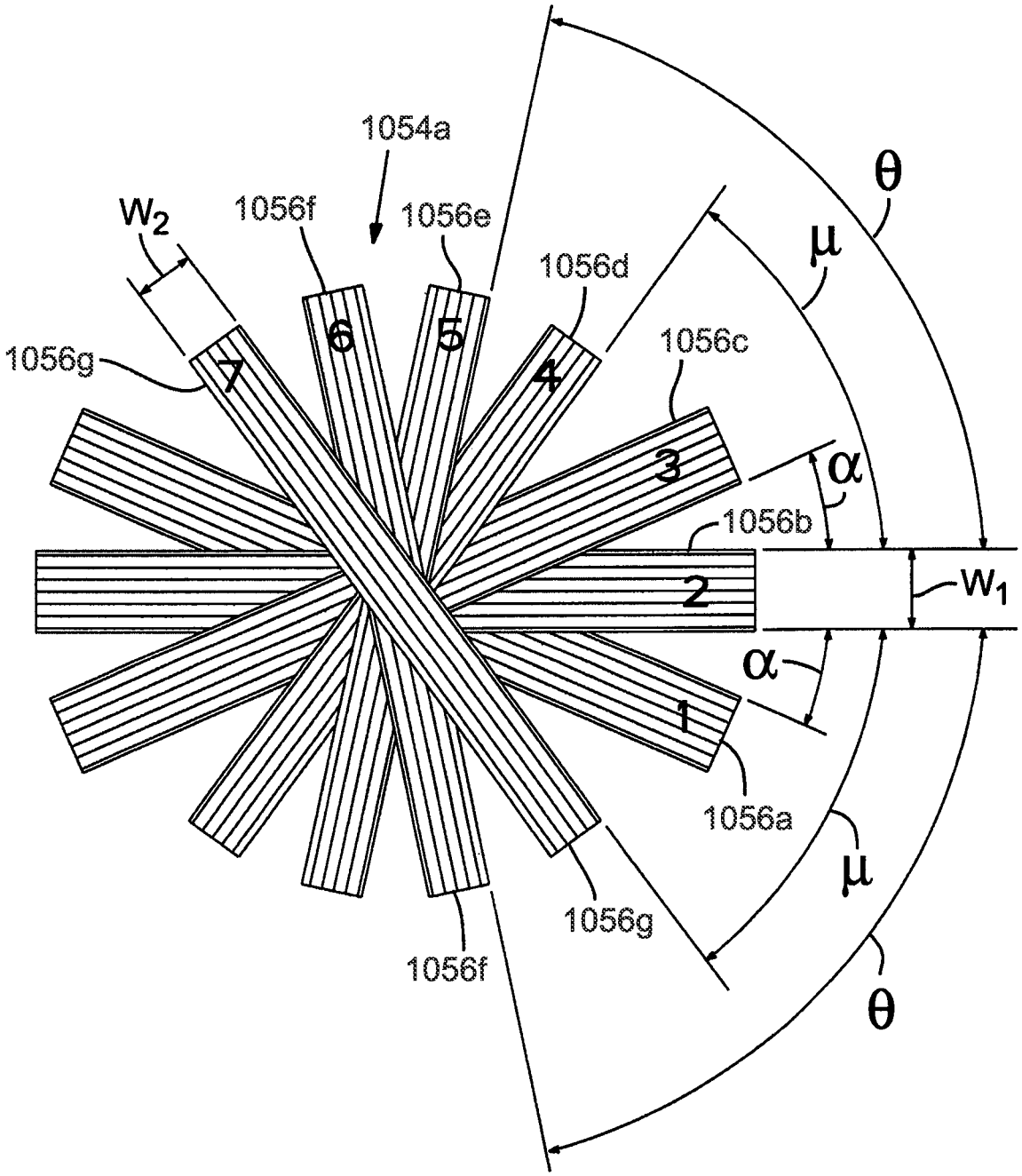
FIG. 14 is a plan view of a group or cluster of elongated prepreg strips that can be used in the lay-up illustrated in FIG. 12.

FIG. 14 is an enlarged plan view of the first cluster 1054*a* of elongated prepreg strips which are arranged with respect to each other so that the cluster has a variable thickness. The cluster 1054*a* in the illustrated example includes a first strip 1056*a*, a second strip 1056*b*, a third strip 1056*c*, a fourth strip 1056*d*, a fifth strip 1056*e*, a sixth strip 1056*f*, and a seventh strip 1056*g*. The strips are stacked in a criss-cross pattern such that the strips overlap each other to define an overlapping region 1060 and the ends of each strip are angularly spaced from adjacent ends of another strip. The cluster 1054*a* is therefore thicker at the overlapping region 1060 than it is at the ends of the strips. The strips can have the same or different lengths and widths, which can be varied depending on the desired overall shape of the composite part 1040, although each strip desirably is long enough to extend continuously across the finished part 1040 that is cut or otherwise machined from the oversized lay-up.

The strips 1056*a*-1056*g* in the illustrated embodiment are of equal length and are arranged such that the geometric center point 1062 of the cluster corresponds to the center of each strip. The first three strips 1056*a*-1056*c* in this example have a width $w_1$ that is greater than the width $w_2$ of the last four strips 1056*d*-1056*g*. The strips define an angle $\alpha$ between the "horizontal" edges of the second strip 1056*b* and the adjacent edges of strips 1056*a* and 1056*c*, an angle $\mu$ between the edges of strip 1056*b* and the closest edges of strips 1056*d* and 1056*g*, and an angle $\theta$ between the edges of strip 1056*b* and the closest edges of strips 1056*e* and 1056*f*. In a working embodiment, the width $w_1$ is about 20 mm, the width $w_2$ is about 15 mm, the angle $\alpha$ is about 24 degrees, the angle $\mu$ is about 54 degrees, and the angle $\theta$ is about 78 degrees.

Figure 15A:
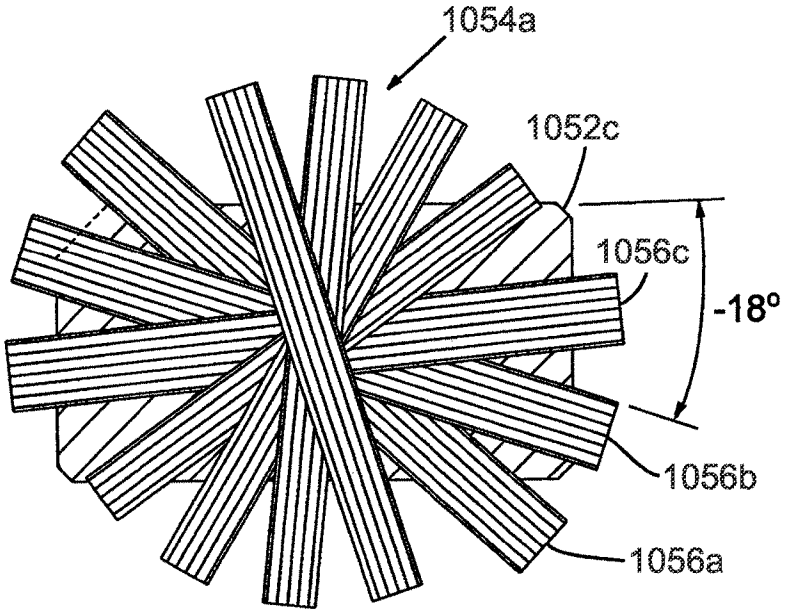
FIG. 15A-15C are plan views illustrating the manner in which clusters of prepreg strips can be oriented at different rotational positions relative to each other in a composite lay-up to create an angular offset between the strips of adjacent clusters.
Figure 15B:
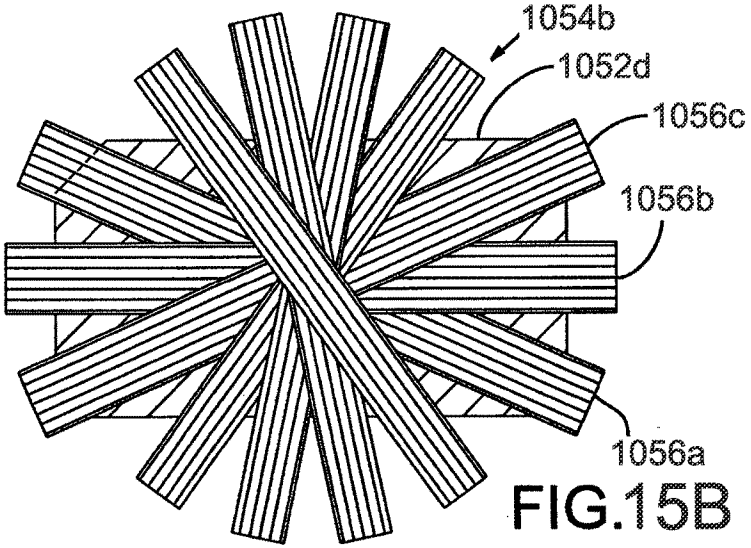
Figure 15C:
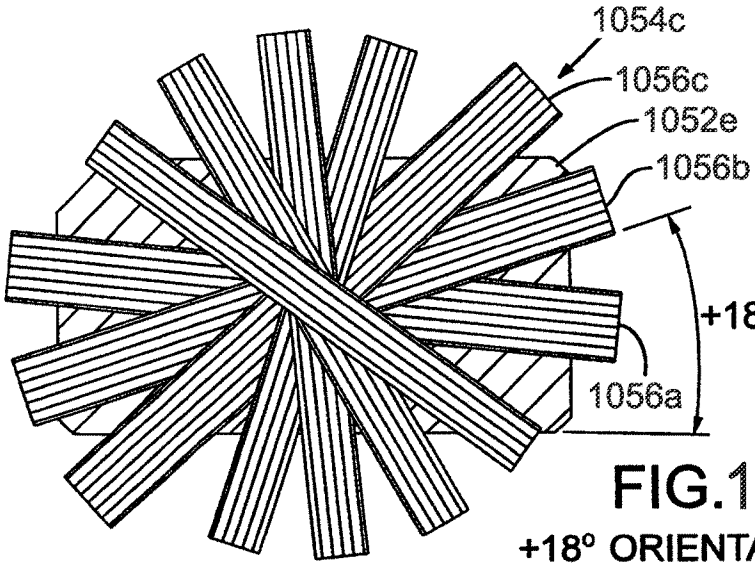

Referring again to FIG. 12, each cluster 1054*a*-1054*g* desirably is rotated slightly or angularly offset with respect to an adjacent cluster so that the end portions of each strip in a cluster are not aligned with the end portions of the strips of an adjacent cluster. In this manner, the clusters can be arranged relative to each other in the lay-up to provide a substantially uniform thickness in the peripheral region 1048 of the composite part (FIG. 10). In the illustrated embodiment, for example, the first cluster 1054*a* has an orientation of −18 degrees, meaning that the "upper" edge of the second strip 1056*b* extends at a −18 degree angle with respect to the "upper" horizontal edge of the adjacent unit-group 1052*c* (as best shown in FIG. 15A). The next successive cluster 1054*b* has an orientation of 0 degrees, meaning that the second strip 1056*b* is parallel to the "upper" horizontal edge of the adjacent unit-group 1052*d* (as best shown in FIG. 15B). The next successive cluster 1054*c* has an orientation of +18 degrees, meaning that the "lower" edge of the respective second strip 1056*b* of cluster 1054*c* extends at a +18 degree angle with respect to the "lower" edge of the adjacent unit-group 1052*e*. Clusters 1054*d*, 1054*e*, 1054*f*, and 1054*g* (FIG. 12) can have an orientation of 0 degrees, −18 degrees, 0 degrees, and +18 degrees, respectively.

When stacked in the lay-up, the overlapping regions 1060 of the clusters are aligned in the direction of the thickness of the lay-up to increase the thickness of the central region 1046 of the part 1040 (FIG. 10), while the "spokes" (the strips 1056*a*-1056*g*) are "fanned" or angularly spaced from each other within each cluster and with respect to spokes in adjacent clusters. Prior to curing/molding, the lay-up has a cross-sectional profile that is similar to the finished part 1040 (FIGS. 9-11) except that the lay-up is flat, that is, the lay-up does not have an overall convex shape. Thus, in profile, the rear surface of the lay-up has a central region of increased thickness and gradually tapers to a relatively thinner peripheral region of substantially uniform thickness surrounding the central region. In a working embodiment, the lay-up has a thickness of about 5 mm at the center of the central region and a thickness of about 3 mm at the peripheral region. A greater or fewer number of panels and/or clusters of strips can be used to vary the thickness at the central region and/or peripheral region of the lay-up.

To form the lay-up, according to one specific approach, formation of the panels 1052*a*-1052*k* may be done first by stacking individual precut, prepreg plies 1058*a*-1058*d* of each panel. After the panels are formed, the lay-up is built up by laying the second panel 1052*b* on top of the first panel 1052*a*, and then forming the first cluster 1054*a* on top of the second panel 1052*b* by laying individual strips 1056*a*-1056*g* in the prescribed manner. The remaining panels 1052*c*-1052*k* and clusters 1054*b*-1054*g* are then added to the lay-up in the sequence shown in FIG. 12, followed by the single ply 1072. The fiberglass plies 1070, 1074 can then be added to the front and back of the lay-up.

The fully-formed lay-up can then be subjected to a "debulking" or compaction step (e.g., using a vacuum table) to remove and/or reduce air trapped between plies. The lay-up can then be cured in a mold that is shaped to provide the desired bulge and roll of the face plate. An exemplary curing process is described in detail below. Alternatively, any desired bulge and roll of the face plate may be formed during one or more debulking or compaction steps performed prior to curing. To form the bulge or roll, the debulking step can be performed against a die panel having the final desired bulge and roll. In either case, following curing, the cured lay-up is removed from the mold and machined to form the part 1040.

The following aspects desirably are controlled to provide composite components that are capable of withstanding impacts and fatigue loadings normally encountered by a club-head, especially by the face plate of the club-head. These three aspects are: (a) adequate resin content; (b) fiber straightness; and (c) very low porosity in the finished composite. These aspects can be controlled by controlling the flow of resin during curing, particularly in a manner that minimizes entrapment of air in and between the prepreg layers. Air entrapment is difficult to avoid during laying up of prepreg layers. However, air entrapment can be substantially minimized by, according to various embodiments disclosed herein, imparting a slow, steady flow of resin for a defined length of time during the laying-up to purge away at least most of the air that otherwise would become occluded in the lay-up. The resin flow should be sufficiently slow and steady to retain an adequate amount of resin in each layer for adequate inter-layer bonding while preserving the respective orientations of the fibers (at different respective angles) in the layers. Slow and steady resin flow also allows the fibers in each ply to remain straight at their respective orientations, thereby preventing the "wavy fiber" phenomenon. Generally, a wavy fiber has an orientation that varies significantly from its naturally projected direction.

As noted above, the prepreg strips 1056 desirably are of sufficient length such that the fibers in the strips extend continuously across the part 1040; that is, the ends of each fiber are located at respective locations on the outer peripheral edge 1049 of the part 1040 (FIGS. 9-11). Similarly, the fibers in the prepreg panels 1052*a*-1052*k* desirably extend continuously across the part between respective locations on the outer peripheral edge 1049 of the part. During curing, air bubbles tend to flow along the length of the fibers toward the outer peripheral (sacrificial) portion of the lay-up. By making the strips sufficiently long and the panels larger than the final dimensions of the part 1040, the curing process can be controlled to remove substantially all of the entrapped air bubbles from the portion of the lay-up that forms the part 1040. The peripheral portion of the lay-up is also where wavy fibers are likely to be formed. Following curing, the peripheral portion of the lay-up is removed to provide a net-shape part (or near net-shape part if further finishing steps are performed) that has a very low porosity as well as straight fibers in each layer of prepreg material.

In working examples, parts have been made without any voids, or entrapped air, and with a single void in one of the prepreg plies of the lay-up (either a strip or a panel-size ply). Parts in which there is a single void having its largest dimension equal to the thickness of a ply (about 0.1 mm) have a void content, or porosity, of about $1.7\times10^{-6}$ percent or less by volume.

Figure 17A:
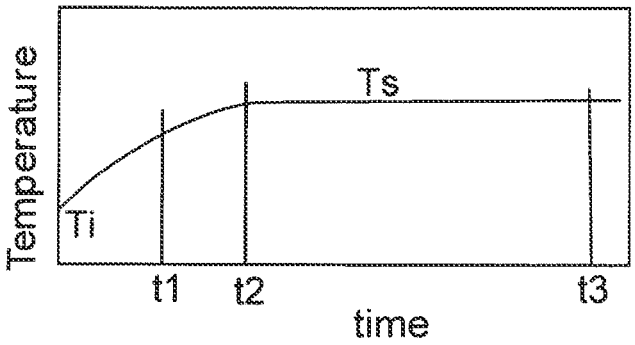
FIGS. 17A-17C are plots of temperature, viscosity, and pressure, respectively, versus time in a representative embodiment of a process for forming composite components.
Figure 17B:
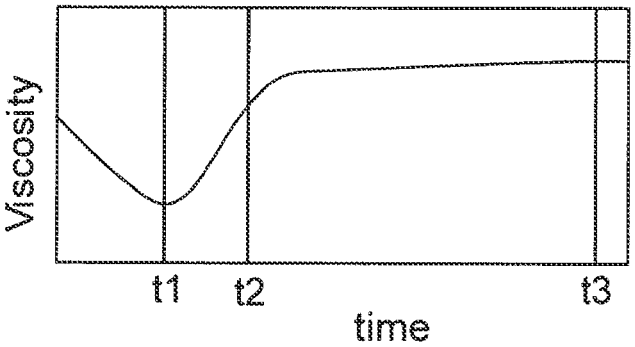
Figure 17C:
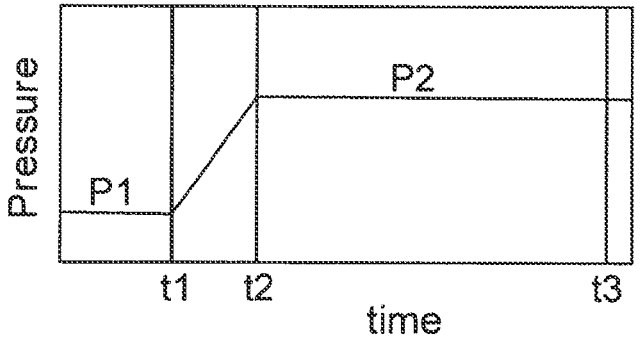
Figure 18A:
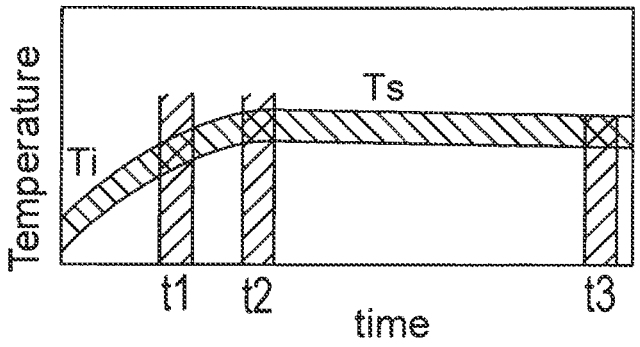
FIGS. 18A-18C are plots of temperature, viscosity, and pressure, respectively, versus time in a representative embodiment of a process in which each of these variables can be within a specified respective range (hatched areas).
Figure 18B:
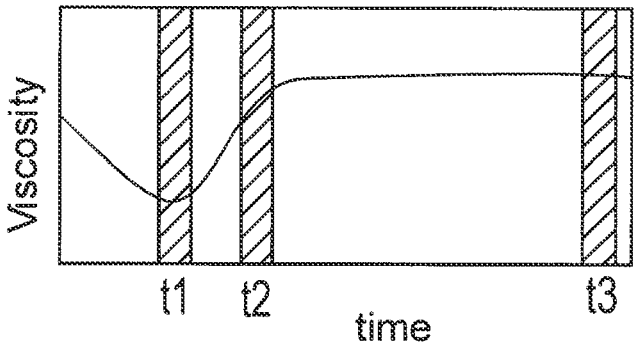
Figure 18C:
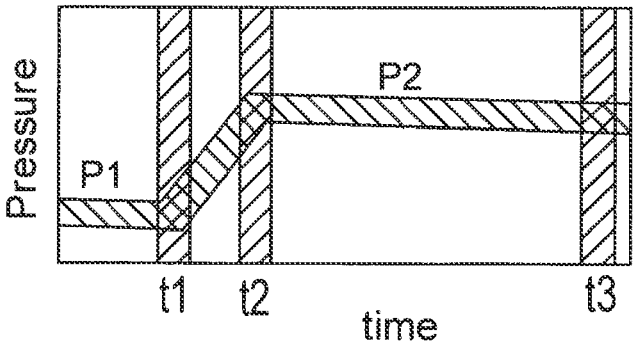

FIGS. 17A-17C depict an embodiment of a process (pressure and temperature as functions of time) in which slow and steady resin flow is performed with minimal resin loss. FIG. 17A shows temperature of the lay-up as a function of time. The lay-up temperature is substantially the same as the tool temperature. The tool is maintained at an initial tool temperature $T_i$, and the uncured prepreg lay-up is placed or formed in the tool at an initial pressure $P_1$ (typically atmospheric pressure). The tool and uncured prepreg is then placed in a hot-press at a tool-set temperature $T_s$, resulting in an increase in the tool temperature (and thus the lay-up temperature) until the tool temperature eventually reaches equilibrium with the set temperature $T_s$ of the hot-press. As the temperature of the tool increases from $T_i$ to $T_s$, the hot-press pressure is kept at $P_1$ for $t=0$ to $t=t_1$. At $t=t_1$, the hot-press pressure is ramped from $P_1$ to $P_2$ such that, at $t=t_2$, $P=P_2$. Between $T_i$ and $T_s$, the temperature increase of the tool and lay-up is continuous. Exemplary rates of change of temperature and pressure are: $\Delta T\sim30\text{-}60°$ C./minute up to $t_1$, and $\Delta P\sim50$ psi/minute from $t_1$ to $t_2$.

As the tool temperature increases from $T_i$ to $T_s$, the viscosity of the resin first decreases to a minimum, at time $t_1$, before the viscosity rises again due to cross-linking of the resin (FIG. 17B). At time $t_1$, resin flows relatively easily. This increased flow poses an increased risk of resin loss, especially if the pressure in the tool is elevated. Elevated tool pressure at this stage also causes other undesirable effects such as a more agitated flow of resin. Hence, tool pressure should be maintained relatively low at and around $t_1$ (see FIG. 17C). After $t_1$, cross-linking of the resin begins and progresses, causing a progressive rise in resin viscosity (FIG. 17B), so tool pressure desirably is gradually increased in the time span from $t_1$ to $t_2$ to allow (and to encourage) adequate and continued (but nevertheless controlled) resin flow. The rate at which pressure is increased should be sufficient to reach maximum pressure $P_2$ slightly before the end of rapid increase in resin viscosity. Again, a desired rate of change is $\Delta P\sim50$ psi/minute from $t_1$ to $t_2$. At time $t_2$ the resin viscosity desirably is approximately 80% of maximum.

Curing continues after time $t_2$ and follows a schedule of relatively constant temperature $T_s$ and constant pressure $P_2$. Note that resin viscosity exhibits some continued increase (typically to approximately 90% of maximum) during this phase of curing. This curing (also called "pre-cure") ends at time $t_3$ at which the component is deemed to have sufficient rigidity (approximately 90% of maximum) and strength for handling and removal from the tool, although the resin may not yet have reached a "full-cure" state (at which the resin exhibits maximum viscosity). A post-processing step typically follows, in which the components reach a "full cure" in a batch heating mode or other suitable manner.

Thus, important parameters of this specific process are: (a) $T_s$, the tool-set temperature (or typical resin-cure temperature), established according to manufacturer's instructions; (b) $T_i$, the initial tool temperature, usually set at approximately 50% of $T_s$ (in ° F. or ° C.) to allow an adequate time span ($t_2$) between $T_i$ and $T_s$ and to provide manufacturing efficiency; (c) $P_1$, the initial pressure that is generally slightly higher than atmospheric pressure and sufficient to hold the component geometry but not sufficient to "squeeze" resin out, in the range of 20-50 psig for example; (d) $P_2$, the ultimate pressure that is sufficiently high to ensure dimensional accuracy of components, in the range of 200-300 psig for example; (e) $t_1$, which is the time at which the resin exhibits a minimal viscosity, a function of resin properties and usually determined by experiment, for most resins generally in the range of 5-10 minutes after first forming the lay-up; (f) $t_2$, the time of maximum pressure, also a time delay from $t_1$, where resin viscosity increases from minimum to approximately 80% of a maximum viscosity (i.e., viscosity of fully cured resin), appears to be related to the moment when the tool reaches $T_s$; and (g) $t_3$, the time at the end of the pre-cure cycle, at which the components have reached handling strength and resin viscosity is approximately 90% of its maximum.

Many variations of this process also can be designed and may work equally as well. Specifically, all seven parameters mentioned above can be expressed in terms of ranges instead of specific quantities. In this sense, the processing parameters can be expressed as follows (see FIGS. 18A-18C):

$T_s$: recommended resin cure temperature±ΔT, where ΔT=20, 50, 75° F.

$T_i$: initial tool temperature (or $T_s/2$)±ΔT.

$P_1$: 0-100 psig±ΔP, where ΔP=5, 10, 15, 25, 35, 50 psi.

$P_2$: 200-500 psig±ΔP.

$t_1$: t(minimum±Δx viscosity)±Δt, where Δx=1, 2, 5, 10, 25% and Δt=1, 2, 5, min.

$t_2$: t(80%±Δx maximum viscosity)±Δt.

$t_3$: t(90%±Δx maximum viscosity)±Δt.

After reaching full-cure, the components are subjected to manufacturing techniques (machining, forming, etc.) that achieve the specified final dimensions, size, contours, etc., of the components for use as face plates on club-heads. Conventional CNC trimming can be used to remove the sacrificial portion of the fully-cured lay-up (e.g., the portion surrounding line 1064 in FIG. 16). However, because the tool applies a lateral cutting force to the part (against the peripheral edge of the part), it has been found that such trimming can pull fibers or portions thereof out of their plies and/or induce horizontal cracks on the peripheral edge of the part. These defects can cause premature delamination or other failure.

In certain embodiments, the sacrificial portion of the fully-cured lay-up is removed by water-jet cutting. In water-jet cutting, the cutting force is applied in a direction perpendicular to the prepreg plies (in a direction normal to the front and rear surfaces of the lay-up), which minimizes the occurrence of cracking and fiber pull out. Consequently, water-jet cutting can be used to increase the overall durability of the part.

The potential mass "savings" obtained from fabricating at least a portion of the face plate of composite, as described above, is about 10-30 g, or more, relative to a 2.7-mm thick face plate formed from a titanium alloy such as Ti-6Al-4V, for example. In a specific example, a mass savings of about 15 g relative to a 2.7-mm thick face plate formed from a titanium alloy such as Ti-6Al-4V can be realized. As mentioned above, this mass can be allocated to other areas of the club, as desired.

Figure 19:
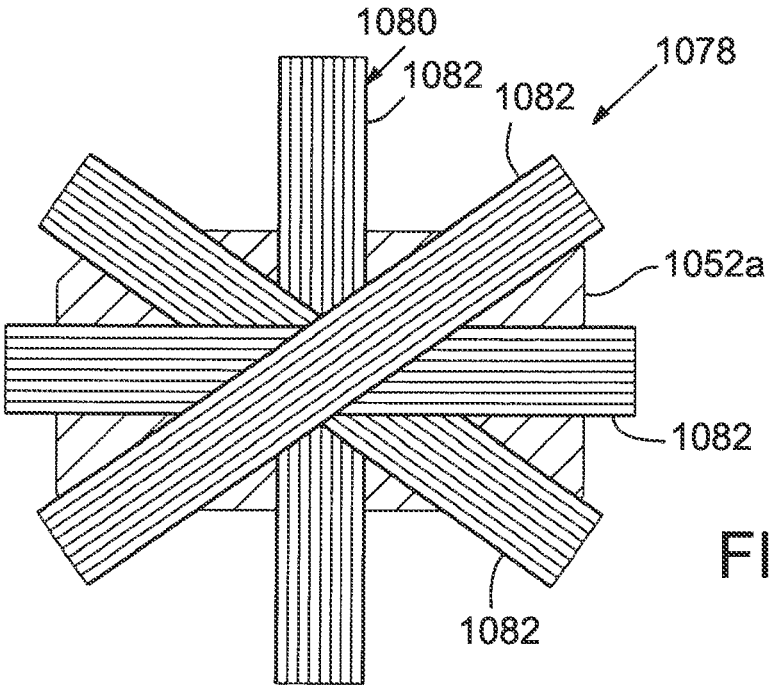
FIG. 19 is a plan view of a simplified lay-up of composite plies from which the component shown in FIG. 9 can be formed.

FIG. 19 shows a portion of a simplified lay-up 1078 that can be used to form the composite part 1040 (FIGS. 9-11). The lay-up 1078 in this example can include multiple prepreg panels (e.g., panels 1052*a*-1052*k*) and one or more clusters 1080 of prepreg strips 1082. The illustrated cluster 1080 comprises only four strips 1082 of equal width arranged in a criss-cross pattern and which are equally angularly spaced or fanned with respect to each other about the center of the cluster. Although the figure shows only one cluster 1080, the lay-up desirably includes multiple clusters 1080 (e.g., 1 to 12 clusters, with 7 clusters in a specific embodiment). Each cluster is rotated or angularly offset with respect to an adjacent cluster to provide an angular offset between strips of one cluster with the strips of an adjacent cluster, such as described above, in order to form the reduced-thickness peripheral portion of the lay-up.

Figure 22:
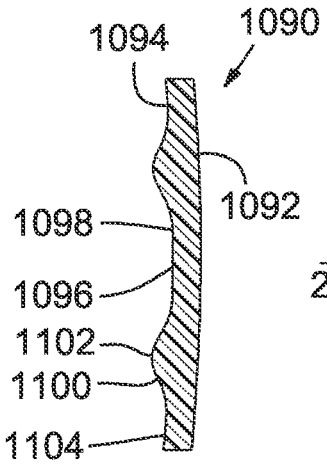
FIG. 22 is a cross-sectional view taken along line 22-22 of FIG. 20.
Figure 20:
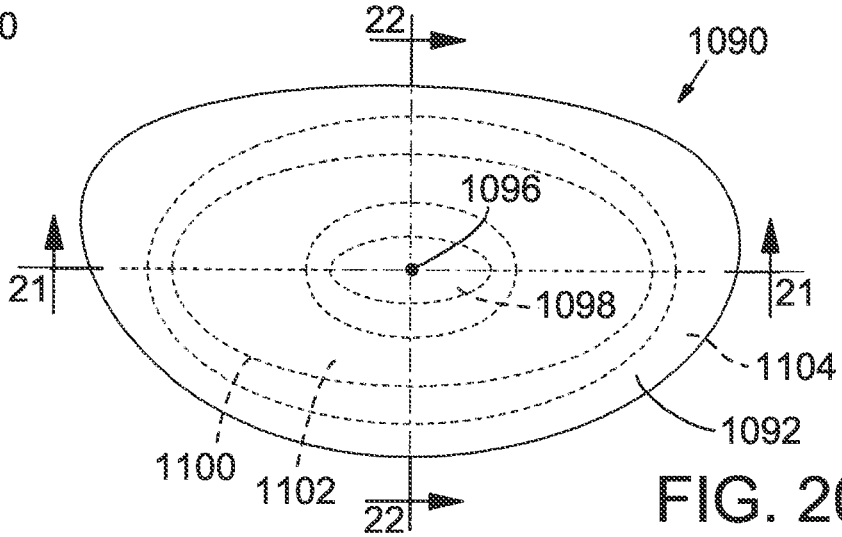
FIG. 20 is a front elevation view of another net-shape composite component that can be used to form the strike plate of a club-head.
Figure 21:
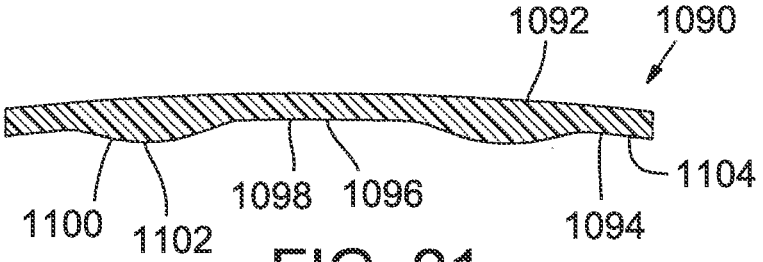
FIG. 21 is a cross-sectional view taken along line 21-21 of FIG. 20.

The embodiments described thus far provide a face plate having a projection or cone at the sweet spot. However, various other cross-sectional profiles can be achieved by selective placement of prepreg strips in the lay-up. FIGS. 20-22, for example, show a composite component 1090 for use as a face plate for a club-head (either by itself or in combination with a polymeric or metal outer layer). The composite component 1090 has a front surface 1092, a rear surface 1094, and an overall slightly convex shape. The reverse surface 1094 defines a point 1096 situated in a central recess 1098. The point 1096 represents the approximate center of the sweet spot of the face plate, not necessarily the center of the face plate, and is located in the approximate center of the recess 1098. The central recess 1098 is a "dimple" having a spherical or otherwise radiused sectional profile in this embodiment (see FIGS. 21 and 22), and is surrounded by an annular ridge 1100. At the point 1096 the thickness of the component 1090 is less than at the "top" 1102 of the annular ridge 1100. The top 1102 is normally the thickest portion of the component. Outward from the top 1102, the thickness of the component gradually decreases to form a peripheral region 1104 of substantially uniform thickness surrounding the ridge 1100. Hence, the central recess 1098 and surrounding ridge 1100 have a cross-sectional profile that is reminiscent of a "volcano." Generally speaking, an advantage of this profile is that thinner central region is effective to provide a larger sweet spot, and therefore a more forgiving club-head.

Figure 23:
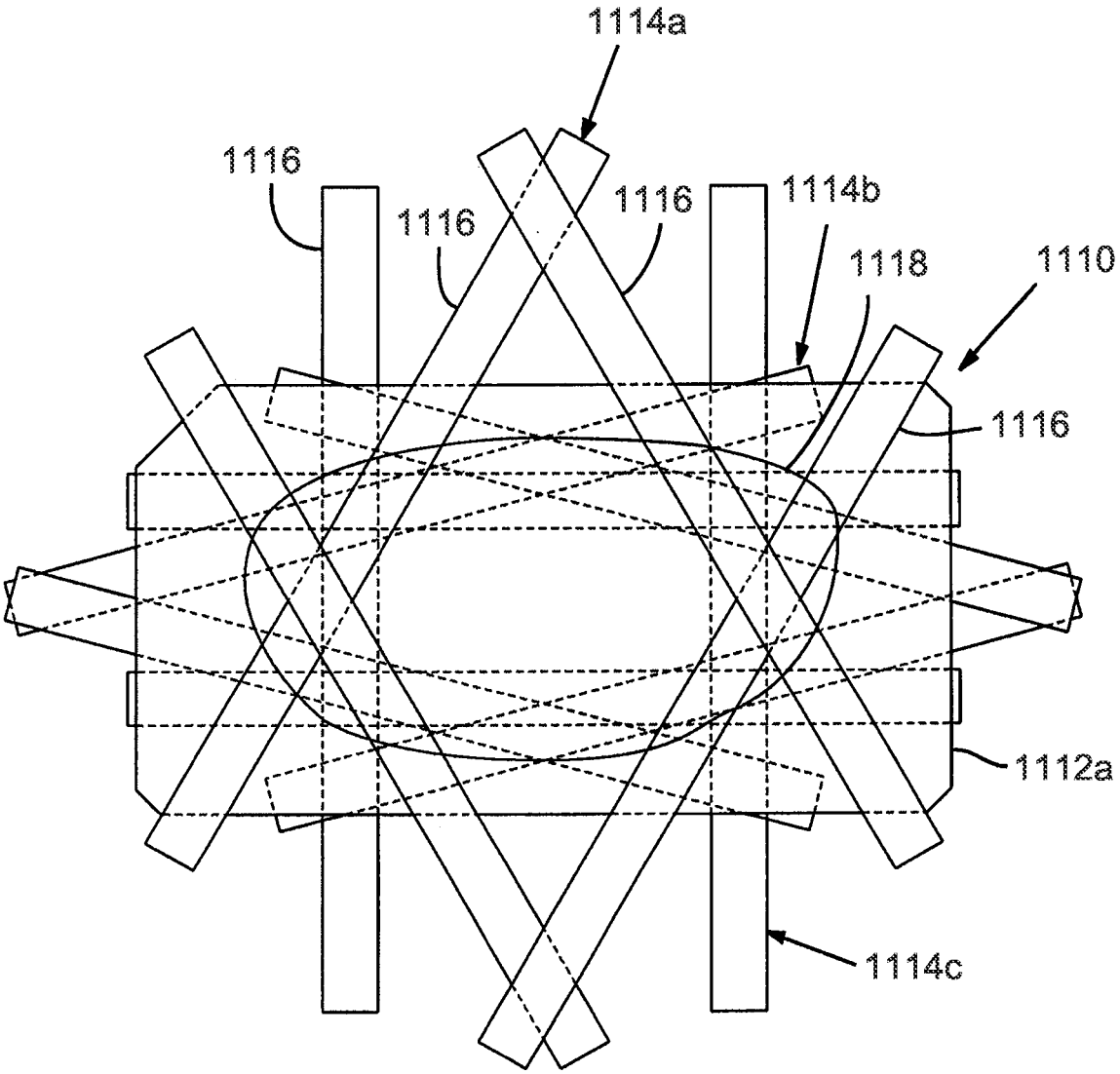
FIG. 23 is a top plan view of one embodiment of a lay-up of composite plies from which the component shown in FIG. 20 can be formed.
Figure 24:
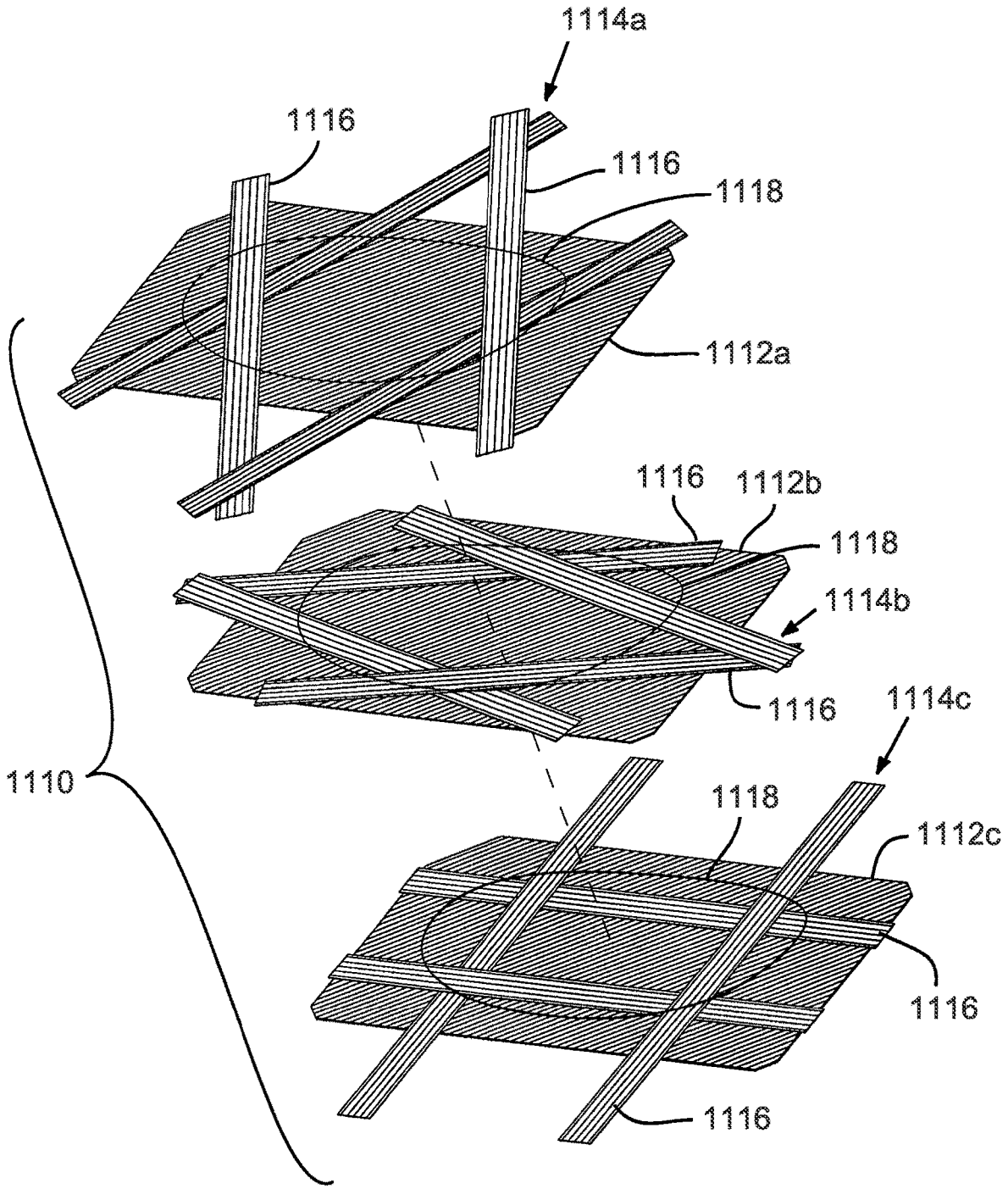
FIG. 24 is an exploded view of the first few groups of composite plies that are used to form the lay-up shown in FIG. 23.

FIG. 23 is a plan view of a lay-up 1110 of multiple prepreg plies that can be used to fabricate the composite component 1090. FIG. 24 shows an exploded view of a few of the prepreg layers that form the lay-up 1110. As shown, the lay-up 1110 includes multiple panels 1112*a*, 1112*b*, 1112*c* of prepreg material and sets, or clusters, 1114*a*, 1114*b*, 1114*c* of prepreg strips interspersed between the panels. The panels 1112*a*-1112*c* can be formed from one or more prepreg plies and desirably comprise four plies having respective fibers orientations of +45 degrees, 0 degrees, −45 degrees, and 90 degrees, in the manner described above. The line 1118 in FIGS. 23 and 24 represent the outline of the composite component 1090 and the portion surrounding the line 1118 is a sacrificial portion. Once the lay-up 1110 is cured, the sacrificial portion surrounding the line 1118 can be removed to form the component 1090.

Each cluster 1114*a*-1114*c* in this embodiment comprises four criss-cross strips 1116 arranged in a specific shape. In the illustrated embodiment, the strips of the first cluster 1114*a* are arranged to form a parallelogram centered on the center of the panel 1112*a*. The strips of the second cluster 1114*b* also are arranged to form a parallelogram centered on the center of the panel 1112*b* and rotated 90 degrees with respect to the first cluster 1114*a*. The strips of the third cluster 1114*c* are arranged to form a rectangle centered on the center of panel 1112*c*. When stacked in the lay-up, as best shown in FIG. 23, the strips 1116 of clusters 1114*a*-1114*c* overlay one another so as to collectively form an oblong, annular area of increased thickness corresponding to the annular ridge 1100 (FIG. 21). Hence, the fully-formed lay-up has a rear surface having a central recess and a surrounding annular ridge of increased thickness formed collectively by the build up of strip clusters 1114*a*-1114*c*. Additional panels 1112*a*-1112*c* and strip clusters 1114*a*-1114*c* may be added to lay-up to achieve a desired thickness profile.

It can be appreciated that the number of strips in each cluster can vary and still form the same profile. For example, in the another embodiment, clusters 1114*a*-1114*c* can be stacked immediately adjacent each other between adjacent panels 1112 (i.e., effectively forming one cluster of twelve strips 1116).

The lay-up 1110 may be cured and shaped to remove the sacrificial portion of the lay-up (the portion surrounding the line 1118 in FIG. 23 representing the finished part), as described above, to form a net shape part. As in the previous embodiments, each strip 1116 is of sufficient length to extend continuously across the part 1090 so that the free ends of the fibers are located on the peripheral edge of the part. In this manner, the net shape part can be formed free of any voids, or with an extremely low void content (e.g., about $1.7\times10^{-6}$ percent or less by volume) and can have straight fibers in each layer of prepreg material.

As mentioned above, any of various cross-sectional profiles can be achieved by arranging strips of prepreg material in a predetermined manner. Examples of other face plate profiles that can be formed by the techniques described herein are disclosed in U.S. Pat. Nos. 6,800,038, 6,824,475, 6,904,663, and 7,066,832, all of which are incorporated herein by reference.

As mentioned above, the face plate 1012 (FIG. 8) can include a composite plate and a metal cap covering the front surface of the composite plate. One such embodiment is shown, for example, in the partial section depicted in FIG. 25, in which the face plate 1012 comprises a metal "cap" 1130 formed or placed over a composite plate 1040 to form the strike surface 1013. The cap 1130 includes a peripheral rim 1132 that covers the peripheral edge 1134 of the composite plate 1040. The rim 1132 can be continuous or discontinuous, the latter comprising multiple segments (not shown).

The metal cap 1130 desirably is bonded to the composite plate 1040 using a suitable adhesive 1136, such as an epoxy, polyurethane, or film adhesive. The adhesive 1136 is applied so as to fill the gap completely between the cap 1130 and the composite plate 1040 (this gap usually in the range of about 0.05-0.2 mm, and desirably is approximately 0.1 mm). The face plate 1012 desirably is bonded to the body 1014 using a suitable adhesive 1138, such as an epoxy adhesive, which completely fills the gap between the rim 1132 and the adjacent peripheral surface 1140 of the face support 1018 and the gap between the rear surface of the composite plate 1040 and the adjacent peripheral surface 1142 of the face support 1018.

A particularly desirable metal for the cap 1130 is titanium alloy, such as the particular alloy used for fabricating the body (e.g., Ti-6Al-4V). For a cap 1130 made of titanium alloy, the thickness of the titanium desirably is less than about 1 mm, and more desirably less than about 0.3 mm. The candidate titanium alloys are not limited to Ti-6Al-4V, and the base metal of the alloy is not limited to Ti. Other materials or Ti alloys can be employed as desired. Examples include commercially pure (CP) grade Ti, aluminum and aluminum alloys, magnesium and magnesium alloys, and steel alloys.

Surface roughness can be imparted to the composite plate 1040 (notably to any surface thereof that will be adhesively bonded to the body of the club-head and/or to the metal cap 1130). In a first approach, a layer of textured film is placed on the composite plate 1040 before curing the film (e.g., "top" and/or "bottom" layers discussed above). An example of such a textured film is ordinary nylon fabric. Conditions under which the adhesives 1136, 1138 are cured normally do not degrade nylon fabric, so the nylon fabric is easily used for imprinting the surface topography of the nylon fabric to the surface of the composite plate. By imparting such surface roughness, adhesion of urethane or epoxy adhesive, such as 3M® DP 460, to the surface of the composite plate so treated is improved compared to adhesion to a metallic surface, such as cast titanium alloy.

In a second approach, texture can be incorporated into the surface of the tool used for forming the composite plate 1040, thereby allowing the textured area to be controlled precisely and automatically. For example, in an embodiment having a composite plate joined to a cast body, texture can be located on surfaces where shear and peel are dominant modes of failure.

Figure 25:
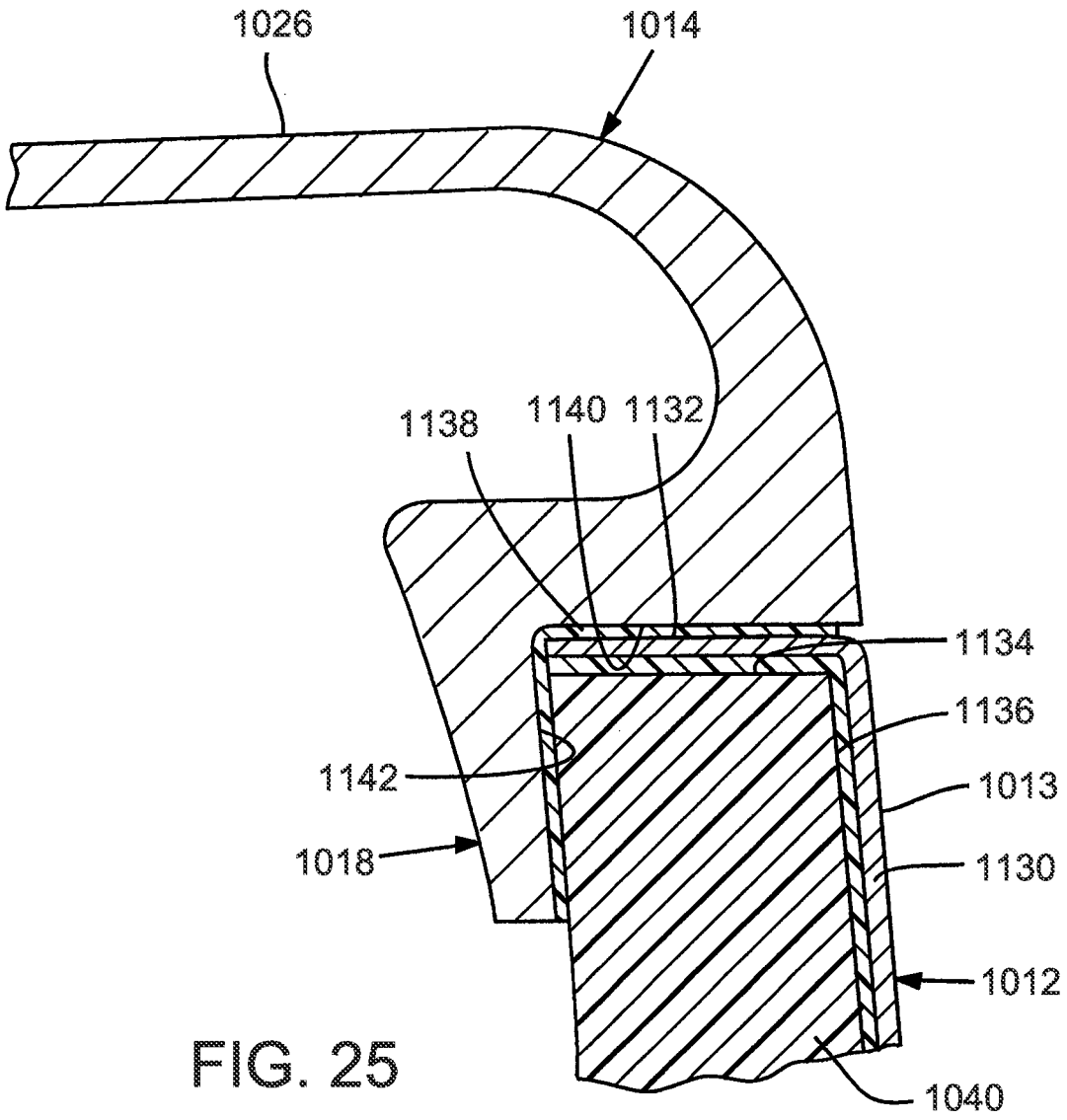
FIG. 25 is a partial sectional view of the upper lip region of an embodiment of a club-head of which the face plate comprises a composite plate and a metal cap.
Figure 26:
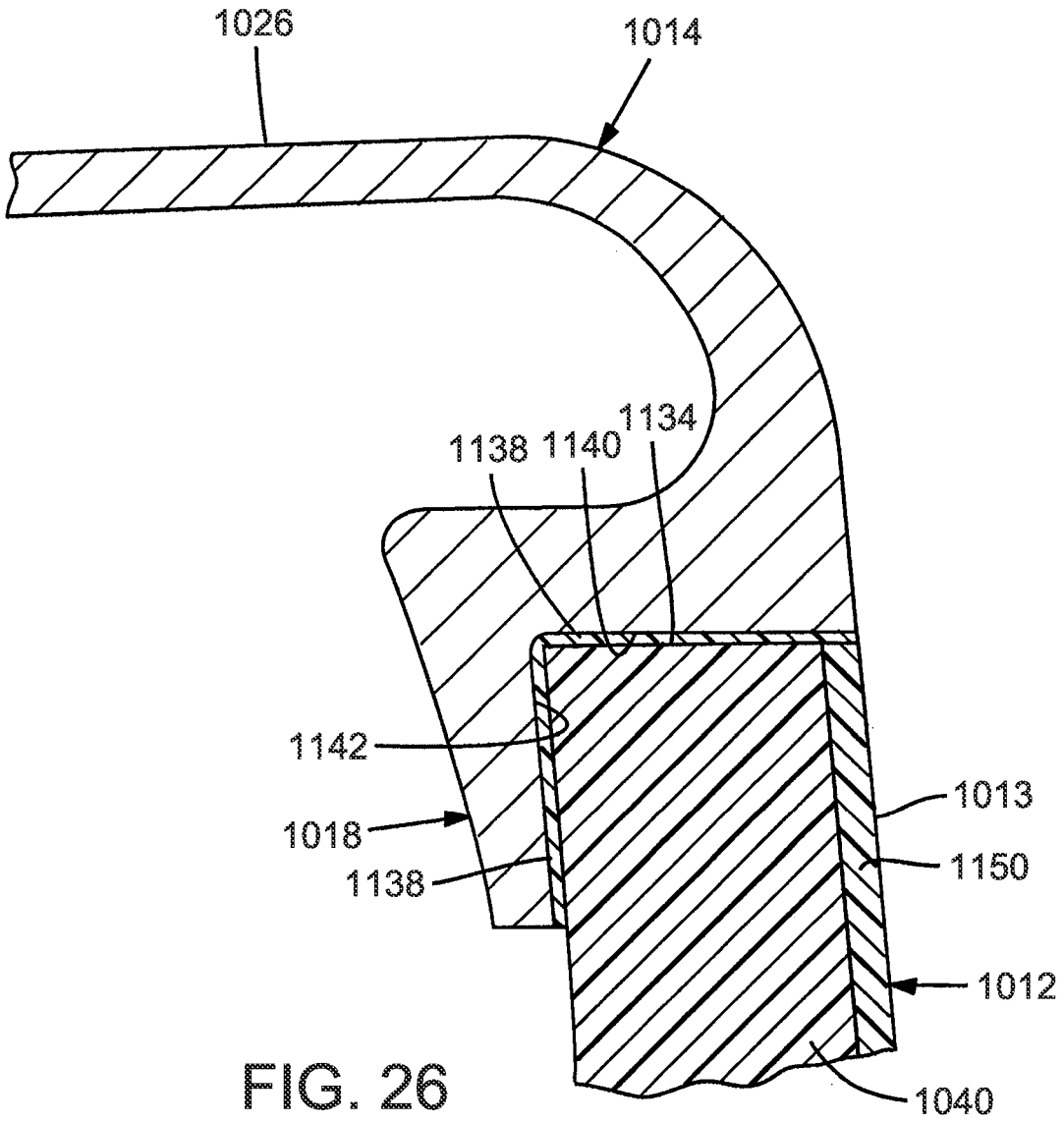
FIG. 26 is a partial sectional view of the upper lip region of an embodiment of a club-head of which the face plate comprises a composite plate and a polymeric outer layer.
Figure 28:
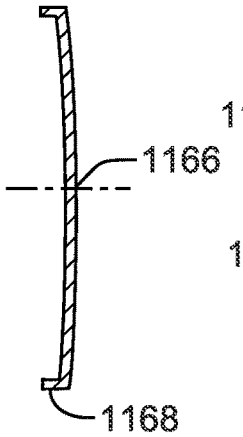
FIGS. 27-30 illustrate a metallic cover for a composite face plate.

FIG. 26 shows an embodiment similar to that shown in FIG. 25, with one difference being that in the embodiment of FIG. 26, the face plate 1012 includes a polymeric outer layer, or cap, 1150 on the front surface of the composite plate 1040 forming the striking surface 1013. The outer layer 0150 desirably completely covers at least the entire front surface of the composite plate 1040. A list of suitable polymers that can be used as an outer layer on a face plate is provide below. A particularly desirable polymer is urethane. For an outer layer 1150 made of urethane, the thickness of the layer desirably is in the range of about 0.2 mm to about 1.2 mm, with about 0.4 mm being a specific example. As shown, the face plate 1012 can be adhesively secured to the face support 1018 by an adhesive 1138 that completely fills the gap between the peripheral edge 1134 and the adjacent peripheral surface 1140 of the face support 1018 and the gap between the rear surface of the composite plate 1040 and the adjacent peripheral surface 1142 of the face support 1018.

The composite face plate as described above need not be coextensive (dimensions, area, and shape) with a typical face plate on a conventional club-head. Alternatively, a subject composite face plate can be a portion of a full-sized face plate, such as the area of the "sweet spot." Both such composite face plates are generally termed "face plates" herein. Further, the composite plate 1040 itself (without additional layers of material bonded or formed on the composite plate) can be used as the face plate 1012.

Example 1

In this example, a number of composite strike plates were formed using the strip approach described above in connection with FIGS. 9-16. A number of strike plates having a similar profile were formed using the partial ply approach described above. Five plates of each batch were sectioned and optically examined for voids. Table 2 below reports the yield of the examined parts. The yield is the percentage of parts made that did not contain any voids. As can be seen, the strip approach provided a much greater yield of parts without voids than the partial ply approach. The remaining parts of each batch were then subjected to endurance testing during which the parts were subjected to 3600 impacts at a ball speed of 50 m/s. As shown in Table 2, the parts made by the strip approach yielded a much higher percentage of parts that survived 3600 impacts than the parts made by the partial ply approach (72.73% vs. 52%). Table 2 also shows the average characteristic time (CT) (ball contact time with the strike plate) measured during the endurance test.

TABLE 2

| | Average weight (g) | Yield (%) | CT (μs) | Pieces tested | Number of passing parts | % of passing parts | Maximum shots |
|---|---|---|---|---|---|---|---|
| Strip | 21.9 | 81 | 255 | 11 | 8 | 72.73 | 3600 |
| Partial ply | 21.6 | 57.5 | 259 | 25 | 13 | 52 | 3600 |

Example 2

In this example, a number of composite strike plates were formed using the strip approach described above in connection with FIGS. 9-16. A number of strike plates having a similar profile were formed using the partial ply approach above. Five plates of each batch were sectioned and optically examined for voids. Table 3 below reports the yield of the parts formed by both methods. As in Example 1, the strip approach provided a much greater yield of parts without voids than the partial ply approach (90% vs. 70%). The remaining parts of each batch were then subjected to endurance testing during which the parts were subjected to 3600 impacts at a ball speed of 42 m/s. At this lower speed, all of the tested parts survived 3600 impacts.

TABLE 3

| | Average weight (g) | Yield (%) | CT (μs) | Pieces tested | Number of passing parts | % of passing parts | Maximum shots |
|---|---|---|---|---|---|---|---|
| Strip | 22 | 90 | 255 | 11 | 11 | 100 | 3600 |
| Partial ply | 21.5 | 70 | 258 | 16 | 16 | 100 | 3600 |

The methods described above provide improved structural integrity of the face plates and other club-head components manufactured according to the methods, compared to composite component manufactured by prior-art methods. These methods can be used to fabricate face plates for any of various types of clubs, such as (but not limited to) irons, wedges, putter, fairway woods, etc., with little to no process-parameter changes.

The subject methods are especially advantageous for manufacturing face plates because face plates are the most severely loaded components in golf club-heads. If desired, conventional (and generally less expensive) composite-processing techniques (e.g., bladder-molding, etc.) can be used to make other parts of a club-head not subject to such severe loads.

Moreover, the methods for fabricating composite parts described herein can be used to make various other types of composite parts, and in particular, parts that are subject to high impact loads and/or repetitive loads. Some examples of such parts include, without limitation, a hockey stick (e.g., the blade of a stick), a bicycle frame, a baseball bat, and a tennis racket, to name a few.

Example 3

Figure 27:
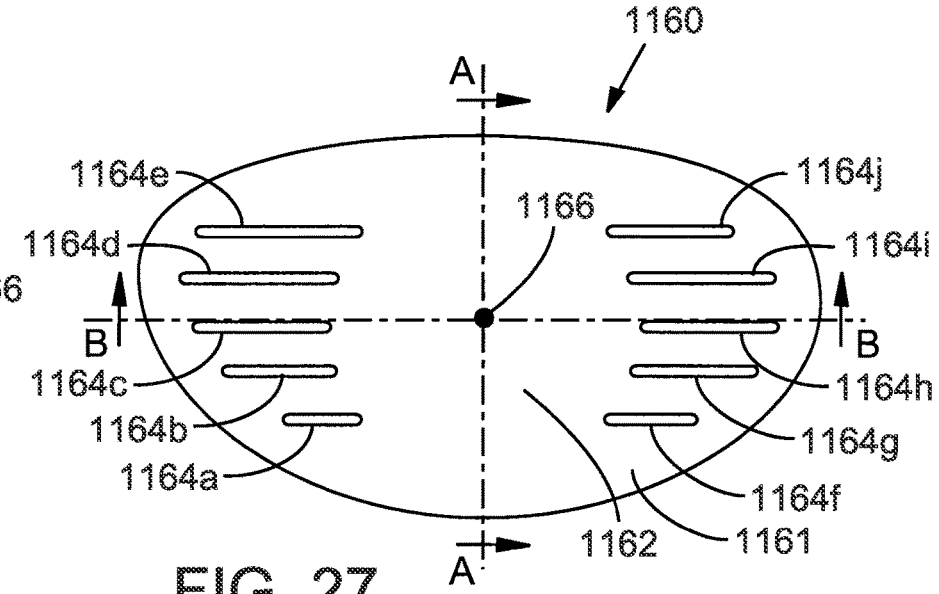
Figure 29:
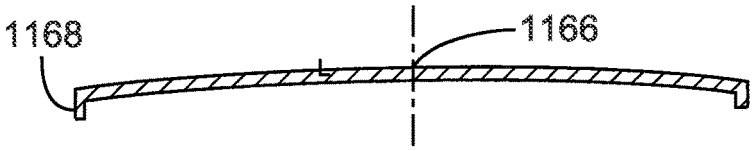

As shown in FIGS. 25-26, a metallic cover can be provided so that a golf club striking plate includes a composite face plate and a metallic striking surface that tends to be wear resistant. A representative metallic cover 1160 is illustrated in detail in FIGS. 27-30. Referring to FIG. 27, the metallic cover 1160 provides a striking surface 1161 that includes a central striking region 1162 and a plurality of contrasting scorelines **1164*a*-1164*j* that are associated with respective dents, depressions, or indentations in the metallic cover that are generally filled with a contrasting pigment or paint such as white paint. Scorelines generally extend along an axis parallel to a toe-to-heel direction. In a representative example, scorelines have lengths of between about 6 mm and 14 mm, with scoreline lengths larger toward a golf club crown. The scorelines are spaced about 6-7 mm apart in a top-to-bottom direction. The arrangement of FIG. 27** is one example, and other arrangements can be used.

The metallic cover 1160 is generally made of a titanium alloy or other metal such as those mentioned above, and has a bulge/roll center 1166 for bulge and roll curvatures that are provided to control club performance. Centers of curvature for bulge/roll curvatures are typically situated on an axis that is perpendicular to the striking surface 1161 at the bulge/roll center 1166. In this example, innermost edges of the scorelines **1164*a*-1164*j* are situated along a circumference of a circle having a diameter of about 40-50 mm that is centered at the bulge/roll center 1166. As shown in the sectional view of FIG. 28, a "roll" radius of curvature (a top-to-bottom radius of curvature) is about 300 mm and is symmetric about the bulge/roll center. As shown in the sectional view of FIG. 29, a "bulge" radius of curvature (a toe-to-heel radius of curvature) is about 410 mm and is symmetric about the bulge/roll center 1166. Bulge and roll curvatures can be spherical or circular curvatures, but other curvatures such as elliptical, oval, or other curvatures can be provided. In this example, a rim 1168 is provided and is intended to at least partially cover an edge of a composite faceplate to which the metallic cover 1160** is attached.

Figure 30:
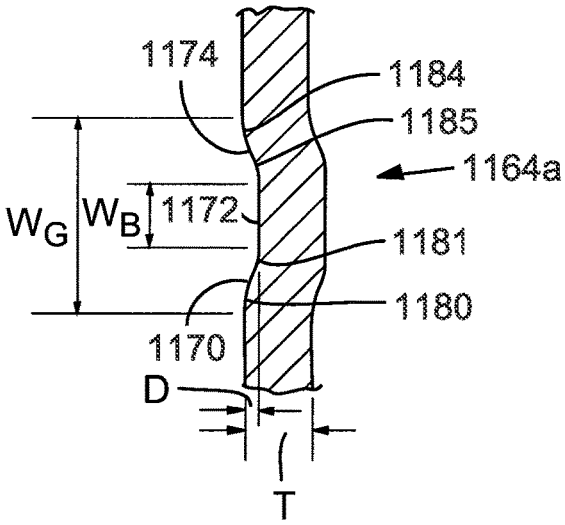
Figure 31:
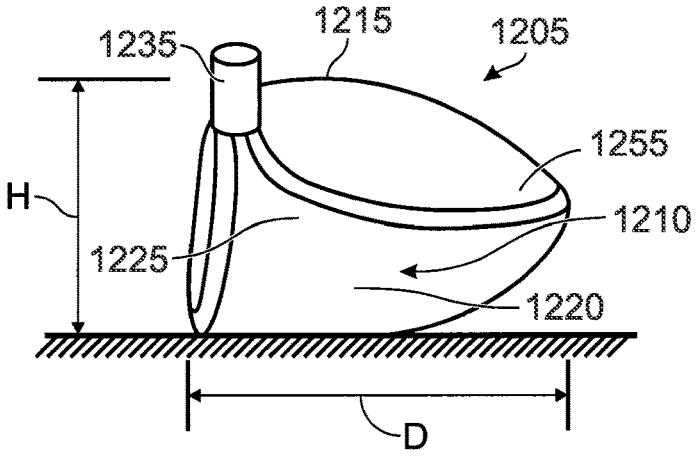
FIG. 31 is a side perspective view of a wood-type golf club head.
Figure 32:
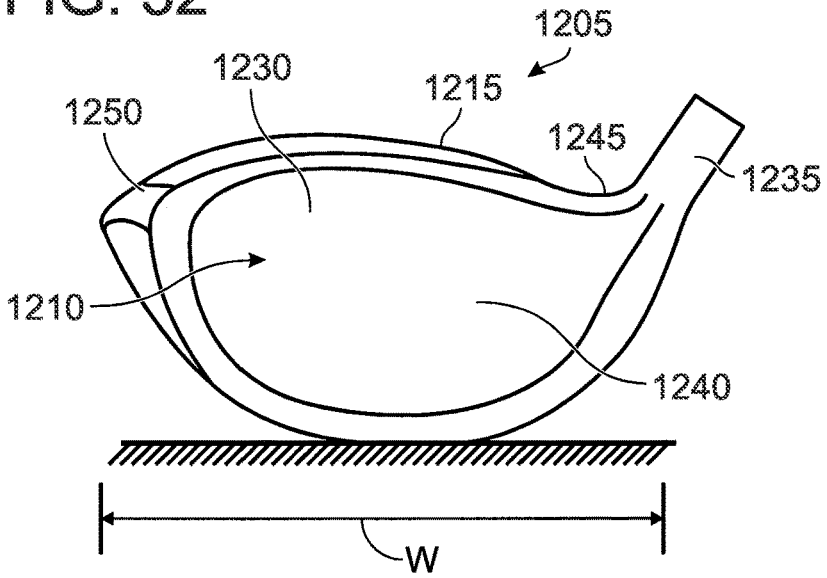
FIG. 32 is a front perspective view of a wood-type golf club head.
Figure 33:
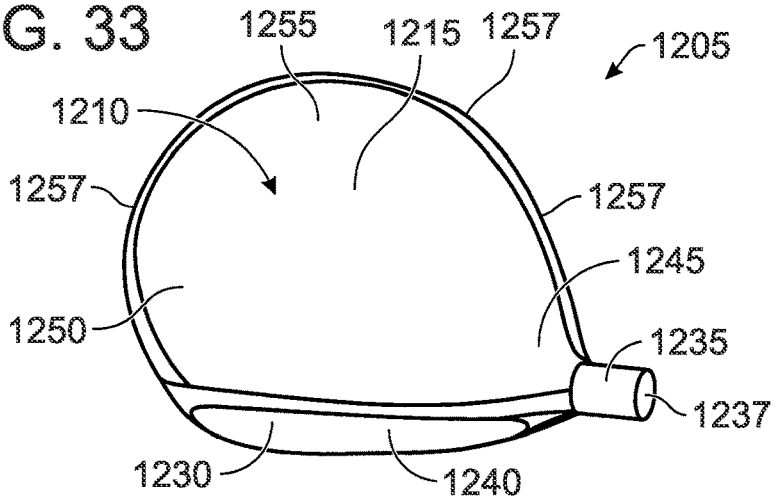
FIG. 33 is a top perspective view of a wood-type golf club head.
Figure 34:
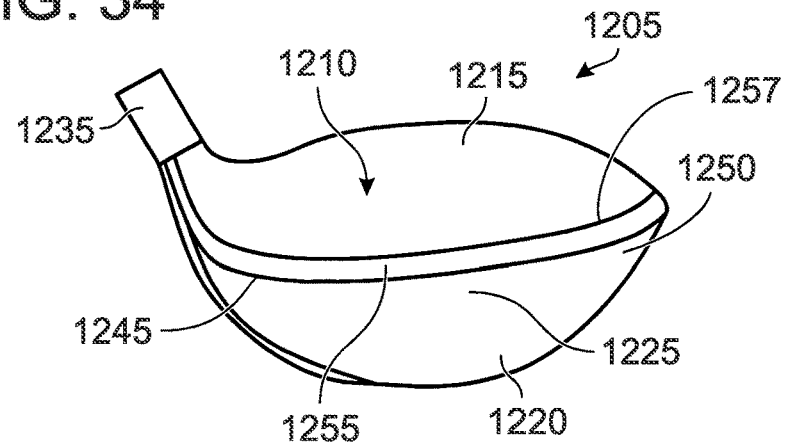
FIG. 34 is a back perspective view of a wood-type golf club head.

The striking region 1162 can be roughened by sandblasting, bead blasting, sanding, or other abrasive process or by a machining or other process. The scorelines **1164*a*-164*j* are situated outside of the intended striking region 1162 and are generally provided for visual alignment and do not typically contribute to ball trajectory. A cross-section of a representative scoreline 1164***a* is shown in FIG. 30 (paint or other pigment is not shown). The scoreline 1164*a* is provided as an indentation in the cover 1160 and includes transition portions 1170, 1174 and a bottom portion 1172. For a thin cover plate (thickness less than about 1.0 mm, 0.5 mm, 0.3 mm, or 0.2 mm), the scoreline 1164*a* can be formed by pressing a correspondingly shaped tool against a sheet of a selected cover plate material. An overall curvature for the cover 1160 can also be provided in the same manner based on a bulge and roll of a face plate such as a composite face plate to which the cover 1160 is to be applied. For a typical cover thickness, indented scorelines are associated with corresponding protruding features on a rear surface 1176 of the cover 1160. In this example, the scoreline 1164*a* has a depth D of about 0.07 mm in a cover having a thickness T of about 0.30 mm. A width W B of the bottom portion 1172 is about 0.29 mm, and a width $W_G$ of the entire indent is about 0.90 mm. The transition portions 1170, 1174 have inner and outer radiused regions 1181, 1185 and 1180, 1184, respectively, having respective radii of curvature of about 0.40 mm and 0.30 mm.

In other examples, a cover can be between about 0.10 mm and 1.0 mm thick, between about 0.2 mm and 0.8 mm thick, or between about 0.3 mm and 0.5 mm thick. Indentation depths between about 0.02 mm and 0.12 mm or about 0.06 mm and 0.10 mm are generally preferred for scoreline definition. Impact resistant cover plates with scorelines generally have scoreline depths D and cover plate thicknesses T such that a ratio D/T is less than about 0.4, 0.3, 0.25, or 0.20. A ratio $W_B/T$ is typically between about 0.5 and 1.5, 0.75 and 1.25, or 0.9 and 1.1. A ratio $W_G/T$ is typically between about 1 and 5, 2 and 4, or 2.5 and 3.5. A ratio of transition region radii of curvature R to cover thickness T is typically between about 0.5 and 1.5, 0.67 and 1.33, or 0.75 and 1.33. While it is convenient to provide scorelines based on common indentation depths, scorelines on a single cover can be based on indentations of one or more depths.

For wood-type golf clubs, an impact area is based on areas associated with inserts used in traditional wood golf clubs. For irons, an impact area is a portion of the striking surface within 20 mm on either side of a vertical centerline, but does not include 6.35 mm wide strips at the top and bottom of the striking surface. For wood-type golf clubs, scorelines are generally provided in a cover so as to be situated exterior to an impact region. The disclosed covers with scorelines are sufficiently robust for placement within or without an impact region for either wood or iron type golf clubs.

A cover is generally formed from a sheet of cover stock that is processed so as to have a bulge/roll region that includes the necessary arrangement of scoreline dents. The formed cover stock is then trimmed to fit an intended face plate, and attached to the face plate with an adhesive. Typically a glue layer is situated between the cover and the face plate, and the cover and face plate are urged together so as to form an adhesive layer of a suitable thickness. For typical adhesives, layer thicknesses between about 0.05 mm and 0.10 mm are preferred. Once a suitable layer thickness is achieved, the adhesive can be cured or allowed to set. In some cases, the cover includes a cover lip or rim as well so as to cover a face plate perimeter. The scoreline indentations are generally filled with paint of a color that contrasts with the remainder of the striking surface.

Although the scorelines are provided to realize a particular appearance in a finished product, the indentations used to define the scorelines also serve to control adhesive thickness. As a cover plate and a face plate are urged together in a gluing operation, the rear surface protrusions associated with the indentations tend to approach the face plate and thus regulate an adhesive layer thickness. Accordingly, indentation depth can be selected not only to retain paint or other pigment on a striking face, but can also based on a preferred adhesive layer thickness. In some examples, protruding features of indentations in a cover plate are situated at distances of less than about 0.10 mm, 0.05 mm, 0.03 mm, and 0.01 mm from a face plate surface as an adhesive layer thickness is established.

In other examples, the indent-based scorelines shown in FIGS. 27-30 can be replaced with grooves that are punched, machined, etched or otherwise formed in a cover plate sheet. Indentations are generally preferable as gluing operations based on indented plates are not generally associated with adhesive transfer to the striking surface. In addition, striking plates made with dented metallic covers tend to be more stable in long term use than cover plates that have been machined or punched. Scoreline or indent dimensions (length, depth, and transition region dimensions and curvatures) as well as scoreline or indentation location on a striking surface are preferably selected based on a selected cover material or cover material thickness. Fabrication methods (such as punching, machining) tend to produce cover plates that are more likely to show wear under impact endurance testing in which a finished striking plate is subject to the forces associated with 3000 shots by, for example, forming a club head with a striking plate under test, and making 3000 shots with the club head. A cover that performs successfully under such testing without degradation is referred as an impact-resistant cover plate.

In alterative embodiments, a cover includes a plurality of slots situated around a striking region. A suitably colored adhesive can be used to secure the cover layer to a face plate so that the adhesive fills the slots or is visible through the slots so to provide visible orientation guides on the striking plate surface.

Example 4

Polymer or other surface coatings or surface layers can be provided to composite or other face plates to provide performance similar to that of conventional irons and metal type woods. Such surface layers, methods of forming such layers, and characterization parameters for such layers are described below.

Surface Texture and Roughness

Surface textures or roughness can be conveniently characterized based a surface profile, i.e., a surface height as a function of position on the surface. A surface profile is typically obtained by interrogating a sample surface with a stylus that is translated across the surface. Deviations of the stylus as a function of position are recorded to produce the surface profile. In other examples, a surface profile can be obtained based on other contact or non-contact measurements such as with optical measurements. Surface profiles obtained in this way are often referred to as "raw" profiles. Alternatively, surface profiles for a golf club striking surface can be functionally assessed based on shot characteristics produced when struck with surfaces under wet conditions.

For convenience, a control layer is defined as a striking face cover layer configured so that shots are consistent under wet and dry playing conditions. Generally, satisfactory roughened or textured striking surfaces (or other control surfaces) provide ball spins of at least about 2000 rpm, 2500 rpm, 3000 rpm, or 3500 rpm under wet conditions when struck with club head speeds of between about 75 mph and 120 mph. Such control surfaces thus provide shot characteristics that are substantially the same as those obtained with conventional metal woods. Stylus or other measurement based surface roughness characterizations for such control surfaces are described in detail below.

A surface profile is generally processed to remove gradual deviations of the surface from flatness. For example, a wood-type golf club striking face generally has slight curvatures from toe-to-heel and crown-to-sole to improve ball trajectory, and a "raw" surface profile of a striking surface or a cover layer on the striking surface can be processed to remove contributions associated with these curvatures. Other slow (i.e., low spatial frequency) contributions can also be removed by such processing. Typically features of size of about 1 mm or greater (or spatial frequencies less than about 1/mm) can be removed by processing as the contributions of these features to ball spin about a horizontal or other axis tend to be relatively small. A raw (unprocessed) profile can be spatially filtered to enhance or suppress high or low spatial frequencies. Such filtering can be required in some measurements to conform to various standards such as DIN or other standards. This filtering can be performed using processors configured to execute a Fast Fourier Transform (FFT).

Generally, a patterned roughness or texture is applied to a substantial portion of a striking surface or at least to an impact area. For wood-type golf clubs, an impact area is based on areas associated with inserts used in traditional wood golf clubs. For irons, an impact area is a portion of the striking surface within 20 mm on either side of a vertical centerline, but does not include 6.35 mm wide strips at the top and bottom of the striking surface. Generally, such patterned roughness need not extend across the entire striking surface and can be provided only in a central region that does not extend to a striking surface perimeter. Typically for hollow metal woods, at least some portions of the striking surface at the striking surface perimeter lack pattern roughness in order to provide an area suitable for attachment of the striking plate to the head body.

Striking surface roughness can be characterized based on a variety of parameters. A surface profile is obtained over a sampling length of the striking surface and surface curvatures removed as noted above. An arithmetic mean R a is defined a mean value of absolute values of profile deviations from a mean line over a sampling length of the surface. For a surface profile over the sampling length that includes N surface samples each of which is associated with a mean value of deviations $Y_i$, from the mean line, the arithmetic mean $R_a$ is:

$$R_a = \frac{1}{N}\sum_{i=1}^{N}|Y_i|,$$

wherein i is an integer i=1, . . . , N. The sampling length generally extends along a line on the striking surface over a substantial portion or all of the striking area, but smaller samples can be used, especially for a patterned roughness that has substantially constant properties over various sample lengths. Two-dimensional surface profiles can be similarly used, but one dimensional profiles are generally satisfactory and convenient. For convenience, this arithmetic mean is referred to herein as a mean surface roughness.

A surface profile can also be further characterized based on a reciprocal of a mean width $S_m$ of the profile elements. This parameter is used and described in one or more standards set forth by, for example, the German Institute for Standardization (DIN) or the International Standards Organization (ISO). In order to establish a value for $S_m$, an upper count level (an upward surface deviation associated with a peak) and a lower count level (a downward surface deviation associated with a valley) are defined. Typically, the upper count level and the lower count level are defined as values that are 5% greater than the mean line and 5% less than the mean line, but other count levels can be used. A portion of a surface profile projecting upward over the upper count level is called a profile peak, and a portion projecting downward below the given lower count level is called a profile valley. A width of a profile element is a length of the segment intersecting with a profile peak and the adjacent profile valley. $S_m$ is a mean of profile element widths $S_{mi}$ within a sampling length:

$$S_m = \frac{1}{K}\sum_{i=1}^{K}S_{mi}$$

For convenience, this mean is referred to herein as a mean surface feature width.

In determining $S_m$, the following conditions are generally satisfied: 1) Peaks and valleys appear alternately; 2) An intersection of the profile with the mean line immediately before a profile element is the start point of a current profile element and is the end point of a previous profile element; and 3) At the start point of the sampling length, if either of the profile peak or profile valley is missing, the profile element width is not taken into account. Rpc is defined as a reciprocal of the mean width $S_m$ and is referred to herein as mean surface feature frequency.

Another surface profile characteristic is a surface profile kurtosis Ku that is associated with an extent to which profile samples are concentrated near the mean line. As used herein, a the profile kurtosis Ku is defined as:

$$Ku = \frac{1}{R_q^4}\square\frac{1}{N}\sum_{i=1}^{N}(Y_i)^4,$$

wherein $R_q$ a square root of the arithmetic mean of the squares of the profile deviations from the mean line, i.e., $$R_q = \left(\frac{1}{N}\sum_{i=1}^{N}Y_i^2\right)^{1/2}.$$

Profile kurtosis is associated with an extent to which surface features are pointed or sharp. For example, a triangular wave shaped surface profile has a kurtosis of about 0.79, a sinusoidal surface profile has a kurtosis of about 1.5, and a square wave surface profile has a kurtosis of about 1.

Other parameters that can be used to characterize surface roughness include $R_z$ which is based on a sum of a mean of a selected number of heights of the highest peaks and a mean of a corresponding number of depths of the lowest valleys.

One or more values or ranges of values can be specified for surface kurtosis Ku, mean surface feature width $S_m$, and arithmetic mean deviation $R_a$ (mean surface roughness) for a particular golf club striking surface. Superior results are generally obtained with $R_a \leq 5$ μm, $R_{pc} \geq 30$/cm, and $K_u \geq 2.0$.

Wood-Type Club Heads

For convenient illustration, representative examples of striking plates and cover layers for such striking plates are set forth below with reference to wood-type golf clubs. In other examples, such striking plates can be used in iron-type golf clubs. In some examples, face plate cover layers are formed on a surface of a face plate in a molding process, but in other examples surface layers are provided as caps that are formed and then secured to a face plate.

As illustrated in FIGS. 31-34, a typical wood type (i.e., driver or fairway wood) golf club head 1205 includes a hollow body 1210 delineated by a crown 1215, a sole 1220, a skirt 1225, a striking plate 1230, and a hosel 1235. The striking plate 1230 defines a front surface, or striking face 1240 adapted for impacting a golf ball (not shown). The hosel 1235 defines a hosel bore 1237 adapted to receive a golf club shaft (not shown). The body 1210 further includes a heel portion 1245, a toe portion 1250 and a rear portion 1255. The crown 1215 is defined as an upper portion of the club head 5 extending above a peripheral outline 1257 of the club head as viewed from a top-down direction and rearwards of the topmost portion of the striking face 1240. The sole 1220 is defined as a lower portion of the club head 1205 extending in an upwardly direction from a lowest point of the club head approximately 50% to 60% of the distance from the lowest point of the club head to the crown 1215. The skirt 1225 is defined as a side portion of the club head 1205 between the crown 1215 and the sole 1220 extending immediately below the peripheral outline 1257 of the club head, excluding the striking face 1240, from the toe portion 1250, around the rear portion 1255, to the heel portion 1245. The club head 1205 has a volume, typically measured in cubic-centimeters ($cm^3$), equal to the volumetric displacement of the club head 1205.

Figure 35:
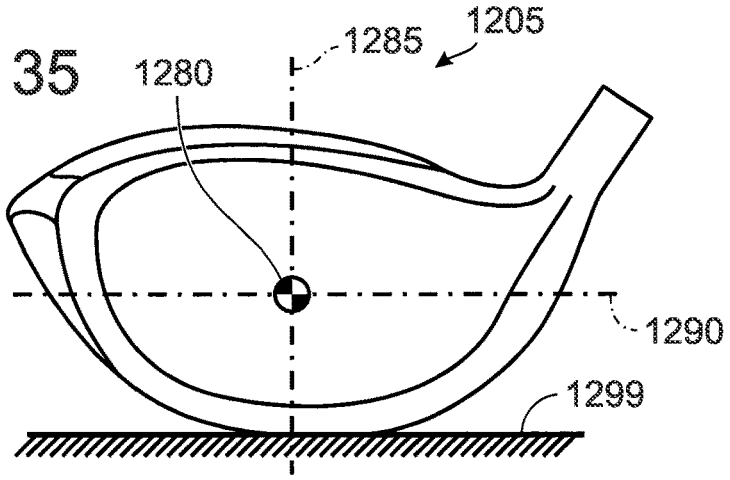
FIG. 35 is a front perspective view of a wood-type golf club head showing a golf club head center of gravity coordinate system.
Figure 36:
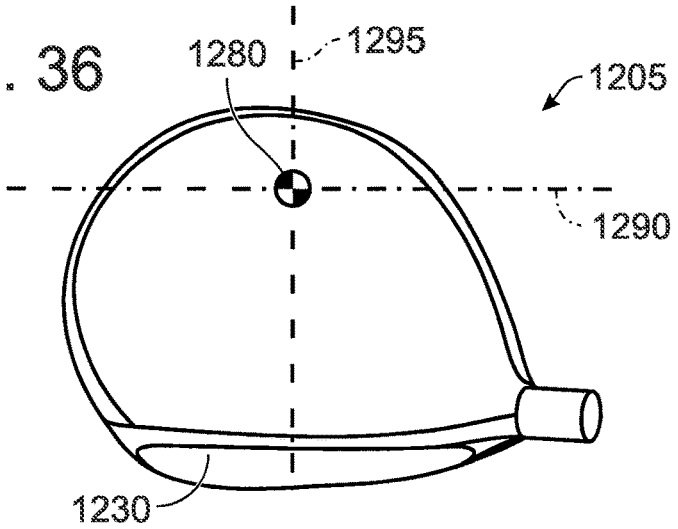
FIG. 36 is a top perspective view of a wood-type golf club head showing a golf club head center of gravity coordinate system.
Figure 37:
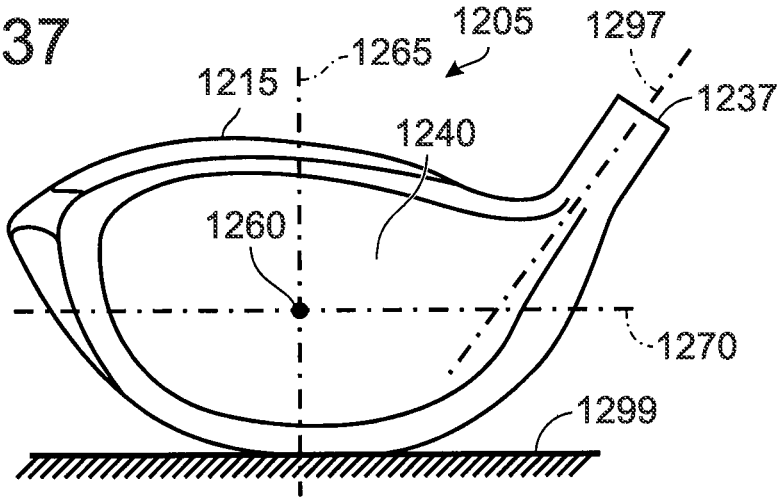
FIG. 37 is a front perspective view of a wood-type golf club head showing a golf club head origin coordinate system.
Figure 38:
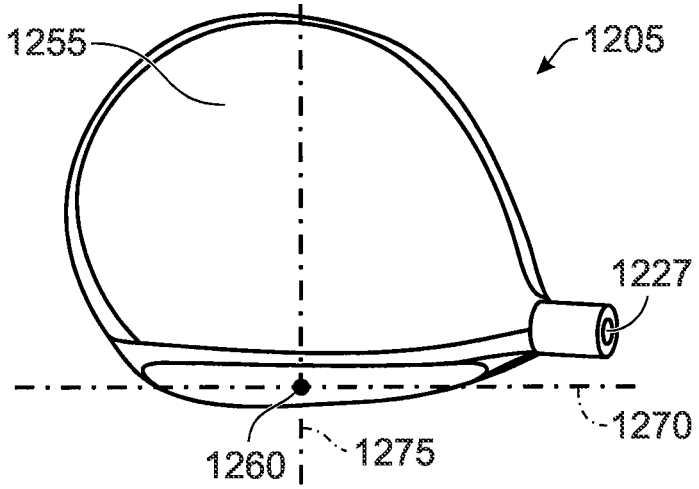
FIG. 38 is a top perspective view of a wood-type golf club head showing a golf club head origin coordinate system.

Referencing FIGS. 35-36, club head coordinate axes can be defined with respect to a club head center-of-gravity (CG) 1280. A $CG_z$-axis 1285 extends through the CG 1280 in a generally vertical direction relative to the ground 1299 when the club head 1205 is at address position. A $CG_x$-axis 1290 extends through the CG 1280 in a heel-to-toe direction generally parallel to the striking face 1240 and generally perpendicular to the $CG_z$-axis 1285. A $CG_y$-axis 1095 extends through the CG 1280 in a front-to-back direction and generally perpendicular to the $CG_x$-axis 1290 and the $CG_z$-axis 1285. The $CG_x$-axis 1290 and the $CG_y$-axis 1295 both extend in a generally horizontal direction relative to the ground when the club head 1005 is at address position. The polymer coated or capped striking plates described herein generally provide 2-15 g of additional distributable mass so that placement of the CG 1280 can be selected using this mass.

A club head origin coordinate system can also be used. Referencing FIGS. 37-38, a club head origin 1260 is represented on club head 1205. The club head origin 1260 is positioned at an approximate geometric center of the striking face 1240 (i.e., the intersection of the midpoints of the striking face's height and width, as defined by the USGA "Procedure for Measuring the Flexibility of a Golf Clubhead," Revision 2.0).

The head origin coordinate system, with head origin 1260, includes three axes: a z-axis 1265 extending through the head origin 1260 in a generally vertical direction relative to the ground 1100 when the club head 1205 is at address position; an x-axis 1270 extending through the head origin 1060 in a heel-to-toe direction generally parallel to the striking face 1240 and generally perpendicular to the z-axis 1265; and a y-axis 1275 extending through the head origin 1260 in a front-to-back direction and generally perpendicular to the x-axis 1270 and the z-axis 1265. The x-axis 1270 and the y-axis 1275 both extend in a generally horizontal direction relative to the ground 1299 when the club head 1205 is at address position. The x-axis 1270 extends in a positive direction from the origin 1260 to the toe 1250 of the club head 1205; the y-axis 1275 extends in a positive direction from the origin 1260 towards the rear portion 1255 of the club head 1205; and the z-axis 1265 extends in a positive direction from the origin 1260 towards the crown 1215.

In a club-head according to one embodiment, a striking plate includes a face plate and a cover layer. In addition, in some examples, at least a portion of the face plate is made of a composite including multiple plies or layers of a fibrous material (e.g., graphite, or carbon, fiber) embedded in a cured resin (e.g., epoxy). Examples of suitable polymers that can be used to form the cover layer include, without limitation, urethane, nylon, SURLYN ionomers, or other thermoset, thermoplastic, or other materials. The cover layer defines a striking surface that is generally a patterned, roughened, and/or textured surface as described in detail below. Striking plates based on composites typically permit a mass reduction of between about 5 g and 20 g in comparison with metal striking plates so that this mass can be redistributed.

Figure 41:
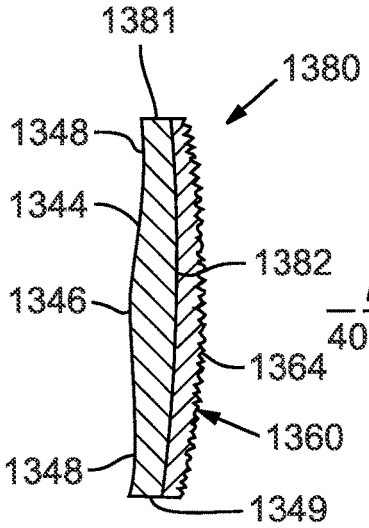
FIGS. 39-41 illustrate a striking plate that includes a face plate and a cover layer having a striking surface with a patterned roughness.
Figure 39:
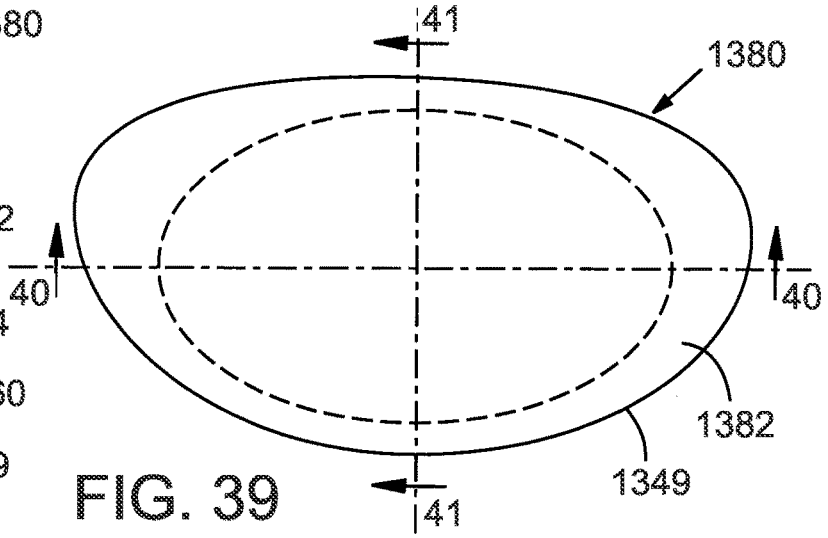
Figure 40:
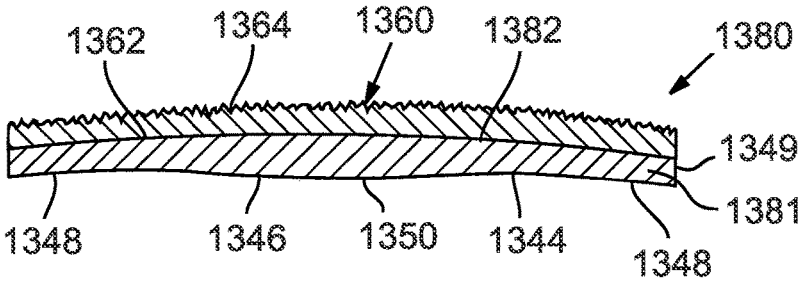

In the example shown in FIGS. 39-41, a striking plate 1380 includes a face plate 1381 fabricated from a plurality of prepreg plies or layers and has a desired shape and size for use in a club-head. The face plate 1381 has a front surface 1382 and a rear surface 1344. In this example, the face plate 1381 has a slightly convex shape, a central region 1346 of increased thickness, and a peripheral region 1348 having a relatively reduced thickness extending around the central region 1346. The central region 1346 in the illustrated example is in the form of a projection or cone on the rear surface having its thickest portion at a central point 1350 and gradually tapering away from the point in all directions toward the peripheral region 1348. The central point 1350 represents the approximate center of the "sweet spot" (optimal strike zone) of the striking plate 1380, but not necessarily the geometric center of the face plate 1381. The thicker central region 1348 adds rigidity to the central area of the face plate 1381, which effectively provides a more consistent deflection across the face plate. In certain embodiments, the face plate 1381 is fabricated by first forming an oversized a lay-up of multiple prepreg plies that are subsequently trimmed or otherwise machined.

As shown in FIGS. 40-41, a cover layer 1360 is situated on the front surface 1382 of the face plate 1381. The cover layer 1360 includes a rear surface 1362 that is typically conformal with and bonded to the front surface 1382 of the face plate 1381, and a striking surface 1364 that is typically provided with patterned roughness so as to control or select a shot characteristic so as to provide performance similar to that obtained with conventional club construction. The cover layer 1360 can be formed of a variety of polymers such as, for example, SURLYN ionomers, urethanes, or others. Representative polymers are disclosed in U.S. patent application Ser. No. 11/685,335, filed Mar. 13, 2007 and Ser. No. 11/809,432, filed May 31, 2007 that are incorporated herein by reference. These polymers are discussed with reference to golf balls, but are also suitable for use in striking plates as described herein. In some examples, the cover layer 1360 can be co-cured with the prepreg layers that form the face plate 1381. In other examples, the cover layer 1360 is formed separately and then bonded or glued to the face plate 1381. The cover layer 1362 can be selected to provide wear resistance or ultraviolet protection for the face plate 1381, or to include a patterned striking surface that provides consistent shot characteristics during play in both wet and dry conditions. Typically, surface textures and/or patterning are configured so as to substantially duplicate the shot characteristics achieved with conventional wood clubs or metal wood type clubs with metallic striking plates. To enhance wear resistance, a Shore D hardness of the cover layer 1360 is preferably sufficient to provide a striking face effective hardness with the polymer layer applied of at least about 75, 80, or 85. In typical examples, a thickness of the cover layer 1360 is between about 0.1 mm and 3.0 mm, 0.15 mm and 2.0 mm, or 0.2 mm and 1.2 mm. In some examples, the cover layer 1360 is about 0.4 mm thick.

Club face hardness or striking face hardness is generally measured based on a force required to produce a predetermined penetration of a probe of a standard size and/or shape in a selected time into a striking face of the club, or a penetration depth associated with a predetermined force applied to the probe. Based on such measurements, an effective Shore D hardness can be estimated. For the club faces described herein, the Shore D hardness scale is convenient, and effective Shore D hardnesses of between about 75 and 90 are generally obtained. In general, measured Shore D values decrease for longer probe exposures. Club face hardnesses as described herein are generally based on probe penetrations sufficient to produce an effective hardness estimate (an effective Shore D value) that can be associated with shot characteristics substantially similar to conventional wood or metal wood type golf clubs. The effective hardness generally depends on faceplate and polymer layer thicknesses and hardnesses.

Figure 42:
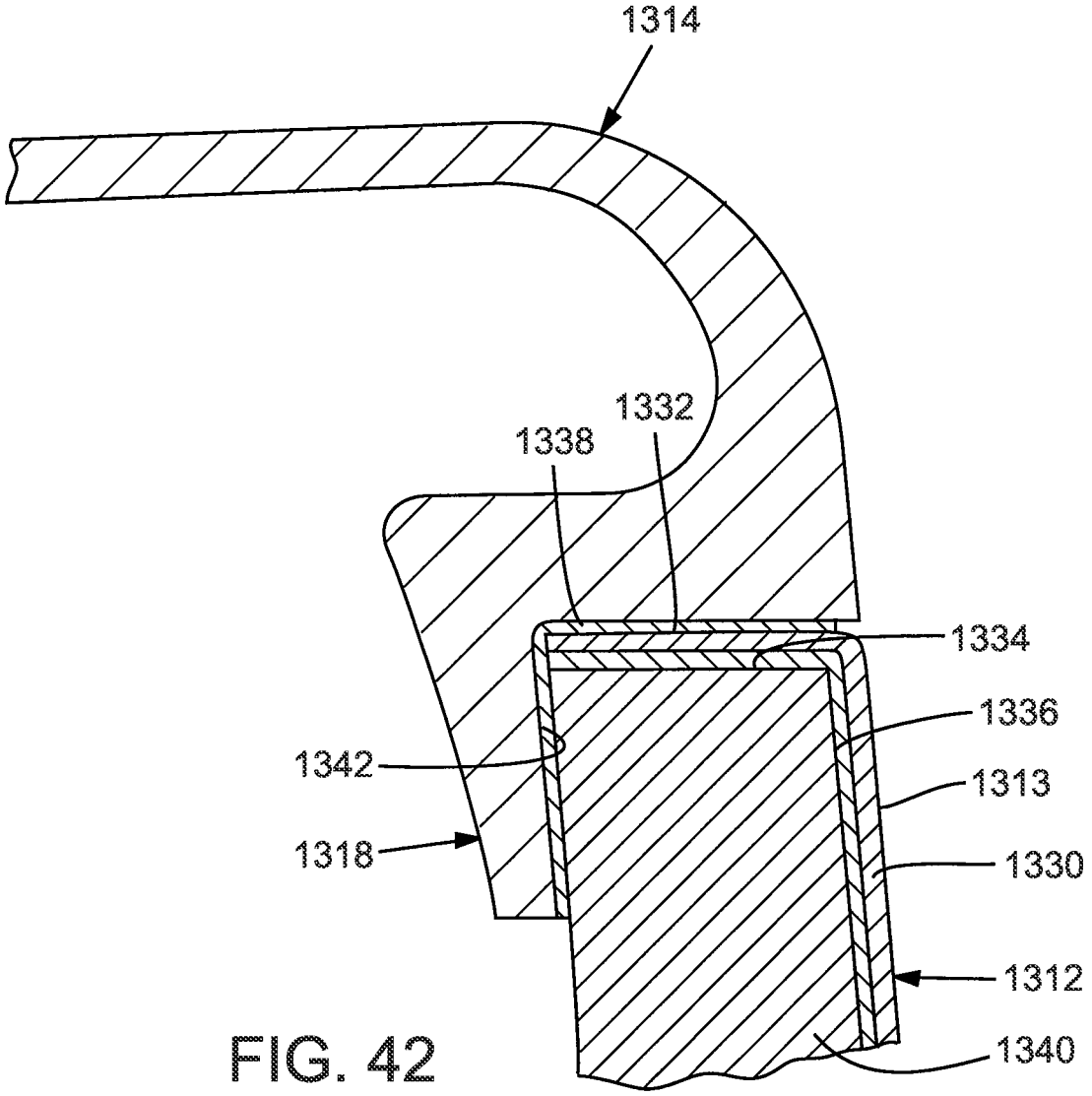
FIG. 42 illustrates attachment of a striking plate comprising a face plate and a cover layer to a club body.

As shown in FIG. 42, a striking plate 1312 comprises a cover layer 1330 formed or placed over a composite face plate 1340 to form a striking surface 1313. In other examples, the cover layer 1330 can include a peripheral rim that covers a peripheral edge 1334 of the composite face plate 1340. The rim 1332 can be continuous or discontinuous, the latter comprising multiple segments (not shown). The cover layer 1330 can be bonded to the composite plate 1340 using a suitable adhesive 1336, such as an epoxy, polyurethane, or film adhesive, or otherwise secured. The adhesive 1336 is applied so as to fill the gap completely between the cover layer 1330 and the composite plate 1340 (this gap is usually in the range of about 0.05-0.2 mm, and desirably is less than approximately 0.05 mm). Typically the cover layer 1330 is formed directly on the face plate, and the adhesive 1336 is omitted. The striking plate 1312 desirably is bonded to a club body 1314 using a suitable adhesive 1338, such as an epoxy adhesive, which completely fills the gap between the rim 1332 and the adjacent peripheral surface 1338 of the face support 1318 and the gap between the rear surface of the composite plate 1340 and the adjacent peripheral surface 1342 of the face support 1318. In the example of FIG. 42, the cover layer 1330 extends at least partially around a faceplate edge, but in other examples, a cover layer is situated only on an external surface of the face plate. As used herein, an external surface of a face plate is a face plate surface directed towards a ball in normal address position. In conventional metallic striking plates that consist only of a metallic face plate, the external surface is the striking surface.

Cover layers such as the cover layer 1330 can be formed and secured to a face plate using various methods. In one example, a striking surface of a cover layer is patterned with a mold. A selected roughness pattern is etched, machined, or otherwise transferred to a mold surface. The mold surface is then used to shape the striking surface of the cover layer for subsequent attachment to a composite face plate or other face plate. Such cover layers can be bonded with an adhesive to the face plate. Alternatively, the mold can be used to form the cover layer directly on the composite part. For example, a layer of a thermoplastic material (or pellets or other portions of such a material) can be situated on an external surface of a face plate, and the mold pressed against the thermoplastic material and the face plate at suitable temperatures and pressures so as to impress the roughness pattern on a thermoplastic layer, thereby forming a cover layer with a patterned surface. In another example, a thermoset material can be deposited on the external surface of the cover plate, and the mold pressed against the thermoset material and the face plate to provide a suitable cover layer thickness. The face plate, the thermoset material, and the mold are then raised to a suitable temperature so as to cure or otherwise fix the shape and thickness of the cover layer. These methods are examples only, and other methods can be used as may be convenient for various cover materials.

In another method, a layer of a so-called "peel ply" fabric is bonded to an exterior surface of a composite face plate (preferably as the face plate is fabricated) or to a striking surface on a polymer cover layer. In some examples, a thermoset material is used for the cover layer, while in other examples thermoplastic materials are used. With either type of material, the peel ply fabric is removably bonded to the cover layer (or to the face plate). The peel ply fabric is removed from the cover layer, leaving a textured or roughened striking surface. A striking surface texture can be selected based upon peel ply fabric texture, fabric orientation, and fiber size so as to achieve surface characteristics comparable to conventional metal woods and irons.

A representative peel ply based process is illustrated in FIGS. 47-49. A portion of a peel ply fabric 1602 is oriented so the woven fibers in the fabric are along an x-axis 1604 and a z-axis 1606 based on an eventual striking plate orientation in a finished club. In other examples, different orientations can be used. Peel ply fabric weave is not generally or necessarily the same along the warp and the weft directions, and in some examples, the warp and weft are aligned preferentially along selected directions. As shown in FIG. 48, a resulting striking plate 1610 includes a face plate 1612 and a cover layer 1614 that has a textured striking surface 1616. A portion of the textured striking surface 1616 is shown in FIG. 49 to illustrate the surface texture based on surface peaks 1618 that are separated by about 0.27 mm and having a height H of about 0.03 mm. In the example of FIGS. 47-49, the cover layer 1610 is about 0.5 mm thick.

Figure 50:
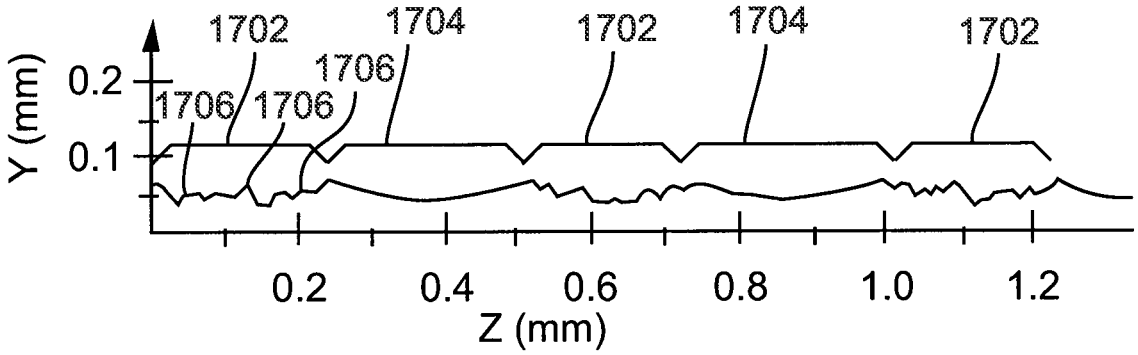
FIGS. 50-51 are surface profiles of a representative textured striking surface of polymer layer produced with a peel ply fabric.
Figure 51:
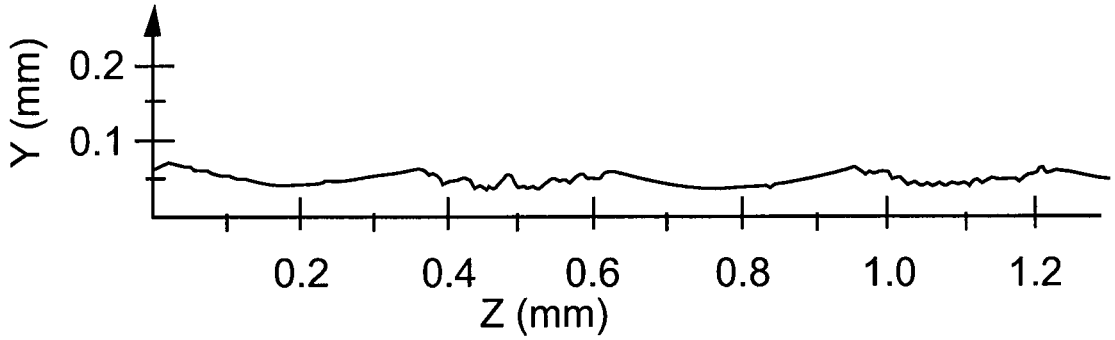
Figure 52:
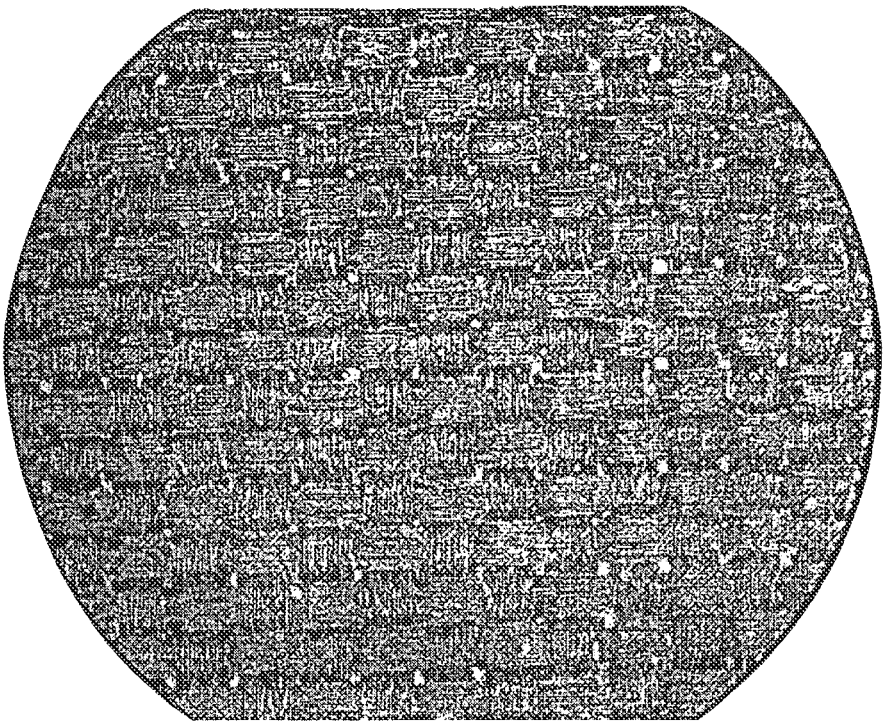
FIG. 52 is a photograph of a portion of a peel ply fabric textured surface.

Representative surface profiles of peel ply based striking surfaces are shown in FIGS. 50-51. FIG. 50 is portion of a toe-to-heel surface profile scan performed with a stylus-based surface profilometer as described further detail above. Relatively rough profile portions 1702 are separated by profile portions 1704 that correspond to more gradual surface curvatures. A plurality of peaks 1706 in the rough profile portions 1702 appear to correspond to a stylus crossing over features defined by individual peel ply fabric fibers. The smoother portions 1704 appear to correspond to stylus scanning along a feature that is defined along a fiber direction. Surface peaks have a periodic separation of about 0.5 mm and a height of about 20-30 μm. FIG. 51 is a portion of a similar scan to that of FIG. 50 but along a top-to-bottom direction. Relatively smooth and rough areas alternate, and peak spacing is about 0.6 mm, slightly larger than that in the toe-to-heel direction, likely due to differing fiber spacings in peel ply fabric warp and weft. FIG. 52 is a photograph of a portion of a striking surface formed with a peel ply fabric.

Figure 53:
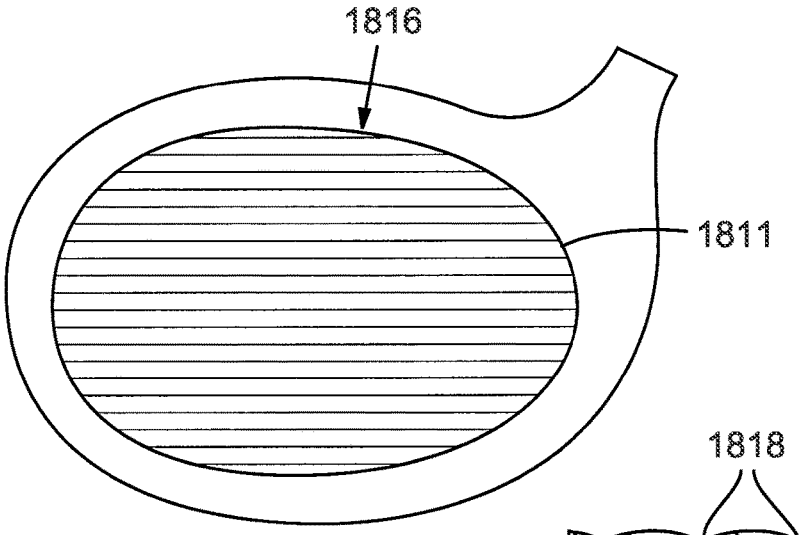
FIGS. 53-55 illustrate another representative striking plate that includes a cover layer having a roughened striking surface.
Figure 54:
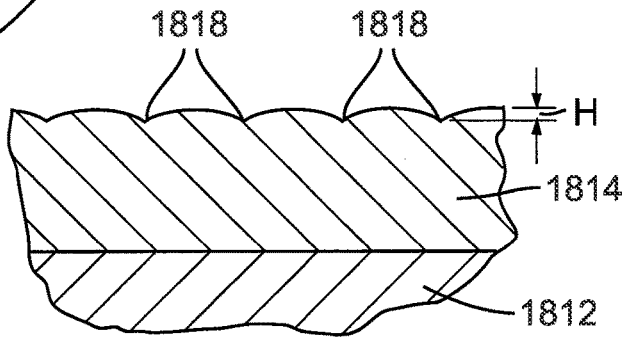
Figure 55:
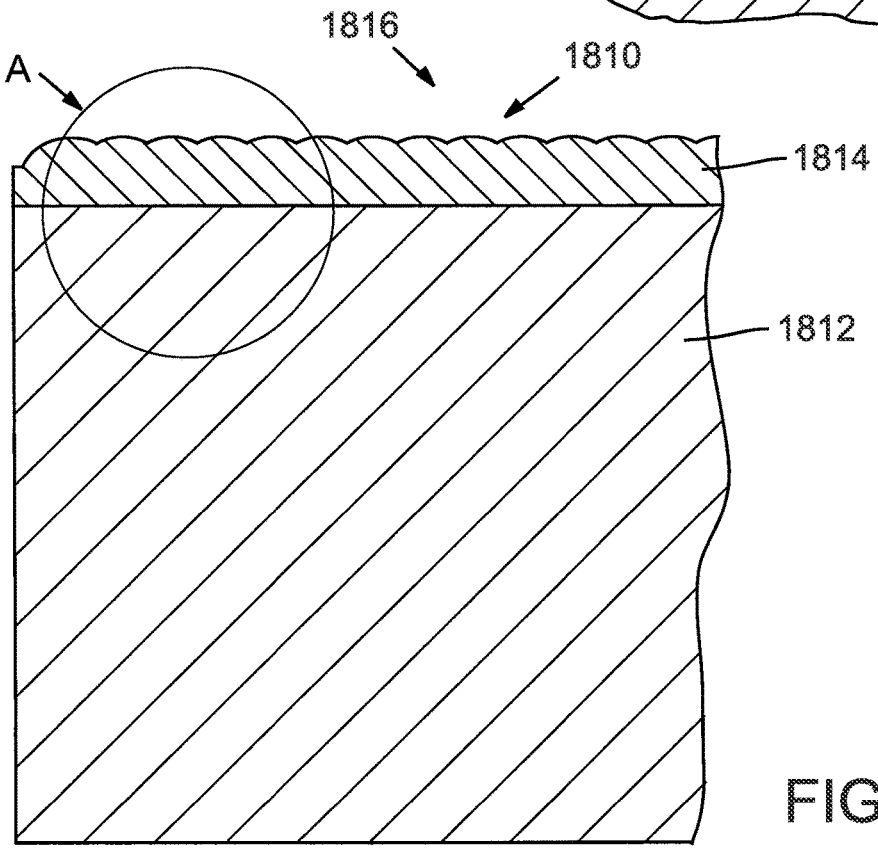
Figure 56:
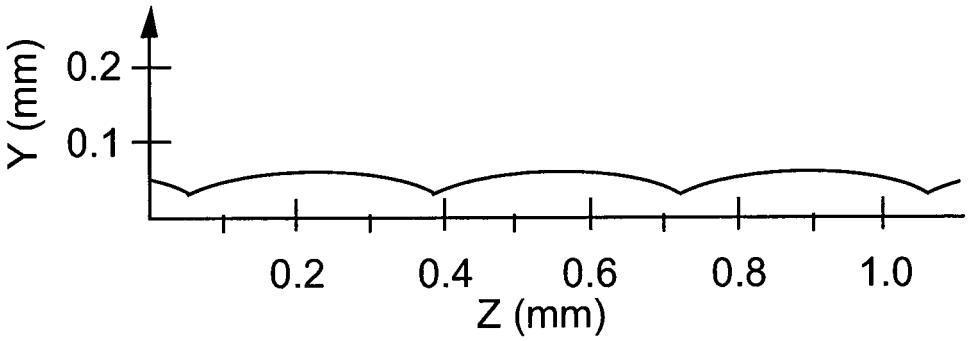
FIG. 56 is a surface profile of the roughened surface of FIGS. 53-55.

An example striking plate 1810 based on a machined or other mold is shown in FIGS. 53-55. In this example, a surface texture 1811 provided to a striking surface 1816 is aligned with respect to a club and a club head substantially along an x-axis as shown in FIG. 53. FIGS. 54-55 illustrate the texture 1811 of the striking surface 1816 that is formed as a surface of a cover layer 1814 that is situated on a face plate 1812. As shown in FIG. the cover layer 1814 is about 0.5 mm thick, and the texture includes a plurality of valleys 1818 separated by about 0.34 mm and about 40 μm deep. FIG. 56 includes a portion of a stylus-based top-to-bottom surface scan of a representative polymer surface showing bumps having a center to center spacing of about 0.34 mm.

The following table summarize surface roughness parameters associated with the scans of FIGS. 50-51 and 56. In typical examples, measured surface roughness is greater than about 0.1 μm, 1 μm, 2 μm, or 2.5 μm and less than about 20 μm, 10 μm, 5 μm, 4.5 μm, or 4 μm.

| Parameter | Toe-to-Heel Scan (Tooled Mold) | Toe-to-Heel Scan (Peel Ply Shaped) | Top-to-Bottom Scan (Peel Ply Shaped) |
|---|---|---|---|
| $R_a$ | 6.90 μm | 8.31 μm | 7.07 μm |
| $R_z$ | 29.4 μm | 49.0 μm | 48.7 μm |
| $R_p$ | 9.9 μm | 26.9 μm | 27.4 μm |
| RPc | 29.7/cm | 44.4/cm | 37.6/cm |
| $K_u$ | 2.41 | | |

Figure 43:
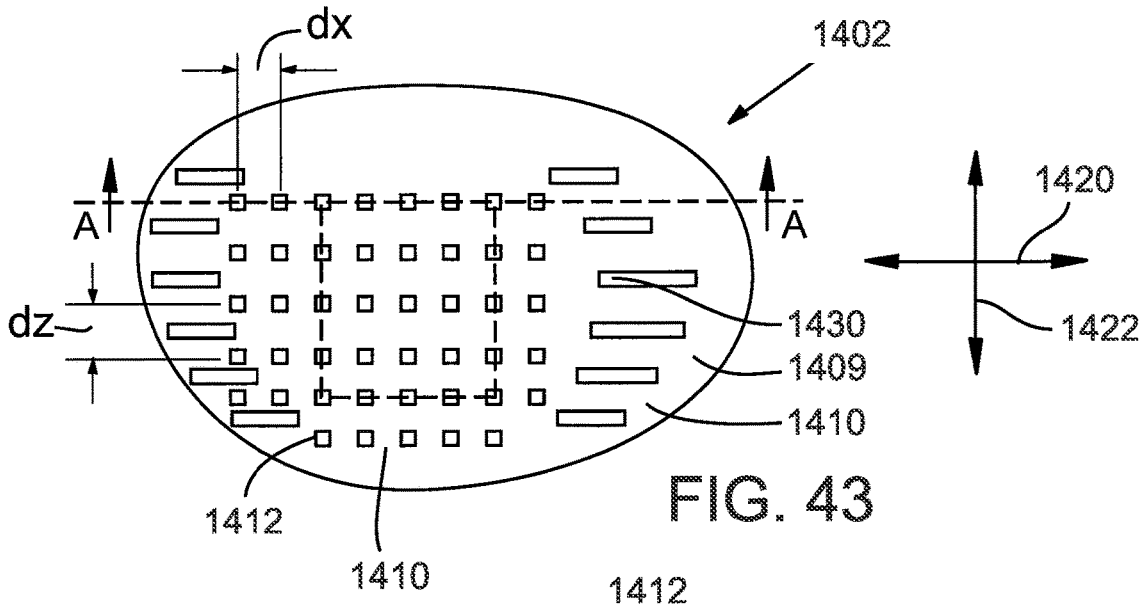
FIGS. 43-44 illustrate a representative striking plate that includes a cover layer having a roughened striking surface.
Figure 44:
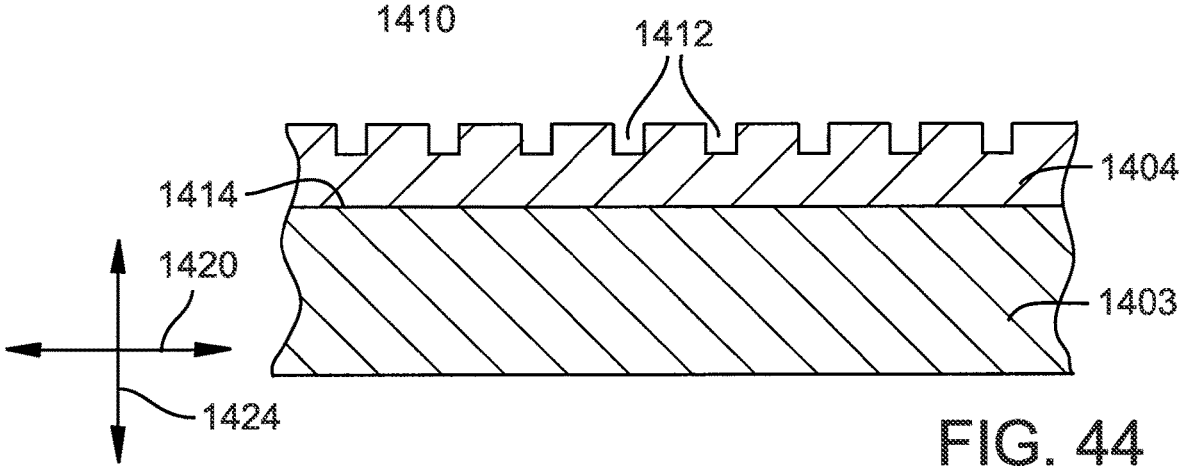

A striking surface of a cover layer can be provided with a variety of other roughness patterns some examples of which are illustrated in FIGS. 43-46. Typically these patterns extend over substantially the entire striking surface, but in some illustrated examples only a portion of the striking surface is shown for convenient illustration. Referring to FIGS. 43-44, a striking plate 1402 includes a composite face plate 1403 and a cover layer 1404. A striking surface 1409 of the cover layer includes a patterned area 1410 that includes a plurality of pattern features 1412 that are arranged in a two dimensional array. As shown in FIGS. 43-44, the pattern features 1412 are rectangular or square depressions formed in the cover layer 1404 and that extend along a +y-direction (i.e., inwardly towards an external surface 1414 of the face plate 1403). A horizontal spacing (along an x-axis 1420) of the pattern features is dx and a vertical spacing (along a z-axis 1422) is dz. These spacings can be the same or different, and the features 1412 can be inwardly or outwardly directed and can be columns or depressions having square, circular, elliptical, polygonal, oval, or other cross-sections in an xz-plane. In addition, for cross-sectional shapes that are asymmetric, the pattern features can be arbitrarily aligned with respect to the x-axis 1420 and the z-axis 1422. The pattern features 1412 can be located in a regular array, but the orientation of each of the pattern features can be arbitrary, or the pattern features can be periodically arranged along the x-axis 1420, the z-axis 1422, or another axis in the xz-plane. As shown in FIG. 43, a plurality of scorelines 1430 are provided and are typically colored so as to provide a high contrast. A maximum depth dy of the pattern features 1512 along the y-axis is between about 10 μm and 100 μm, between about 5 μm and 50 μm, or about 2 μm and 25 μm. The horizontal and vertical spacings are typically between about 0.025 mm and 0.500 mm.

While the pattern features 1412 may have substantially constant cross-sectional dimensions in one or more planes perpendicular the xz-plane (i.e. vertical cross-sections), these vertical cross-sections can vary along a y-axis 1424 or as a function of an angle of a cross-sectional plane with respect to the x-axis, the y-axis, or the z-axis. For example, columnar protrusions can have bases that taper outwardly, inwardly, or a combination thereof along the y-axis 1424, and can be tilted with respect to the y-axis 1424.

Figure 45:
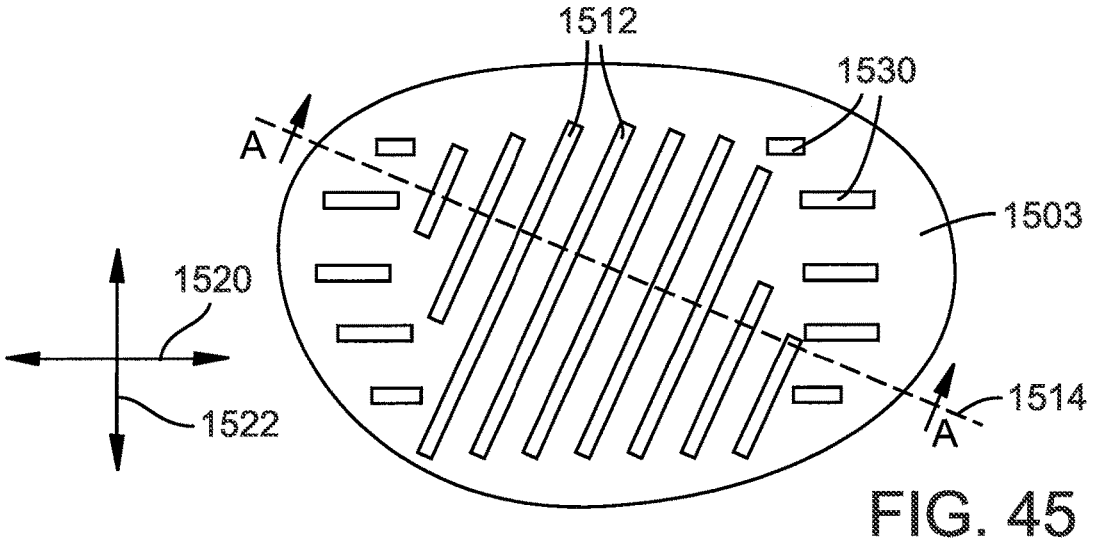
FIGS. 45-46 illustrate a representative striking plate that includes a cover layer having a roughened striking surface.
Figure 46:
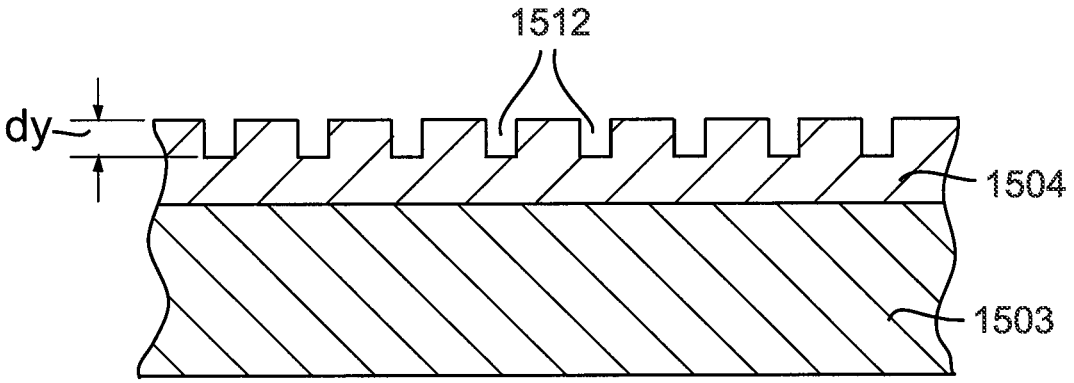

In an example shown in FIGS. 45-46, a cover layer 1504 includes a plurality of pattern features 1512 that are periodically situated along an axis 1514 that is tilted with respect to an x-axis 1520 and a z-axis 1522. The pattern features 1512 are periodic in one dimension, but in other examples, pattern features periodic along one more axes that are tilted (or aligned with) x- and z-axes can be provided. A plurality of scorelines 1530 are provided (generally in a face plate) and are colored so as to provide a high contrast. As shown in FIG. 46, the cover layer 1504 is secured to a face plate 1503 and the pattern features 1512 have a depth dy.

In other examples, pattern features can be periodic, aperiodic, or partially periodic, or randomly situated. Spatial frequencies associated with pattern features can vary, and pattern feature size and orientation can vary as well. In some examples, a roughened surface is defined as series of features that are randomly situated and sized.

Similar striking plates can be provided for iron-type golf clubs. While striking plates for wood-type golf clubs generally have top-to-bottom and toe-to-heel curvatures (commonly referred to as bulge and roll), striking plates for irons are typically flat. Composite-based striking plates for iron-type clubs typically include a polymer cover layer selected to protect the underlying composite face plate. In some examples, similar striking surface textures to those described above can be provided. In addition, one or more conventional grooves are generally provided on the striking surface. Such striking plates can be secured to iron-type golf club bodies with various adhesives or otherwise secured.

Representative Polymer Materials

Representative polymer materials suitable for face plate covers or caps are described herein.

Definitions

The term "bimodal polymer" as used herein refers to a polymer comprising two main fractions and more specifically to the form of the polymer's molecular weight distribution curve, i.e., the appearance of the graph of the polymer weight fraction as a function of its molecular weight. When the molecular weight distribution curves from these fractions are superimposed onto the molecular weight distribution curve for the total resulting polymer product, that curve will show two maxima or at least be distinctly broadened in comparison with the curves for the individual fractions. Such a polymer product is called bimodal. The chemical compositions of the two fractions may be different.

The term "chain extender" as used herein is a compound added to either a polyurethane or polyurea prepolymer, (or the prepolymer starting materials), which undergoes additional reaction but at a level sufficiently low to maintain the thermoplastic properties of the final composition The term "conjugated" as used herein refers to an organic compound containing two or more sites of unsaturation (e.g., carbon-carbon double bonds, carbon-carbon triple bonds, and sites of unsaturation comprising atoms other than carbon, such as nitrogen) separated by a single bond.

The term "curing agent" or "curing system" as used interchangeably herein is a compound added to either polyurethane or polyurea prepolymer, (or the prepolymer starting materials), which imparts additional crosslinking to the final composition to render it a thermoset.

The term "(meth)acrylate" is intended to mean an ester of methacrylic acid and/or acrylic acid.

The term "(meth)acrylic acid copolymers" is intended to mean copolymers of methacrylic acid and/or acrylic acid.

The term "polyurea" as used herein refers to materials prepared by reaction of a diisocyanate with a polyamine.

The term "polyurethane" as used herein refers to materials prepared by reaction of a diisocyanate with a polyol.

The term "prepolymer" as used herein refers to any material that can be further processed to form a final polymer material of a manufactured golf ball, such as, by way of example and not limitation, a polymerized or partially polymerized material that can undergo additional processing, such as crosslinking.

The term "thermoplastic" as used herein is defined as a material that is capable of softening or melting when heated and of hardening again when cooled. Thermoplastic polymer chains often are not cross-linked or are lightly cross-linked using a chain extender, but the term "thermoplastic" as used herein may refer to materials that initially act as thermoplastics, such as during an initial extrusion process or injection molding process, but which also may be cross-linked, such as during a compression molding step to form a final structure.

The term "thermoplastic polyurea" as used herein refers to a material prepared by reaction of a prepared by reaction of a diisocyanate with a polyamine, with optionally addition of a chain extender.

The "thermoplastic polyurethane" as used herein refers to a material prepared by reaction of a diisocyanate with a polyol, with optionally addition of a chain extender.

The term "thermoset" as used herein is defined as a material that crosslinks or cures via interaction with as crosslinking or curing agent. The crosslinking may be brought about by energy in the form of heat (generally above 200 degrees Celsius), through a chemical reaction (by reaction with a curing agent), or by irradiation. The resulting composition remains rigid when set, and does not soften with heating. Thermosets have this property because the long-chain polymer molecules cross-link with each other to give a rigid structure. A thermoset material cannot be melted and re-molded after it is cured thus thermosets do not lend themselves to recycling unlike thermoplastics, which can be melted and re-molded.

The term "thermoset polyurethane" as used herein refers to a material prepared by reaction of a diisocyanate with a polyol, and a curing agent.

The term "thermoset polyurea" as used herein refers to a material prepared by reaction of a diisocyanate with a polyamine, and a curing agent.

The term "urethane prepolymer" as used herein is the reaction product of diisocyante and a polyol.

The term "urea prepolymer" as used herein is the reaction product of a diisocyanate and a polyamine.

The term "unimodal polymer" refers to a polymer comprising one main fraction and more specifically to the form of the polymer's molecular weight distribution curve, i.e., the molecular weight distribution curve for the total polymer product shows only a single maximum.

Materials

Polymeric materials generally considered useful for making the golf club face cap according to the present invention include both synthetic or natural polymers or blend thereof including without limitation, synthetic and natural rubbers, thermoset polymers such as other thermoset polyurethanes or thermoset polyureas, as well as thermoplastic polymers including thermoplastic elastomers such as metallocene catalyzed polymer, unimodal ethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, unimodal ionomers, bimodal ionomers, modified unimodal ionomers, modified bimodal ionomers, thermoplastic polyurethanes, thermoplastic polyureas, polyamides, copolyamides, polyesters, copolyesters, polycarbonates, polyolefins, halogenated (e.g. chlorinated) polyolefins, halogenated polyalkylene compounds, such as halogenated polyethylene [e.g. chlorinated polyethylene (CPE)], polyalkenamer, polyphenylene oxides, polyphenylene sulfides, diallyl phthalate polymers, polyimides, polyvinyl chlorides, polyamide-ionomers, polyurethane-ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic copolymers, functionalized styrenic copolymers, functionalized styrenic terpolymers, styrenic terpolymers, cellulosic polymers, liquid crystal polymers (LCP), ethylene-propylene-diene terpolymers (EPDM), ethylene-vinyl acetate copolymers (EVA), ethylene-propylene copolymers, ethylene vinyl acetates, polyureas, and polysiloxanes and any and all combinations thereof.

One preferred family of polymers for making the golf club face cap of the present invention are the thermoplastic or thermoset polyurethanes and polyureas made by combination of a polyisiocyanate and a polyol or polyamine respectively. Any isocyanate available to one of ordinary skill in the art is suitable for use in the present invention including, but not limited to, aliphatic, cycloaliphatic, aromatic aliphatic, aromatic, any derivatives thereof, and combinations of these compounds having two or more isocyanate (NCO) groups per molecule.

Any polyol available to one of ordinary skill in the polyurethane art is suitable for use according to the invention. Polyols suitable for use include, but are not limited to, polyester polyols, polyether polyols, polycarbonate polyols and polydiene polyols such as polybutadiene polyols.

Any polyamine available to one of ordinary skill in the polyurea art is suitable for use according to the invention. Polyamines suitable for use include, but are not limited to, amine-terminated hydrocarbons, amine-terminated polyethers, amine-terminated polyesters, amine-terminated polycaprolactones, amine-terminated polycarbonates, amine-terminated polyamides, and mixtures thereof.

The previously described diisocyante and polyol or polyamine components may be previously combined to form a prepolymer prior to reaction with the chain extender or curing agent. Any such prepolymer combination is suitable for use in the present invention. Commercially available prepolymers include LFH580, LFH120, LFH710, LFH1570, LF930A, LF950A, LF601D, LF751D, LFG963A, LFG640D.

One preferred prepolymer is a toluene diisocyanate prepolymer with polypropylene glycol. Such polypropylene glycol terminated toluene diisocyanate prepolymers are available from Uniroyal Chemical Company of Middlebury, Conn., under the trade name ADIPRENE® LFG963A and LFG640D. Most preferred prepolymers are the polytetramethylene ether glycol terminated toluene diisocyanate prepolymers including those available from Uniroyal Chemical Company of Middlebury, Conn., under the trade name ADIPRENE® LF930A, LF950A, LF601D, and LF751D.

Polyol chain extenders or curing agents may be primary, secondary, or tertiary polyols. Diamines and other suitable polyamines may be added to the compositions of the present invention to function as chain extenders or curing agents. These include primary, secondary and tertiary amines having two or more amines as functional groups.

Depending on their chemical structure, curing agents may be slow- or fast-reacting polyamines or polyols. As described in U.S. Pat. Nos. 6,793,864, 6,719,646 and copending U.S. Patent Publication No. 2004/0201133 A1, (the contents of all of which are hereby incorporated herein by reference).

Suitable curatives for use in the present invention are selected from the slow-reacting polyamine group include, but are not limited to, 3,5-dimethylthio-2,4-toluenediamine; 3,5-dimethylthio-2,6-toluenediamine; N,N'-dialkyldiamino diphenyl methane; trimethylene-glycol-di-p-aminobenzoate; polytetramethyleneoxide-di-p-aminobenzoate, and mixtures thereof. Of these, 3,5-dimethylthio-2,4-toluenediamine and 3,5-dimethylthio-2,6-toluenediamine are isomers and are sold under the trade name ETHACURE® 300 by Ethyl Corporation. Trimethylene glycol-di-p-aminobenzoate is sold under the trade name POLACURE 740M and polytetramethyleneoxide-di-p-aminobenzoates are sold under the trade name POLAMINES by Polaroid Corporation. N,N'-dialkyldiamino diphenyl methane is sold under the trade name UNILINK® by UOP. Suitable fast-reacting curing agent can be used include diethyl-2,4-toluenediamine, 4,4"-methylenebis-(3-chloro, 2,6-diethyl)-aniline (available from Air Products and Chemicals Inc., of Allentown, Pa., under the trade name LONZACURE®), 3,3'-dichlorobenzidene; 3,3'-dichloro-4,4'-diaminodiphenyl methane (MOCA); N,N,N',N'-tetrakis(2-hydroxypropyl)ethylenediamine and Curalon L, a trade name for a mixture of aromatic diamines sold by Uniroyal, Inc. or any and all combinations thereof. A preferred fast-reacting curing agent is diethyl-2,4-toluene diamine, which has two commercial grades names, Ethacure® 100 and Ethacure® 100LC commercial grade has lower color and less by-product. Blends of fast and slow curing agents are especially preferred.

In another preferred embodiment the polyurethane or polyurea is prepared by combining a diisocyanate with either a polyamine or polyol or a mixture thereof and one or more dicyandiamides. In a preferred embodiment the dicyandiamide is combined with a urethane or urea prepolymer to form a reduced-yellowing polymer composition as described in U.S. Patent Application No. 60/852,582 filed on Oct. 17, 2006, the entire contents of which are herein incorporated by reference in their entirety.

Another preferred family of polymers for making the golf club face cap of the present invention are thermoplastic ionomer resins. One family of such resins was developed in the mid-1960's, by E.I. DuPont de Nemours and Co., and sold under the trademark SURLYN®. Preparation of such ionomers is well known, for example see U.S. Pat. No. 3,264,272. Generally speaking, most commercial ionomers are unimodal and consist of a polymer of a mono-olefin, e.g., an alkene, with an unsaturated mono- or dicarboxylic acids having 3 to 12 carbon atoms. An additional monomer in the form of a mono- or dicarboxylic acid ester may also be incorporated in the formulation as a so-called "softening comonomer". The incorporated carboxylic acid groups are then neutralized by a basic metal ion salt, to form the ionomer. The metal cations of the basic metal ion salt used for neutralization include $Li^+$, $Na^+$, $K^+$, $Zn^{2+}$, $Ca^{2+}$, $Co^{2+}$, $Ni^{2+}$, $Cu^{2+}$, $Pb^{2+}$, and $Mg^{2+}$, with the $Li^+$, $Na^+$, $Ca^{2+}$, $Zn^{2+}$, and $Mg^{2+}$ being preferred. The basic metal ion salts include those derived by neutralization of for example formic acid, acetic acid, nitric acid, and carbonic acid. The salts may also include hydrogen carbonate salts, metal oxides, metal hydroxides, and metal alkoxides.

Today, there are a wide variety of commercially available ionomer resins based both on copolymers of ethylene and (meth)acrylic acid or terpolymers of ethylene and (meth) acrylic acid and (meth)acrylate, all of which many of which are be used as a golf club component such as a cover layer that provides a striking surface. The properties of these ionomer resins can vary widely due to variations in acid content, softening comonomer content, the degree of neutralization, and the type of metal ion used in the neutralization. The full range commercially available typically includes ionomers of polymers of general formula, E/X/Y polymer, wherein E is ethylene, X is a $C_3$ to $C_8$ $\alpha,\beta$ ethylenically unsaturated carboxylic acid, such as acrylic or methacrylic acid, and is present in an amount from about 2 to about 30 weight % of the E/X/Y copolymer, and Y is a softening comonomer selected from the group consisting of alkyl acrylate and alkyl methacrylate, such as methyl acrylate or methyl methacrylate, and wherein the alkyl groups have from 1-8 carbon atoms, Y is in the range of 0 to about 50 weight % of the E/X/Y copolymer, and wherein the acid groups present in said ionomeric polymer are partially neutralized with a metal selected from the group consisting of lithium, sodium, potassium, magnesium, calcium, barium, lead, tin, zinc or aluminum, and combinations thereof.

The ionomer may also be a so-called bimodal ionomer as described in U.S. Pat. No. 6,562,906 (the entire contents of which are herein incorporated by reference). These ionomers are bimodal as they are prepared from blends comprising polymers of different molecular weights In addition to the unimodal and bimodal ionomers, also included are the so-called "modified ionomers" examples of which are described in U.S. Pat. Nos. 6,100,321, 6,329,458 and 6,616,552 and U.S. Patent Publication U.S. 2003/0158312 A1, the entire contents of all of which are herein incorporated by reference. An example of such a modified ionomer polymer is DuPont® HPF-1000 available from E. I. DuPont de Nemours and Co. Inc.

Also useful for making the golf club face cap of the present invention is a blend of an ionomer and a block copolymer. A preferred block copolymer is SEPTON HG-252. Such blends are described in more detail in commonly-assigned U.S. Pat. No 6,861,474 and U.S. Patent Publication No. 2003/0224871 both of which are incorporated herein by reference in their entireties.

In a further embodiment, the golf club face cap of the present invention can comprise a composition prepared by blending together at least three materials, identified as Components A, B, and C, and melt-processing these components to form in-situ, a polymer blend composition incorporating a pseudo-crosslinked polymer network. Such blends are described in more detail in commonly-assigned U.S. Pat. No. 6,930,150, to Kim et al., the content of which is incorporated by reference herein in its entirety.

Component A is a monomer, oligomer, prepolymer or polymer that incorporates at least five percent by weight of at least one type of an acidic functional group. Examples of such polymers suitable for use as include, but are not limited to, ethylene/(meth)acrylic acid copolymers and ethylene/(meth)acrylic acid/alkyl (meth)acrylate terpolymers, or ethylene and/or propylene maleic anhydride copolymers and terpolymers.

As discussed above, Component B can be any monomer, oligomer, or polymer, preferably having a lower weight percentage of anionic functional groups than that present in Component A in the weight ranges discussed above, and most preferably free of such functional groups. Preferred materials for use as Component B include polyester elastomers marketed under the name PEBAX and LOTADER marketed by ATOFINA Chemicals of Philadelphia, Pennsylvania; HYTREL, FUSABOND, and NUCREL marketed by E.I. DuPont de Nemours & Co. of Wilmington, Delaware; SKYPEL and SKYTHANE by S.K. Chemicals of Seoul, South Korea; SEPTON and HYBRAR marketed by Kuraray Company of Kurashiki, Japan; ESTHANE by Noveon; and KRATON marketed by Kraton Polymers. A most preferred material for use as Component B is SEPTON HG-252. Component C is a base capable of neutralizing the acidic functional group of Component A and is a base having a metal cation. These metals are from groups IA, IB, IIA, IIB, IIIA, IIIB, IVA, IVB, VA, VB, VIA, VIB, VIIB and VIIIB of the periodic table. Examples of these metals include lithium, sodium, magnesium, aluminum, potassium, calcium, manganese, tungsten, titanium, iron, cobalt, nickel, hafnium, copper, zinc, barium, zirconium, and tin. Suitable metal compounds for use as a source of Component C are, for example, metal salts, preferably metal hydroxides, metal oxides, metal carbonates, or metal acetates. The composition preferably is prepared by mixing the above materials into each other thoroughly, either by using a dispersive mixing mechanism, a distributive mixing mechanism, or a combination of these.

In a further embodiment, the golf club face cap of the present invention can comprise a polyamide. Specific examples of suitable polyamides include polyamide 6; polyamide 11; polyamide 12; polyamide 4,6; polyamide 6,6; polyamide 6,9; polyamide 6,10; polyamide 6,12; polyamide MXD6; PA12, CX; PA12, IT; PPA; PA6, IT; and PA6/PPE.

The polyamide may be any homopolyamide or copolyamide. One example of a group of suitable polyamides is thermoplastic polyamide elastomers. Thermoplastic polyamide elastomers typically are copolymers of a polyamide and polyester or polyether. For example, the thermoplastic polyamide elastomer can contain a polyamide (Nylon 6, Nylon 66, Nylon 11, Nylon 12 and the like) as a hard segment and a polyether or polyester as a soft segment. In one specific example, the thermoplastic polyamides are amorphous copolyamides based on polyamide (PA 12). Suitable amide block polyethers include those as disclosed in U.S. Pat. Nos. 4,331,786; 4,115,475; 4,195,015; 4,839,441; 4,864,014; 4,230,848 and 4,332,920.

One type of polyetherester elastomer is the family of Pebax, which are available from Elf-Atochem Company. Preferably, the choice can be made from among Pebax 2533, 3533, 4033, 1205, 7033 and 7233. Blends or combinations of Pebax 2533, 3533, 4033, 1205, 7033 and 7233 can also be prepared, as well. Some examples of suitable polyamides for use include those commercially available under the trade names PEBAX, CRISTAMID and RILSAN marketed by Atofina Chemicals of Philadelphia, Pennsylvania, GRIVORY and GRILAMID marketed by EMS Chemie of Sumter, South Carolina, TROGAMID and VESTAMID available from Degussa, and ZYTEL marketed by E.I. DuPont de Nemours & Co., of Wilmington, Delaware.

The polymeric compositions used to prepare the golf club face cap of the present invention also can incorporate one or more fillers. Such fillers are typically in a finely divided form, for example, in a size generally less than about 20 mesh, preferably less than about 100 mesh U.S. standard size, except for fibers and flock, which are generally elongated. Filler particle size will depend upon desired effect, cost, ease of addition, and dusting considerations. The appropriate amounts of filler required will vary depending on the application but typically can be readily determined without undue experimentation.

The filler preferably is selected from the group consisting of precipitated hydrated silica, limestone, clay, talc, asbestos, barytes, glass fibers, aramid fibers, mica, calcium metasilicate, barium sulfate, zinc sulfide, lithopone, silicates, silicon carbide, diatomaceous earth, carbonates such as calcium or magnesium or barium carbonate, sulfates such as calcium or magnesium or barium sulfate, metals, including tungsten, steel, copper, cobalt or iron, metal alloys, tungsten carbide, metal oxides, metal stearates, and other particulate carbonaceous materials, and any and all combinations thereof. Preferred examples of fillers include metal oxides, such as zinc oxide and magnesium oxide. In another preferred embodiment the filler comprises a continuous or non-continuous fiber. In another preferred embodiment the filler comprises one or more so called nanofillers, as described in U.S. Pat. No. 6,794,447 and copending U.S. patent application Ser. No. 10/670,090 filed on Sep. 24, 2003 and copending U.S. patent application Ser. No. 10/926,509 filed on Aug. 25, 2004, the entire contents of each of which are incorporated herein by reference.

Another particularly well-suited additive for use in the compositions of the present invention includes compounds having the general formula:

$$(R_2N)_m—R'—(X(O)_nOR_y)_m,$$

wherein R is hydrogen, or a $C_1$-$C_{20}$ aliphatic, cycloaliphatic or aromatic systems; R' is a bridging group comprising one or more $C_1$-$C_{20}$ straight chain or branched aliphatic or alicyclic groups, or substituted straight chain or branched aliphatic or alicyclic groups, or aromatic group, or an oligomer of up to 12 repeating units including, but not limited to, polypeptides derived from an amino acid sequence of up to 12 amino acids; and X is C or S or P with the proviso that when X=C, n=1 and y=1 and when X=S, n=2 and y=1, and when X=P, n=2 and y=2. Also, m=1–3. These materials are more fully described in copending U.S. patent application Ser. No. 11/182,170, filed on Jul. 14, 2005, the entire contents of which are incorporated herein by reference. Most preferably the material is selected from the group consisting of 4,4'-methylene-bis-(cyclohexylamine)-carbamate (commercially available from R.T. Vanderbilt Co., Norwalk CT under the tradename Diak® 4), 11-aminoundecanoicacid, 12-aminododecanoic acid, epsilon-caprolactam; omega-caprolactam, and any and all combinations thereof.

If desired, the various polymer compositions used to prepare the golf club face cap of the present invention can additionally contain other conventional additives such as, antioxidants, or any other additives generally employed in plastics formulation. Agents provided to achieve specific functions, such as additives and stabilizers, can be present. Exemplary suitable ingredients include plasticizers, pigments colorants, antioxidants, colorants, dispersants, U.V. absorbers, optical brighteners, mold releasing agents, processing aids, fillers, and any and all combinations thereof. UV stabilizers, or photo stabilizers such as substituted hydroxphenyl benzotriazoles may be utilized in the present invention to enhance the UV stability of the final compositions. An example of a commercially available UV stabilizer is the stabilizer sold by Ciba Geigy Corporation under the tradename TINUVIN.

Whereas the invention has been described in connection with representative embodiments, it will be understood that the invention is not limited to those embodiments. On the contrary, the invention is intended to encompass all modifications, alternatives, and equivalents as may fall within the spirit and scope of the invention, as defined by the appended claims.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

The invention claimed is:

1. A golf club head having a more consistent trajectory and distance on impact comprising:

a heel portion;

a toe portion;

a crown;

a hosel defining a hosel axis;

a sole;

a face having a striking surface for striking a golf ball, the face having an ideal impact location at a center of the striking surface defining the origin of a coordinate system including a horizontal axis that extends substantially parallel to the face and generally parallel to the ground when the head is in an address position, with the negative direction of the horizontal axis pointing toward the heel portion and the positive direction of the horizontal axis pointing toward the toe portion, the face further having a first off-center location on the face located in a toe direction away from the center of the striking surface at 40 mm along the horizontal axis and a second off-center location on the face located in a heel direction away from the center of the striking surface at −40 mm along the horizontal axis, wherein a characteristic time at 10 mm increment locations on the face along the horizontal axis between the center of the striking surface and the second off-center location deviates from the characteristic time at the center of the striking surface by no more than 20%, wherein the face has a face size of about 4,000 $mm^2$ to about 7,000 $mm^2$, wherein face size is measured by:

(i) determining an extended front wall surface using an average bulge radius of the striking surface and an average roll radius of the striking surface, (ii) offsetting the extended front wall surface by 0.5 mm toward a center of the club head along an axis that is parallel to a face surface normal vector at the center of the striking surface, wherein the offset extended front wall surface has a boundary defined by a curved line $S_f$ at an intersection between the offset extended front wall surface and a surrounding portion of the club head external surface and a straight line that intersects $S_f$ a first location $P_a$ and at a second location $P_b$, wherein $P_a$ is the intersection of $S_f$ with a 30-mm diameter cylindrical surface that is co-axial with the hosel and the straight line is normal to the hosel axis, (iii) projecting the offset extended front wall surface onto a plane that is tangent to the center of the striking surface; and a non-metal face plate that contacts the ball at impact, wherein the face plate defines the striking surface and comprises a peripheral edge surrounding the striking surface, wherein the face plate comprises a lay-up of multiple, composite prepreg plies, wherein at least a portion of the plies comprises a plurality of elongated prepreg strips that are narrower than the width of the lay-up and extend continuously across the striking surface, the elongated strips being arranged within the lay-up so as to define a cross-sectional profile having a varying thickness.

2. The golf club head of claim 1, wherein the face has a face size of about 4,500 $mm^2$ to about 6,978 $mm^2$.

3. The golf club head of claim 1, wherein the face plate has a maximum height $H_{ss}$ of about 50 mm to about 88 mm, and a maximum width $W_{ss}$ of about 100 mm to about 127 mm.

4. The golf club head of claim 1, further comprising a weight port configured to receive a weight, wherein the weight port has a longitudinal axis that intersects the face.

5. The golf club head of claim 4, wherein when a weight is not received in the weight port, the weight port defines a rearward-most point of the club head when the club head is at the address position.

6. The golf club head of claim 1, wherein the golf club head comprises a body, which is made of a metallic material, wherein the non-metal face plate is attached directly to the body via an adhesive.

7. The golf club head of claim 6, wherein the cross-sectional profile of the face plate comprises a thickness at the center of the striking surface that is greater than a thickness at a peripheral edge of the striking surface, thereby adjusting the characteristic time at various locations along the x-axis.

8. The golf club head of claim 7, further comprising a weight port configured to receive a weight, wherein the weight port has a longitudinal axis that intersects the face.

9. The golf club head of claim 7, wherein the non-metal face plate includes a polymer cover layer having a cover layer thickness of 0.1-3.0 mm.

10. The golf club head of claim 9, wherein the polymer cover layer includes a plurality of surface features to provide a mean roughness of 2.5-5 μm, and the cover layer thickness is 0.2-1.2 mm.

11. The golf club head of claim 10, wherein the face plate has an insert height dimension of between 50 mm and 127 mm, and the plurality of composite prepreg plies includes a plurality of prepreg panels and wherein the elongated prepreg strips are arranged in at least one cluster of elongated strips.

12. The golf club head of claim 11, wherein at least one cluster is located in between adjacent prepreg panels.

13. The golf club head of claim 11, wherein the plurality of prepreg strips are arranged in a criss-cross pattern defining an overlapping region where the strips overlap each other, wherein the cross-sectional profile of the lay-up has a first thickness at a location spaced from the overlapping region and a second thickness at the overlapping region, the second thickness being greater than the first thickness.

14. The golf club head of claim 11, wherein the prepreg strips are arranged to form a central projection of the lay-up having a first thickness and a peripheral portion surrounding the projection having a second thickness that is less than the first thickness.

15. The golf club head of claim 11, wherein the plurality of surface features have a peak to trough height of between 20 μm and 30 μm.

16. The golf club head of claim 15, wherein adjacent surface features are separated by no more than 0.6 mm.

17. The golf club head of claim 6, wherein:

the body comprises a hinge region defining a transition between the face and the crown;

the composite material of the face plate is attached directly to the hinge region of the body via the adhesive; and the hinge region is configured such that in a direction, that extends parallel to a z-axis of the club head from the sole to the crown, a void is defined between two layers of the metallic material of the body.

18. The golf club head of claim 6, wherein the non-metal face plate includes a polymer cover layer comprising a plurality of surface features to provide a mean roughness of 2.5-5 μm.

19. The golf club head of claim 18, wherein each prepreg strip comprises longitudinally extending reinforcing fibers, each fiber extending continuously from a first point on the peripheral edge of the insert to a second point on the peripheral edge of the face plate.

20. The golf club head of claim 1, wherein:

the horizontal axis is an x-axis and the face further includes a y-axis extending substantially perpendicular to the x-axis and generally parallel to the ground when the head is in the address position and a z-axis extending substantially perpendicular to the x-axis and to the y-axis;

a moment of inertia about a center-of-gravity (CG) x-axis, passing through a CG of the golf club head and parallel to the x-axis, is between about 300 kg·mm$^2$ and about 500 kg·mm$^2$;

wherein a moment of inertia about a CG z-axis, passing through the CG of the golf club head and parallel to the z-axis, is between about 450 kg·mm$^2$ and about 650 kg·mm$^2$; and the golf club head has a depth of at least 111.76 mm, a CG y-axis coordinate of 30-50 mm, and a CG z-axis coordinate of between about −10 mm and about 5 mm.

21. The golf club head of claim 1, wherein:

the cross-sectional profile of the face plate comprises a first thickness at the center of the striking surface that is greater than a second thickness at a peripheral edge of the striking surface, thereby adjusting the characteristic time at various locations along the x-axis;

the horizontal axis is an x-axis and the face further includes a y-axis extending substantially perpendicular to the x-axis and generally parallel to the ground when the head is in the address position and a z-axis extending substantially perpendicular to the x-axis and to the y-axis;

a moment of inertia about a center-of-gravity (CG) x-axis, passing through a CG of the golf club head and parallel to the x-axis, is between about 300 kg·mm$^2$ and about 500 kg·mm$^2$;

wherein a moment of inertia about a CG z-axis, passing through the CG of the golf club head and parallel to the z-axis, is between about 450 kg·mm$^2$ and about 650 kg·mm$^2$;

the golf club head has a depth of at least 111.76 mm, a CG y-axis coordinate of 30-50 mm, and a CG z-axis coordinate of between about −10 mm and about 5 mm; and the plurality of prepreg strips are arranged in a criss-cross pattern defining an overlapping region at the center of the striking surface where the strips overlap each other, wherein the cross-sectional profile of the lay-up has the first thickness at the overlapping region, and wherein the peripheral edge defining the second thickness is spaced from the overlapping region.

22. The golf club head of claim 21, wherein the non-metal face plate includes a polymer cover layer having a plurality of surface features to provide a mean roughness of 2.5-5 μm.

23. The golf club head of claim 22, further comprising a weight port configured to receive a weight, wherein the weight port has a longitudinal axis that intersects the face.

24. The golf club head of claim 22, wherein the prepreg plies include prepreg panels and the prepreg strips are arranged in at least one cluster of prepreg strips, which is located in between adjacent prepreg panels.

25. A golf club head having a more consistent trajectory and distance on impact comprising:

a heel portion;

a toe portion;

a crown;

a hosel defining a hosel axis;

a sole;

a face having a striking surface for striking a golf ball, the face having an ideal impact location at a center of the striking surface defining the origin of a coordinate system including a horizontal axis that extends substantially parallel to the face and generally parallel to the ground when the head is in an address position, with the negative direction of the horizontal axis pointing toward the heel portion and the positive direction of the horizontal axis pointing toward the toe portion, the face further having a first off-center location on the face located in a toe direction away from the center of the striking surface at 40 mm along the horizontal axis and a second off-center location on the face located in a heel direction away from the center of the striking surface at −40 mm along the horizontal axis, wherein a characteristic time at 10 mm increment locations on the face along the horizontal axis between the center of the striking surface and the second off-center location deviates from the characteristic time at the center of the striking surface by no more than 20%, wherein the face has a face size of about 4,000 mm$^2$ to about 7.000 mm$^2$, wherein face size is measured by:

(i) determining an extended front wall surface using an average bulge radius of the striking surface and an average roll radius of the striking surface, (ii) offsetting the extended front wall surface by 0.5 mm toward a center of the club head along an axis that is parallel to a face surface normal vector at the center of the striking surface, wherein the offset extended front wall surface has a boundary defined by a curved line $S_f$ at an intersection between the offset extended from wall surface and a surrounding portion of the club head external surface and a straight line that intersects $S_f$ a first location $P_a$ and at a second location $P_b$, wherein $P_a$ is the intersection of $S_f$ with a 30-mm diameter cylindrical surface that is co-axial with the hosel and the straight line is normal to the hosel axis, (iii) projecting the offset extended front wall surface onto a plane that is tangent to the center of the striking surface;

a weight port configured to receive a weight, the weight port extending from the crown and the sole in a front-to-back direction at a rear portion of the club head such that a longitudinal axis of the weight port intersects the face; and a non-metal face plate that contacts the ball at impact, wherein the face plate defines the striking surface and comprises a lay-up of multiple, composite prepreg plies, wherein at least a portion of the plies comprises a plurality of elongated prepreg strips arranged in a criss-cross pattern defining an overlapping region at the center of the striking surface where the strips overlap each other, the lay-up having a first thickness at a location spaced from the overlapping region and a second thickness at the overlapping region, the second thickness being greater than the first thickness, thereby adjusting the characteristic time at various locations along the horizontal axis.

26. The golf club head of claim 25, wherein when the weight is not received in the weight port, the weight port defines a rearward-most point of the club head when the club head is at the address position.

27. The golf club head of claim 26, wherein the longitudinal axis of the weight port is offset from a center of gravity (CG) of the club head toward the heel portion.

28. The gold club head of claim 25, wherein:

the horizontal axis is an x-axis and the face further includes a y-axis extending substantially perpendicular to the x-axis and generally parallel to the ground when the head is in the address position and a z-axis extending substantially perpendicular to the x-axis and to the y-axis;

wherein a moment of inertia about a center-of-gravity (CG) x-axis, passing through a CG of the golf club head and parallel to the x-axis, is between about 300 $kg \cdot mm^2$ and about 500 $kg \cdot mm^2$;

wherein a moment of inertia about a CG z-axis, passing through the CG of the golf club head and parallel to the z-axis, is between about 450 $kg \cdot mm^2$ and about 650 $kg \cdot mm^2$;

the golf club head comprises a body, which is made of a metallic material, and the face plate comprises a polymer cover layer having a cover layer thickness of 0.2-1.2 mm and defining the striking surface, wherein the face plate is attached directly to the body via an adhesive and the polymer cover layer includes a plurality of surface features to provide a mean roughness of 2.5-5 μm;

and the golf club head has a depth of at least 111.76 mm, a CG y-axis coordinate of 30-50 mm, and a CG z-axis coordinate of between about −10 mm and about −2 mm.

29. The golf club head of claim 28, wherein:

the body comprises a hinge region defining a transition between the face and the crown;

the composite material of the face plate is attached directly to the hinge region of the body via the adhesive; and the hinge region is configured such that in a direction, that extends parallel to the z-axis from the sole to the crown, a void is defined between two layers of the metallic material of the body.

30. The golf club head of claim 28, further comprising a weight retained by the weight port.

31. The golf club head of claim 28, further comprising a hinge region positioned about an upper edge of the insert.

32. The golf club head of claim 25, wherein:

the first thickness is at a peripheral edge of the face plate;

the horizontal axis is an x-axis and the face further includes a y-axis extending substantially perpendicular to the x-axis and generally parallel to the ground when the head is in the address position and a z-axis extending substantially perpendicular to the x-axis and to the y-axis;

a moment of inertia about a center-of-gravity (CG) x-axis, passing through a CG of the golf club head and parallel to the x-axis, is between about 300 $kg \cdot mm^2$ and about 500 $kg \cdot mm^2$;

wherein a moment of inertia about a CG z-axis, passing through the CG of the golf club head and parallel to the z-axis, is between about 450 $kg \cdot mm^2$ and about 650 $kg \cdot mm^2$; and the golf club head has a depth of at least 111.76 mm, a CG y-axis coordinate of 30-50 mm, and a CG z-axis coordinate of between about −10 mm and about 5 mm.

33. A golf club comprising:

a shaft;

a golf club head comprising:

a heel portion;

a toe portion;

a crown;

a hosel defining a hosel axis, wherein the shaft is connected to and extends from the hosel;

a sole;

a face having a striking surface for striking a golf ball, the face having an ideal impact location at a center of the striking surface defining the origin of a coordinate system including a horizontal axis that extends substantially parallel to the face and generally parallel to the ground when the head is in an address position, with the negative direction of the horizontal axis pointing toward the heel portion and the positive direction of the horizontal axis pointing toward the toe portion, the face further having a first off-center location on the face located in a toe direction away from the center of the striking surface at 40 mm along the horizontal axis and a second off-center location on the face located in a heel direction away from the center of the striking surface at −40 mm along the horizontal axis, wherein a characteristic time at 10 mm increment locations on the face along the horizontal axis between the center of the striking surface and the second off-center location deviates from the characteristic time at the center of the striking surface by no more than 20%, wherein the face has a face size of about 4,000 $mm^2$ to about 7,000 $mm^2$, wherein face size is measured by:

(i) determining an extended front wall surface using an average bulge radius of the striking surface and an average roll radius of the striking surface, (ii) offsetting the extended front wall surface by 0.5 mm toward a center of the club head along an axis that is parallel to a face surface normal vector at the center of the striking surface, wherein the offset extended front wall surface has a boundary defined by a curved line $S_f$ at an intersection between the offset extended front wall surface and a surrounding portion of the club head external surface and a straight line that intersects $S_f$ a first location $P_a$ and at a second location $P_b$, wherein $P_a$ is the intersection of $S_f$ with a 30-mm diameter cylindrical surface that is co-axial with the hosel and the straight line is normal to the hosel axis, (iii) projecting the offset extended front wall surface onto a plane that is tangent to the center of the striking surface; and, a non-metal face plate that contacts the ball at impact, wherein the face plate defines the striking surface and comprises a lay-up of multiple, composite prepreg plies, wherein at least a portion of the plies comprises a plurality of elongated prepreg strips forming one or more areas of increased thickness of the lay-up where the strips overlap each other within the lay-up;

the cross-sectional profile of the face plate comprises a first thickness at the center of the striking surface that is greater than a second thickness at a peripheral edge of the striking surface, thereby adjusting the characteristic time at various locations along the x-axis;

the horizontal axis is an x-axis and the face further includes a y-axis extending substantially perpendicular to the x-axis and generally parallel to the ground when the head is in the address position and a z-axis extending substantially perpendicular to the x-axis and to the y-axis;

a moment of inertia about a center-of-gravity (CG) x-axis, passing through a CG of the golf club head and parallel to the x-axis, is between about 300 $kg \cdot mm^2$ and about 500 $kg \cdot mm^2$;

wherein a moment of inertia about a CG z-axis, passing through the CG of the golf club head and parallel to the z-axis, is between about 450 $kg \cdot mm^2$ and about 650 $kg \cdot mm^2$;

the golf club head has a depth of at least 111.76 mm, a CG y-axis coordinate of 30-50 mm, and a CG z-axis coordinate of between about −10 mm and about 5 mm; and the plurality of prepreg strips are arranged in a criss-cross pattern defining an overlapping region at the center of the striking surface where the strips overlap each other, wherein the cross-sectional profile of the lay-up has the first thickness at the overlapping region, and wherein the peripheral edge defining the second thickness is spaced from the overlapping region.

34. The golf club of claim 33, wherein:

the club head further comprises a weight port located at a back portion of the golf club head, the back portion being on an opposite side of the golf club head as the face;

the golf club head comprises a body, which is made of a metallic material, and the face plate comprises a polymer cover layer having a cover layer thickness of 0.1-3.0 mm and defining the striking surface, wherein the face plate is attached directly to the body via an adhesive, and the plurality of composite prepreg plies includes a plurality of prepreg panels;

wherein the golf club head has a volume between 400 cc and 500 cc; and wherein the polymer cover layer includes a plurality of surface features to provide a mean roughness of 2.5-5 μm.

35. The golf club claim 34, wherein:

the club head further comprises a hinge region positioned about an upper edge of the face;

the face plate is supported by the hinge region.

36. The golf club of claim 34, wherein the cover layer thickness is 0.2-1.2 mm, wherein the prepreg strips are arranged in at least one cluster of prepreg strips located in between adjacent prepreg panels.

* * * * *